US012478131B1

(12) United States Patent
Frenkel

(10) Patent No.: US 12,478,131 B1
(45) Date of Patent: Nov. 25, 2025

(54) EASY ON FOOTWEAR ASSEMBLY AND METHOD OF USE

(71) Applicant: Mark Frenkel, Naples, FL (US)

(72) Inventor: Mark Frenkel, Naples, FL (US)

( * ) Notice: Subject to any disclaimer, the term of this patent is extended or adjusted under 35 U.S.C. 154(b) by 148 days.

(21) Appl. No.: 18/105,875

(22) Filed: Feb. 5, 2023

Related U.S. Application Data

(60) Provisional application No. 63/356,023, filed on Jun. 27, 2022, provisional application No. 63/307,128, filed on Feb. 6, 2022.

(51) Int. Cl.
*A43B 11/00* (2006.01)
*A43B 3/24* (2006.01)
*A43B 13/36* (2006.01)

(52) U.S. Cl.
CPC ..... *A43B 11/00* (2013.01); *A43B 3/244* (2013.01); *A43B 13/36* (2013.01)

(58) Field of Classification Search
CPC ..... A43B 3/24; A43B 3/242; A43B 3/244; A43B 3/246; A43B 13/36; A43B 11/00
See application file for complete search history.

(56) References Cited

U.S. PATENT DOCUMENTS 2,438,711 A 3/1948 Leach et al.
2,510,236 A 6/1950 Kutcher
3,890,725 A 6/1975 Lea et al.
3,983,642 A 10/1976 Liao
4,363,177 A 12/1982 Boros
4,450,633 A 5/1984 Connelly
4,974,344 A * 12/1990 Ching ..... A43B 3/24 36/15
5,802,738 A * 9/1998 Ferniani ..... A43B 3/103 36/11.5
5,992,058 A 11/1999 Jneid
6,170,131 B1 1/2001 Shin
6,349,486 B1 2/2002 Lin
6,581,255 B2 * 6/2003 Kay ..... A43B 3/122 24/640

(Continued)

FOREIGN PATENT DOCUMENTS

CN 2058565 U 6/1990
JP 5123304 B2 1/2013

(Continued)

*Primary Examiner* — F Griffin Hall
(74) *Attorney, Agent, or Firm* — Allen D Hertz, P.A.; Allen D. Hertz

(57) ABSTRACT

A method for assisting placement of a footwear onto a foot by utilizing footwear having an upper and lower assembled together by joining upper and lower fasteners. One of the upper and lower is placed against the foot in an appropriate position and the other of the upper and lower is subsequently located in the other appropriate position. The upper and lower fasteners are joined, assembling the upper and lower about the foot. Another method utilizes a heel insert, wherein contraction of the heel insert allows insertion of the foot. Once the foot is inserted, the contracting force is released and the insert returns to a relaxed state, retaining the foot within the footwear. The heel insert preferably conforms to the heel when in use. In another arrangement, the upper and lower are slideably assembly by a sliding mechanism enabling opening and closing a foot insertion region.

20 Claims, 43 Drawing Sheets

(56) References Cited

U.S. PATENT DOCUMENTS 6,895,697 B2 * 5/2005 Yang ..... A43B 3/244 36/101
6,931,766 B2 * 8/2005 Greene ..... A43B 3/122 36/15
7,117,615 B2 * 10/2006 Gerber ..... A43B 3/24 36/11.5
7,210,250 B2 5/2007 Gallegos
7,219,445 B2 5/2007 Stern et al.
7,823,300 B2 11/2010 Fullerton et al.
8,020,318 B2 * 9/2011 Khalifa ..... A43B 1/0027 36/103
8,201,347 B2 6/2012 Garza
8,245,418 B2 8/2012 Paintin et al.
8,307,570 B2 * 11/2012 Delgatty ..... A43B 13/189 36/15
8,943,713 B1 2/2015 Eidson
9,301,570 B2 4/2016 Hwang
9,788,607 B2 * 10/2017 Waatti ..... A43B 3/244
10,143,261 B2 12/2018 Perkins et al.
11,160,326 B2 * 11/2021 Bramani ..... A43B 3/244
2004/0187346 A1 * 9/2004 Bianchi ..... A43B 3/244 36/24
2008/0098623 A1 5/2008 Komitau
2012/0174435 A1 7/2012 Ruano Cerdan et al.
2012/0260530 A1 10/2012 Policastro
2014/0033568 A1 2/2014 Pearson
2014/0196307 A1 * 7/2014 Fremming ..... A43B 3/244 36/15
2015/0040434 A1 2/2015 Perkins et al.
2015/0305432 A1 10/2015 Wiens
2017/0079370 A1 3/2017 Hashish et al.
2018/0084868 A1 3/2018 Feinstein
2018/0192732 A1 7/2018 Cosper
2018/0303194 A1 10/2018 Naughton
2020/0359743 A1 11/2020 Bentvelzen et al.
2021/0108660 A1 4/2021 Russell-Clarke et al.
2021/0204637 A1 * 7/2021 Deepesh ..... A43B 1/0054
2022/0022592 A1 * 1/2022 Kundani Kumta .... A43B 3/244

FOREIGN PATENT DOCUMENTS

WO WO2013007895 A1 1/2013
WO WO2020086294 A1 4/2020

* cited by examiner

EASY ON FOOTWEAR ASSEMBLY AND METHOD OF USE

RELATED APPLICATIONS

This Non-Provisional Application claims the benefit of each of:

A) U.S. Provisional Patent Application Ser. No. 63/307,128, filed on Feb. 6, 2022, and B) U.S. Provisional Patent Application Ser. No. 63/356,023, filed on Jun. 27, 2022, both of which are incorporated herein in their entireties by reference.

FIELD OF THE INVENTION

The present disclosure generally relates to an arrangement to aid a process of placing footwear upon a foot of a person. In one arrangement, the footwear is provided in an upper portion and a lower portion that are joined to one another by joining interface following placement upon the person's foot. In a second arrangement, a heel insert is placed within an interior surface of the footwear and located against the back of the heel. The heel insert is arranged to be retracted to enable insertion and removal of the person's foot from the footwear and relaxed to retain the person's foot within the footwear. In a third arrangement, the upper portion is slideably assembled to the lower and controlled by a locking mechanism.

BACKGROUND OF THE INVENTION

Footwear is provided in many different forms. The footwear is secured to a person's foot using any suitable arrangement.

A first example is an enclosed shoe comprising an enclosed upper assembled to a lower where an opening through the upper is expanded and contracted using laces, elastic, a dense hook and loop tape, or the like. Enclosed footwear is considered an optimal design to retain the footwear on a person's foot. Unfortunately, enclosed footwear can also be difficult to place upon a person's foot, particularly in certain circumstances. Enclosed footwear is preferred for use with young children, disabled persons, elderly persons, and in a number of other conditions. Placing enclosed footwear can be difficult to place upon a person's foot, particularly for placement upon feet of young children, disabled persons, elderly persons, and person's having a number of other limiting conditions. The enclosed footwear requires angling of the person's foot, insertion of the foot through an opening in the upper of the enclosed footwear, quickly curling the person's against an insole, then forwarding the person's foot into the toe section of the enclosed footwear. Once the foot is seated within the enclosed footwear, the shoe is commonly tightened to remain on the foot. This is accomplished using laces, a strap, a buckle, or any other suitable arrangement for securing footwear onto a person's foot.

A second example is an open or slip on design, where the upper may or may not include an opening, such as a slipper, a loafer, a sandal, a flip-flop, a slider, and the like and the footwear is placed upon the person's foot without any manipulation of the footwear.

Enclosed footwear includes another limitation. A shape of the heel and length between a toe and the heel of the enclosed footwear can be too large. This condition is commonly addressed by inserting a heel pad within the shoe interior and securing the heel pad to the interior surface of the footwear.

Footwear is known to be offered in a variety of configurations. Several offerings provide an arrangement including an upper and a lower, where the upper and lower are assembled to one another prior to placement upon the wearer's foot. This arrangement is offered for flexibility of the aesthetics of the footwear; enabling a user to exchange an upper of one material, pattern, and/or design with an upper having a different material, pattern, and/or design. These offered forms of footwear are provided in a form of sandals or other open back shoes, which are designed to be slid on after assembly.

A person's foot can vary in shape and size. This becomes more of a factor when dealing with people with medical conditions, birth defects, disabilities or any other condition that might impact a fit of the footwear upon the person's foot. In one example, the person's foot becomes enlarged as a result of poor circulation. The enlarged foot commonly is either uncomfortable or worse, would not fit in commonly sized footwear. In a second example, a person may be born with one leg shorter than the other, that person commonly requires custom footwear, wherein one shoe has a different sole height compared to the other shoe. In a third example, a patient may have had a procedure done on one foot and would require sufficient sizing for any post procedure dressing.

Footwear can include one or more wheels and configured in a variety of form factors. Examples include various styled wheeled footwear sold under the brand HEELYS, SPEED by ROLLERKICK, MOONWALKERS by Shift Robotics, and others. The wheeled footwear is offered in two different form factors: (1) an enclosed shoe, generally similar to a pair of sneakers, and (2) a strap on that is intended to cover an already worn shoe. In either scenario, each of the wheeled footwear requires placement of a common shoe having an enclosed upper upon a foot of the person, and therefore have the same inherent difficulties of being placed upon a person's foot as described above.

What is desired is a new apparatus and method of use that aids in a process of placing footwear upon a person's foot.

BRIEF DESCRIPTION OF THE INVENTION

The present invention provides an arrangement that aids in a process of placing footwear upon a person's foot.

In a general scope of the present invention, a method for aiding placement of footwear onto a person's foot, the method comprising steps of:

- placing a first member of an easy on footwear proximate a first portion of the person's foot, wherein the first member including at least first member fastener and a second member of the easy on footwear including at least one second member fastener, wherein the first member fastener and the second member fastener are designed to mate with one another;
- positioning the second member of the easy on footwear proximate a second portion of the person's foot and in alignment with the first member of the easy on footwear; and
- joining each first member fastener and each respective second member fastener with one another.

In a more detailed, general scope of the present invention, a method for aiding placement of footwear onto a person's foot, the method comprising steps of:

placing an upper of an easy on footwear proximate a top portion of the person's foot, wherein the easy on footwear comprising an upper including at least one upper fastener and a lower including at least one lower fastener, wherein the upper fastener and the lower fastener are designed to mate with one another;

positioning the lower proximate a bottom portion of the person's foot and in alignment with the upper; and joining each upper fastener and each respective lower fastener with one another.

In another more detailed, general scope of the present invention, a method for aiding placement of footwear onto a person's foot, the method comprising steps of:

placing the lower proximate a bottom portion of the person's foot, wherein the easy on footwear comprising an upper including at least one upper fastener and a lower including at least one lower fastener, wherein the upper fastener and the lower fastener are designed to mate with one another;

positioning an upper of an easy on footwear proximate a top portion of the person's foot and in alignment with the lower; and joining each upper fastener and each respective lower fastener with one another.

In one aspect, the footwear comprising:

an upper having an enclosed circumference defining a foot passageway, an attachment edge along an lower edge of the upper, the attachment edge of the upper including a toe portion, a lateral portion, a heel edge portion, and a medial portion, at least one fastening element carried by the upper proximate the attachment edge of the upper, and a lower having a sole and a sidewall, an attachment edge along an upper edge of the sidewall of the lower, the attachment edge of the lower including a toe portion, a lateral portion, a heel edge portion, and a medial portion, and at least one mating fastening element carried by the lower proximate the attachment edge of the lower, wherein the lateral portion of the upper and lower are detached from one another, wherein the medial portion of the upper and lower are detached from one another, wherein at least one of:

(a) the toe portion of the attachment edge of the upper and the toe portion of the attachment edge of the lower are detached from one another, and (b) the heel portion of the attachment edge of the upper and the heel portion of the attachment edge of the lower are detached from one another.

In a second aspect, the footwear comprising:

an upper having an enclosed circumference defining a foot passageway, an attachment edge along an lower edge of the upper, the attachment edge of the upper including a toe portion, a lateral portion, a heel portion, and a medial portion, at least one fastening element carried by the upper proximate the attachment edge of the upper, and a lower having a sole and a sidewall, an attachment edge along an upper edge of the sidewall of the lower, the attachment edge of the lower including a toe portion, a lateral portion, a heel edge portion, and a medial portion, and at least one mating fastening element carried by the lower proximate the attachment edge of the lower, wherein at least three of:

(a) the toe portion of the attachment edge of the upper and the toe portion of the attachment edge of the lower are detached from one another, (b) the lateral portion of the attachment edge of the upper and the lateral portion of the attachment edge of the lower are detached from one another, (c) the heel portion of the attachment edge of the upper and the heel portion of the attachment edge of the lower are detached from one another, and (d) the medial portion of the attachment edge of the upper and the medial portion of the attachment edge of the lower are detached from one another.

In another aspect, the upper can be provided in different sizes, shapes and/or styles that would be compatible with the lower.

In yet another aspect, the lower can be provided in different sizes, shapes and/or styles that would be compatible with the upper.

In yet another aspect, the upper and the lower can be hinged to one another.

In yet another aspect, the upper and the lower are hinged to one another, wherein the hinge is located pivotally connecting a heel portion of the upper and a heel portion of the lower to one another.

In yet another aspect, the upper and the lower are hinged to one another, wherein the hinge is located pivotally connecting a toe portion of the upper and a toe portion of the lower to one another.

In yet another aspect, the upper and the lower are hinged to one another, wherein the hinge is located pivotally connecting an outsole portion of the upper and an outsole portion of the lower to one another.

In yet another aspect, the upper and the lower are hinged to one another, wherein the hinge is located pivotally connecting an insole portion of the upper and an insole portion of the lower to one another.

In yet another aspect, the upper fastener and the lower fastener can be collectively referred to as an upper and lower fastening system.

In yet another aspect, the upper includes a plurality of upper fasteners and the lower includes a plurality of lower fasteners.

In another aspect, each upper fastener is designed to include at least a portion that is inserted into the respective lower fastener.

In another aspect, each lower fastener is designed to include at least a portion that is inserted into the respective upper fastener.

In another aspect, at least a portion of a series of upper fasteners are designed to include at least a portion that is inserted into each respective lower fastener.

In another aspect, at least a portion of a series of lower fasteners are designed to include at least a portion that is inserted into each respective upper fastener.

In yet another aspect, the upper fastener and the lower fastener are secured by a magnetic attraction between the upper fastener and the lower fastener.

In yet another aspect, the upper fastener and the lower fastener are secured by a magnetic attraction between the upper fastener and the lower fastener, wherein ends of the upper fastener and the lower fastener abut one another.

In yet another aspect, the upper fastener and the lower fastener are secured by a magnetic attraction between the upper fastener and the lower fastener, wherein at least a portion of the upper fastener is inserted into a cavity formed in the lower fastener.

In yet another aspect, the upper fastener and the lower fastener are secured by a magnetic attraction between the upper fastener and the lower fastener, wherein at least a portion of the lower fastener is inserted into a cavity formed in the upper fastener.

In another aspect, at least a first portion of a series of upper fasteners are designed to include at least a portion that is inserted into each respective lower fastener and at least a second portion of a series of lower fasteners are designed to include at least a portion that is inserted into each respective upper fastener.

In yet another aspect, the upper fastener at least partially contains a magnetically charged material.

In yet another aspect, the upper fastener is fabricated of a magnetically charged material.

In yet another aspect, the lower fastener at least partially contains a magnetically charged material.

In yet another aspect, the lower fastener is fabricated of a magnetically charged material.

In yet another aspect, the upper fastener employs a magnetically charged material and the lower fastener includes a magnetically attracted material.

In yet another aspect, the upper fastener employs a magnetically attracted material and the lower fastener includes a magnetically charged material.

In yet another aspect, the upper fastener employs a magnetically charged material and the lower fastener includes a magnetically charged material.

In yet another aspect, the upper fastener employs a magnetically charged material and the lower fastener includes a magnetically charged material, wherein the upper fastener and the lower fastener are oriented having the magnetically charged materials being attracting to one another.

In yet another aspect, the upper fastener and the lower fastener are assembled using a vertical insertion motion.

In yet another aspect, the upper fastener and the lower fastener are assembled using a horizontal insertion motion.

In yet another aspect, the upper fastener and the lower fastener are assembled using a vertical insertion motion and subsequently a horizontal insertion motion.

In yet another aspect, the upper fastener and the lower fastener are assembled using an insertion motion in a first direction and subsequently insertion motion in a second direction, wherein the insertion motion in the second direction retains the upper fastener and the lower fastener from moving in the first direction, thus locking the upper fastener and the lower fastener with one another.

In yet another aspect, the upper fastener and the lower fastener are assembled using an insertion motion in a first direction and subsequently insertion motion in a second direction, wherein the insertion motion in the second direction retains the upper fastener and the lower fastener from moving in the first direction, thus locking the upper fastener and the lower fastener with one another, wherein the first direction and the second direction are not parallel to one another.

In yet another aspect, the upper fastener and the lower fastener are assembled using a vertical insertion motion and subsequently a horizontal insertion motion, wherein the horizontal insertion motion retains the upper fastener and the lower fastener from moving in the vertical direction, thus locking the upper fastener and the lower fastener with one another.

In yet another aspect, the upper fastener and the lower fastener are assembled using a horizontal insertion motion and subsequently a vertical insertion motion, wherein the vertical insertion motion retains the upper fastener and the lower fastener from moving in the horizontal direction, thus locking the upper fastener and the lower fastener with one another.

In yet another aspect, the upper fastener and the lower fastener are assembled using a first element that is positioned by a motion along a first direction and a second element that is positioned by a motion along a second direction.

In yet another aspect, the upper fastener and the lower fastener are assembled using a first element that is positioned by a motion along a first direction and a second element that is positioned by a motion along a second direction, wherein the second element retains the first element from moving in the first direction.

In yet another aspect, the upper fastener and the lower fastener are assembled using a first element that is positioned by a motion along a first direction and a second element that is positioned by a motion along a second direction, wherein the second element retains the first element from moving in the first direction until the second element is repositioned or disengaged from the first element.

In yet another aspect, the upper fastener and the lower fastener are assembled using a first element that is secured by a motion along a first direction and a second element that is secured by a motion along a second direction.

In yet another aspect, the upper fastener and the lower fastener are assembled using a first element that is inserted in a first direction and a second element that is inserted in a second direction.

In yet another aspect, the upper fastener and the lower fastener are assembled by inserting a tongue of one of the upper fastener and the lower fastener into a socket of the second of the upper fastener and the lower fastener.

In yet another aspect, the upper fastener and the lower fastener are assembled by inserting a tongue of one of the upper fastener and the lower fastener into a groove of the second of the upper fastener and the lower fastener.

In yet another aspect, the upper fastener is secured to the upper using a material having elastic properties.

In yet another aspect, the upper fastener is secured to the upper using an elastic material.

In yet another aspect, the upper fastener is secured to the upper wherein the upper includes a material having elastic properties.

In yet another aspect, the upper fastener is secured to the upper wherein the upper includes an elastic material.

In yet another aspect, the upper fastener is an elongated member.

In yet another aspect, the upper fastener is an elongated member comprising at least one notch.

In yet another aspect, the upper fastener is an elongated member comprising at least one notch, wherein the at least one notch is designed to increase flexibility when the elongated member is bent.

In yet another aspect, the upper fastener is an elongated member comprising a plurality of notches.

In yet another aspect, the upper fastener is an elongated member comprising a plurality of notches, wherein the plurality of notches are designed to increase flexibility when the elongated member is bent.

In yet another aspect, the upper fastener and the lower fastener are secured to one another using a twist and lock element.

In yet another aspect, the upper fastener includes an upper aperture and the lower fastener includes a lower aperture, and the the upper fastener and the lower fastener are secured to one another by inserting a locking portion of the twist and lock element through each of the upper aperture and the lower aperture and subsequently rotated.

In yet another aspect, the twist and lock element further comprising a flange located to contact an opposite side of the the upper fastener and the lower fastener than the locking portion of the twist and lock element.

In yet another aspect, the upper fastener and the lower fastener comprise a snap cap, a snap socket, a stud or ball and optionally a stud lock. In one arrangement the snap cap and the snap socket would be secured to the upper and the stud or ball would be secured to the lower. The stud or ball can be secured to the lower using the stuck lock or any other suitable assembly interface.

In yet another aspect, a first fastener element of the upper fastener and the lower fastener includes a boss feature and a second, mating fastener element of the upper fastener and the lower fastener includes a deboss having a size and shape to receive the boss feature.

In yet another aspect, a first fastener element of the upper fastener and the lower fastener includes a boss feature and a second, mating fastener element of the upper fastener and the lower fastener includes a deboss having a size and shape to receive the boss feature, wherein engagement between the boss and the deboss deters motion in any direction other than the assembly/insertion direction.

In yet another aspect, a first fastener element of the upper fastener and the lower fastener includes a pin feature and a second, mating fastener element of the upper fastener and the lower fastener includes a bore having a size and shape to receive the pin feature.

In yet another aspect, a first fastener element of the upper fastener and the lower fastener includes a pin feature and a second, mating fastener element of the upper fastener and the lower fastener includes a bore having a size and shape to receive the pin feature, wherein engagement between the pin and the bore deters motion in any direction other than the assembly/insertion direction.

In yet another aspect, at least a portion of the upper is fabricated of a woven material.

In yet another aspect, at least a portion of the upper is fabricated of a synthetic material.

In yet another aspect, at least a portion of the upper is fabricated of a canvas material.

In yet another aspect, at least a portion of the upper is fabricated of a leather material.

In yet another aspect, at least a portion of the upper is fabricated of a foam material.

In yet another aspect, at least a portion of the upper is fabricated of a molded foam material.

In yet another aspect, at least a portion of the upper is fabricated of a plastic material.

In yet another aspect, at least a portion of the upper is fabricated of a molded plastic material.

In yet another aspect, at least a portion of the upper is fabricated of a silicone material.

In yet another aspect, at least a portion of the upper is fabricated of a nylon material.

In yet another aspect, at least a portion of the upper is fabricated of a polyvinyl chloride (PVC) material.

In yet another aspect, at least a portion of the upper is fabricated of a composite material.

In yet another aspect, at least a portion of the lower is fabricated of a rubber material.

In yet another aspect, at least a portion of the lower is fabricated of a thermoplastic rubber material.

In yet another aspect, at least a portion of the lower is fabricated of a synthetic material.

In yet another aspect, at least a portion of the lower is fabricated of a foam material.

In yet another aspect, at least a portion of the lower is fabricated of a leather material.

In yet another aspect, at least a portion of the lower is fabricated of a silicone material.

In yet another aspect, at least a portion of the lower is fabricated of a polyurethane material.

In yet another aspect, at least a portion of the lower is fabricated of a thermoplastic polyurethane material.

In yet another aspect, at least a portion of the lower is fabricated of a nylon material.

In yet another aspect, at least a portion of the lower is fabricated of a knits material.

In yet another aspect, at least a portion of the lower is fabricated of an Acrylonitrile Butadiene Styrene (ABS) material.

In yet another aspect, at least a portion of the lower is fabricated of an Ethylene Vinyl Acetate (EVA) material.

In yet another aspect, at least a portion of the lower is fabricated of a composite material.

In a general scope of a method of easing a process of placing a footwear onto a person's foot, the method comprising steps of:

applying a contraction force to a heel insert, the heel insert having a securing and release surface; a support surface, and a pliancy between the securing and release surface and the support surface, the heel insert being located within an interior of the footwear and placing the support surface against an interior surface of the heel of the footwear, wherein the contraction force draws the securing and release surface towards the heel;

placing the person's foot into the footwear; and releasing the contraction force from the heel insert, wherein when the contraction force is released, a restoration force is generated by the pliancy between the support surface and the securing and release surface, returning the securing and release surface towards a heel of the inserted person's foot.

In a first aspect, the heel insert is inserted into footwear which is enclosed.

In a second aspect, the pliancy is provided by a medium located between the securing and release surface and the support surface.

In another aspect, the pliancy is provided by a pliant material located between the securing and release surface and the support surface.

In yet another aspect, the pliancy is provided by a gas located between the securing and release surface and the support surface.

In yet another aspect, the pliancy is provided by a gas encased within an interior volume located between the securing and release surface and the support surface.

In yet another aspect, the pliancy is provided by air located between the securing and release surface and the support surface.

In yet another aspect, the pliancy is provided by air encased within an interior volume located between the securing and release surface and the support surface.

In yet another aspect, the pliancy is provided by a material that is shaped to define the securing and release surface and the support surface.

In yet another aspect, the contraction force is provided by a pull member.

In yet another aspect, the pull member includes a shaft member extending through the heel of the footwear and a grip secured to an end of the shaft member located externally to the footwear.

In yet another aspect, the pull member includes a shaft member extending through the heel of the footwear, a grip secured to an end of the shaft member located externally to the footwear and an attachment member secured to an end of the shaft member located internally to the footwear.

In yet another aspect, the pull member includes a shaft member extending through the heel of the footwear, a grip secured to an end of the shaft member located externally to the footwear and an attachment member secured to an end of the shaft member located internally to the footwear and in contact with the securing and release surface.

In yet another aspect, the pull member includes a shaft member extending through the heel of the footwear, a grip secured to an end of the shaft member located externally to the footwear an end of the shaft member located internally to the footwear and secured to the securing and release surface.

In yet another aspect, the contraction force is provided by a pull member, wherein the pull member passes through the heel of the footwear.

In yet another aspect, the pliancy is provided by a biasing member extending between an internal surface of the securing and release surface and an internal surface of the support surface.

In yet another aspect, the contraction force is provided by a lever provided on an exterior of the footwear.

In yet another aspect, the contraction force is provided by a lever provided on an exterior of the footwear, the lever is continuous with a footwear heel securing and release panel.

In yet another aspect, the contraction force is provided by a lever provided on an exterior of the footwear, the lever is continuous with a footwear heel securing and release panel and the footwear heel securing and release member passes through the heel of the footwear.

In yet another aspect, the securing and release panel and the control member are fabricated of a plastic material.

In yet another aspect, the securing and release panel and the control member are fabricated of a composite material.

In yet another aspect, the securing and release panel and the control member are fabricated of a carbon fiber material.

In yet another aspect, the securing and release panel and the control member are fabricated of a metal.

In yet another aspect, the securing and release panel and the control member are fabricated of a spring metal.

In yet another aspect, the securing and release panel is covered with a pliant material.

In yet another aspect, the securing and release panel is covered with a padded material.

In another aspect of the present invention, a method for aiding placement of footwear onto a person's foot, the method comprising steps of:

- sliding an upper of the footwear and a lower of the footwear in a direction opening a foot insertion region, wherein the upper and the lower are slideably assembled to one another via a sliding mechanism;
- inserting the person's foot through the foot insertion region of the footwear;
- resting the person's foot against an insole of the lower;
- sliding the upper and the lower of the footwear in a direction closing the foot insertion region; and
- securing the upper and lower in position, retaining the footwear on the foot.

In a first aspect, the sliding mechanism comprising a tongue or tail slideably engaging within a slot or groove.

In a second aspect, the sliding mechanism comprising a tongue or tail slideably engaging within a slot or groove, wherein the tongue has a bulbous cross sectional shape and the slot is formed as a c shaped channel.

In another aspect, the sliding mechanism comprising a tongue or tail slideably engaging within a slot or groove, wherein the tongue has a circular cross sectional shape and the slot is formed as a circular shaped channel.

In yet another aspect, the sliding mechanism comprising a tongue or tail slideably engaging within a slot or groove, wherein the tongue has a trapezoidal cross sectional shape and the slot is formed as an inverted trapezoidal channel.

In yet another aspect, the sliding mechanism comprising a tongue or tail slideably engaging within a slot or groove, wherein the tongue has an T shaped cross sectional shape and the slot is formed as an inverted T shaped channel.

In yet another aspect, the sliding mechanism comprising a tongue or tail slideably engaging within a slot or groove, wherein the tongue has an L shaped cross sectional shape and the slot is formed as an inverted L shaped channel.

In yet another aspect, the sliding mechanism further comprising a biasing element to return the upper and lower to a closed, wearing configuration.

In yet another aspect, the sliding mechanism further comprising a biasing element to return the upper and lower to a closed, wearing configuration, wherein the biasing element is a material having elastic properties.

In yet another aspect, the sliding mechanism further comprising a biasing element to return the upper and lower to a closed, wearing configuration, wherein the biasing element is an elastic.

In yet another aspect, the sliding mechanism further comprising a biasing element to return the upper and lower to a closed, wearing configuration, wherein the biasing element is an spring.

In yet another aspect, the sliding mechanism further comprising a locking mechanism.

In yet another aspect, the sliding mechanism further comprising a locking mechanism which secures the upper and lower in position.

In yet another aspect, the locking mechanism employs a mechanical interface to retain the upper and lower in position.

In yet another aspect, the locking mechanism employs a mechanical interface to retain the upper and lower in position, wherein the mechanical interface includes a series of teeth.

In yet another aspect, the locking mechanism employs friction to retain the upper and lower in position.

In yet another aspect, the locking mechanism pivots between a locking state and releasing state.

In yet another aspect, the locking mechanism is drawn in a direction to toggle between a locking state and releasing state.

In yet another aspect, the locking mechanism is drawn in a direction to toggle between a locking state and releasing state, wherein a biasing element provides a resistance and restoration force to the drawing motion.

In yet another aspect, the locking mechanism is drawn in a direction to toggle between a locking state and releasing state, wherein a biasing element provides a resistance and restoration force to the drawing motion, the biasing element being a spring.

In yet another aspect, the locking mechanism is drawn (pulled or pushed) in a direction to toggle between a locking state and releasing state, wherein a biasing element provides a resistance and restoration force to the drawing motion, the biasing element being a coil spring.

In yet another aspect, the locking mechanism is drawn (pulled or pushed) in a direction to toggle between a locking state and releasing state, wherein a biasing element provides a resistance and restoration force to the drawing motion, the biasing element being a cantilever spring.

In yet another aspect, a retention system can employ a magnetically attracting elements.

In yet another aspect, the retention system can employ a magnetically charged element and a magnetically attracting element.

In yet another aspect, the retention system can employ a pair of magnetically charged elements.

In yet another aspect, the lower can further comprise one wheel.

In yet another aspect, the lower can further comprise one wheel, wherein the one wheel is retractable.

In yet another aspect, the lower can further comprise one wheel, wherein the one wheel is retractable, toggling between a retracted position where a lower quadrant of the wheel is retracted above a contacting surface of the sole or lower of the shoe and an extended position where a lower quadrant of the wheel is positioned below the contacting surface of the sole or lower of the shoe.

In yet another aspect, the lower can further comprise one wheel located proximate a heel of the footwear.

In yet another aspect, the lower can further comprise one retractable wheel located proximate a heel of the footwear.

In yet another aspect, the lower can further comprise at least two wheels.

In yet another aspect, the lower can further comprise at least two wheels, wherein a first wheel of the two wheels and a second wheel of the two wheels are each arranged having a rotational axis substantially in line with one another along an axis that is tangential or perpendicular to an elongated axis of the footwear.

In yet another aspect, the lower can further comprise at least two wheels, wherein a first wheel of the two wheels and a second wheel of the two wheels are each arranged having a circumference that is substantially in line with one another along an elongated axis of the footwear.

In yet another aspect, the lower can further comprise at least two wheels, wherein a first wheel of the two wheels and a second wheel of the two wheels are each arranged having a circumference that is substantially in line with one another along an elongated central axis of the footwear.

In yet another aspect, the lower can further comprise at least two wheels, wherein each of the at least two wheels are positioned having a lower quadrant that is located below a lowest portion of the adjacent region of a sole of the footwear.

In yet another aspect, the lower can further comprise at least two wheels, wherein each of the at least two wheels are retractable within the lower of the footwear.

In yet another aspect, the lower can further comprise at least two wheels, wherein each of the at least two wheels are retractable within the lower of the footwear and extendable wherein the lower quadrant of each wheel would be located below the lowest portion of the adjacent region of the sole of the footwear.

In yet another aspect, the lower can further comprise at least three wheels, wherein a first wheel of the three wheels and a second wheel of the three wheels are each arranged having a rotational axis substantially in line with one another along an axis that is tangential or perpendicular to an elongated axis of the footwear and a third wheel of the at least three wheels is arranged having a rotational axis substantially parallel with the rotational axis of the first wheel and the second wheel.

In yet another aspect, the lower can further comprise at least three wheels, wherein a first wheel of the three wheels and a second wheel of the three wheels are each arranged having a rotational axis substantially in line with one another along an axis that is tangential or perpendicular to an elongated axis of the footwear and a third wheel of the at least three wheels is arranged having a rotational axis substantially parallel with the rotational axis of the first wheel and the second wheel, wherein the first wheel and the second wheel are located proximate a heel of the footwear and the third wheel is located proximate a toe of the footwear.

In yet another aspect, the lower can further comprise at least three wheels, wherein a first wheel of the three wheels and a second wheel of the three wheels are each arranged having a rotational axis substantially in line with one another along an axis that is tangential or perpendicular to an elongated axis of the footwear and a third wheel of the at least three wheels is arranged having a rotational axis substantially parallel with the rotational axis of the first wheel and the second wheel, wherein the first wheel and the second wheel are located proximate a tow of the footwear and the third wheel is located proximate a heel of the footwear.

In yet another aspect, one or more of the at least two wheels is rotated by a mobility assistance system controller.

In yet another aspect, one or more of the at least two wheels is rotated by the mobility assistance system controller, wherein the mobility assistance system controller includes at least one motor.

In yet another aspect, one or more of the at least two wheels is rotated by the mobility assistance system controller, wherein the mobility assistance system controller includes at least one motor powered by a portable electrical power source.

In yet another aspect, one or more of the at least two wheels is rotated by the mobility assistance system controller, wherein the mobility assistance system controller includes a torque converter connected to at least one motor, the at least one motor being powered by a portable electrical power source.

In yet another aspect, one or more of the at least two wheels is rotated by the mobility assistance system controller, wherein the mobility assistance system controller includes a torque converter integrated transferring power from the at least one motor to the one or more of the at least two wheels, the at least one motor being powered by a portable electrical power source.

In yet another aspect, the torque converter is at least one gear set.

In yet another aspect, the torque converter is at least one direct drive gear set.

In yet another aspect, the torque converter is at least one belt drive gear set.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PRESENT INVENTION

Footwear, particularly enclosed footwear, can be difficult to place upon a person's foot. This is particularly difficult for people in certain groups, including children, elderly, patient's recovering from foot and/or ankle surgery, disabled persons, and the like.

Figure 1:
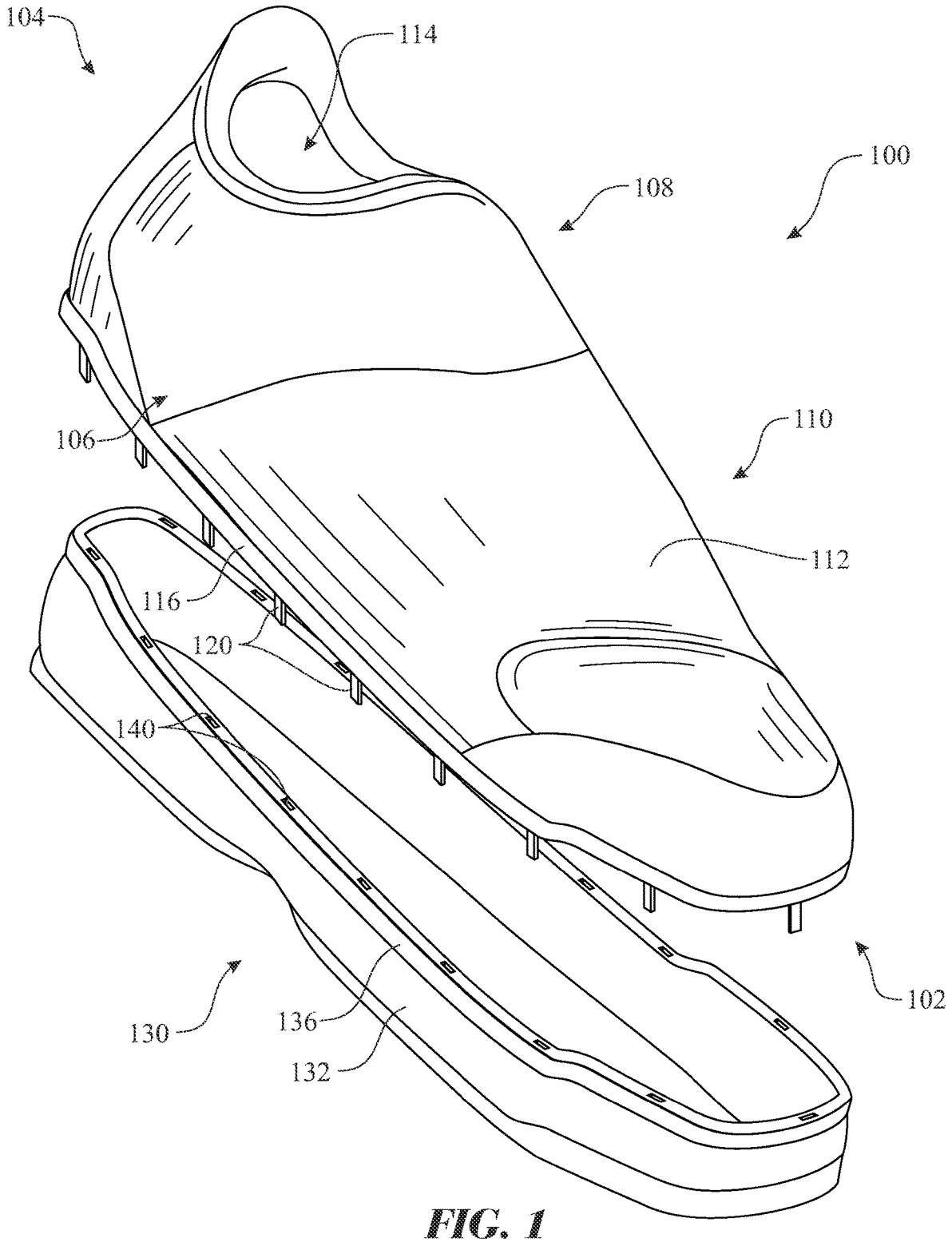
FIG. 1 presents a perspective top side view of an exemplary easy on footwear, the footwear illustrated in an exploded assembly view.
Figure 2:
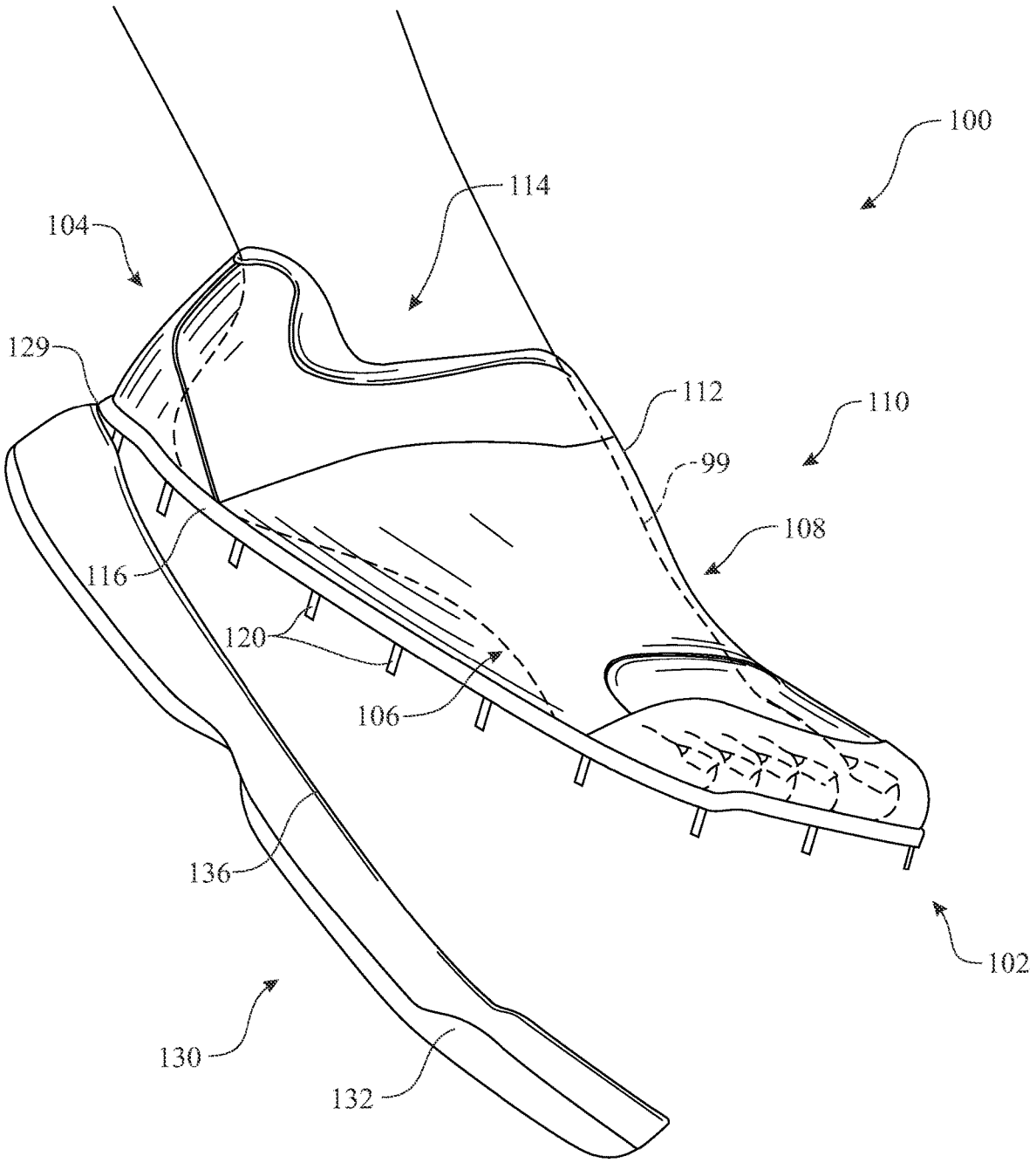
FIG. 2 presents a perspective side view of the exemplary easy on footwear originally introduced in FIG. 1, the footwear illustrated including a heel located hinged assembly and shown in a first exemplary placement step locating an upper upon a foot of a person.
Figure 3:
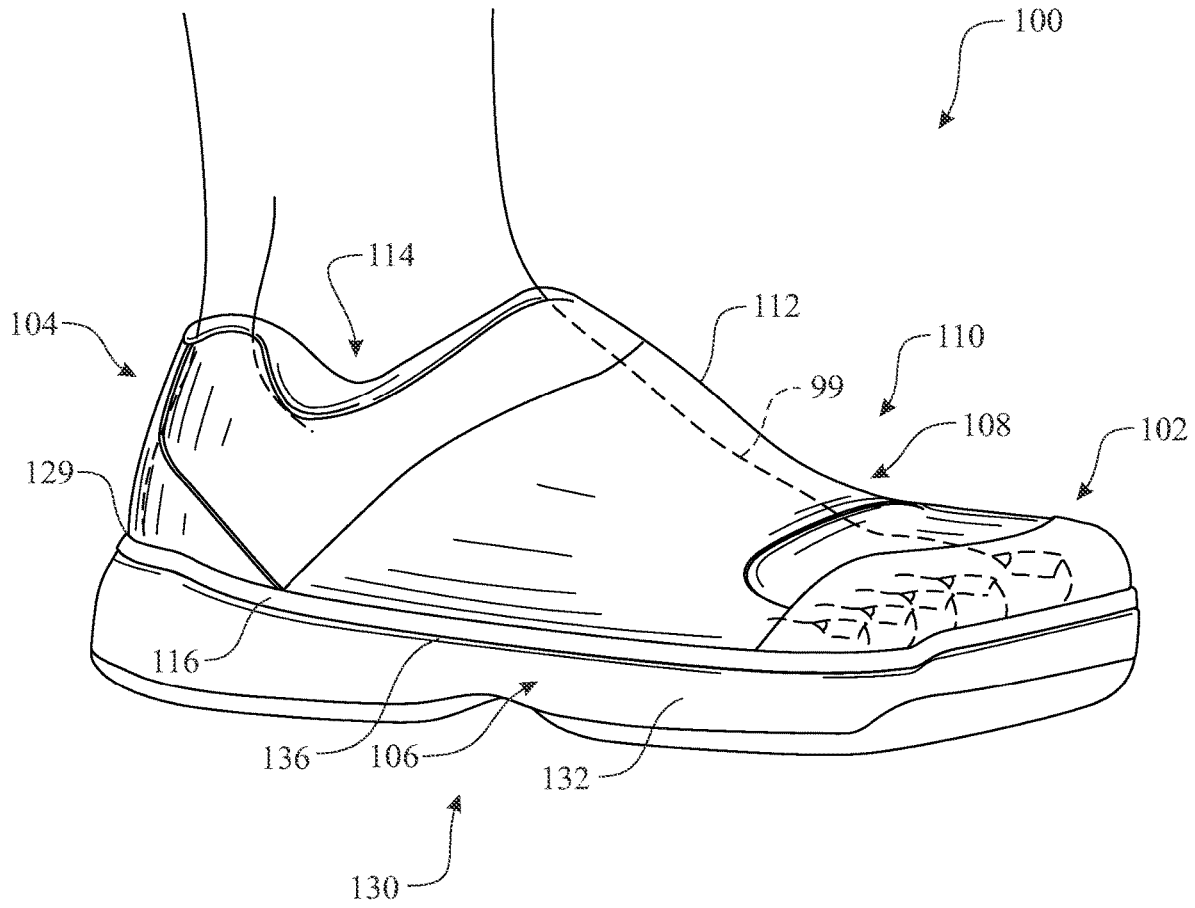
FIG. 3 presents a perspective side view of the exemplary easy on footwear originally introduced in FIG. 2, the footwear shown in a second exemplary placement step having the upper and lower joined to one another by joining a plurality of upper fasteners and lower fasteners to one another.

An easy on footwear 100, illustrated in FIGS. 1 through 3, presents a first exemplary variant of the present invention. The easy on footwear 100 includes a footwear upper 110 and a footwear lower 130. Orientation of the easy on footwear 100 can be identified by a footwear toe 102, a footwear heel 104, a footwear lateral (non-arched) side 106, and a footwear medial (arched) side 108. The footwear upper 110 would include elements common to any upper, including a footwear upper body 112. The footwear upper body 112 can be fabricated of any suitable material, such as a woven material, canvas, leather, a synthetic material, foam, a molded foam, a rubber, a plastic, a molded plastic, a nylon, a silicone, polyvinyl chloride (PVC), a composite material, or any other suitable material. The footwear upper body 112 preferably is formed to define a footwear upper foot passageway 114. The footwear upper body 112 includes at least one upper fastener. The upper fastener can be any suitable fastener element or group of elements. The footwear upper attachment edge 116 is fabricated of any material suitable to adequately support and retain the selected at least one upper fastener. The footwear upper attachment edge 116 can be fabricated of the same material as the footwear upper body 112 or a material that differs from the material of the footwear upper body 112. The exemplary footwear upper 110 includes a plurality of footwear upper fastening elements 120 which are spatially arranged about a footwear upper attachment edge 116 of the footwear upper 110.

The footwear lower 130 would include elements common to any lower, including a footwear lower body 132. The footwear lower body 132 can be fabricated of any suitable material, such as a rubber, a thermoplastic rubber, leather, a synthetic material, foam, a plastic, polyvinyl chloride (PVC), a polyurethane, a thermoplastic polyurethane, a nylon, a knits, Acrylonitrile Butadiene Styrene (ABS), Ethylene Vinyl Acetate (EVA), a silicone, a composite material, or any other suitable material. The footwear lower body 132 includes at least one lower fastener. The lower fastener can be any suitable fastener element or group of elements. The footwear lower attachment edge 136 is fabricated of any material suitable to adequately support and retain the selected at least one lower fastener. The footwear lower attachment edge 136 can be fabricated of the same material as the footwear lower body 132 or a material that differs from the material of the footwear lower body 132. The exemplary footwear lower 130 includes a plurality of footwear lower fastening elements 140 which are spatially arranged about a footwear lower attachment edge 136 of the footwear lower 130.

The present invention provides a method of placing the easy on footwear 100 upon a person's foot 99 of a user. Having the footwear upper 110 and the footwear lower 130 separate from one another, a first of the footwear upper 110 and the footwear lower 130 is placed upon the user and the second, other of the footwear upper 110 and the footwear lower 130 is then placed upon the user and in alignment with the first of the footwear upper 110 and the footwear lower 130. Once in alignment, the footwear upper 110 and the footwear lower 130 are assembled to one another by joining each footwear upper fastening element 120 and respective footwear lower fastening element 140 to one another.

As shown in the exemplary illustration, the footwear upper 110 and the footwear lower 130 are hingeably assembled to one another by an upper and lower hinge assembly 129. The exemplary upper and lower hinge assembly 129 hingeably assembles the footwear upper 110 and the footwear lower 130 to one another at the heel. The footwear upper 110 and the footwear lower 130 are one example of the upper fastener and the lower fastener. It is understood that there are many different arrangements of upper fasteners and lower fasteners that are suitable for the subject application. The upper and lower heel hinge assembly 129 can be a section of flexible material, such as fabric, canvas, leather, rubber, and the like. The upper and lower heel hinge assembly 129 can include a mechanism enabling separation between the upper 110 and the lower 130, offering the consumer an ability to exchange either the upper 110 and/or the lower 130 with a different upper 110/lower 130.

Figure 4B:
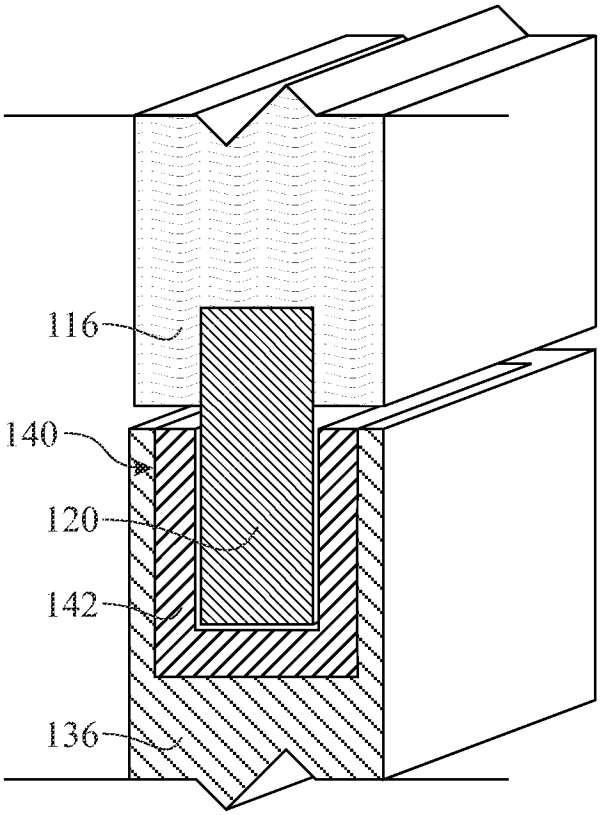
FIG. 4B presents an isometric sectioned end top view of the first exemplary upper and lower fastening system originally introduced in FIG. 4A, the illustration presenting the upper fastener (tongue) and the lower fastener (sleeve) being shown in an engaged configuration.
Figure 4A:
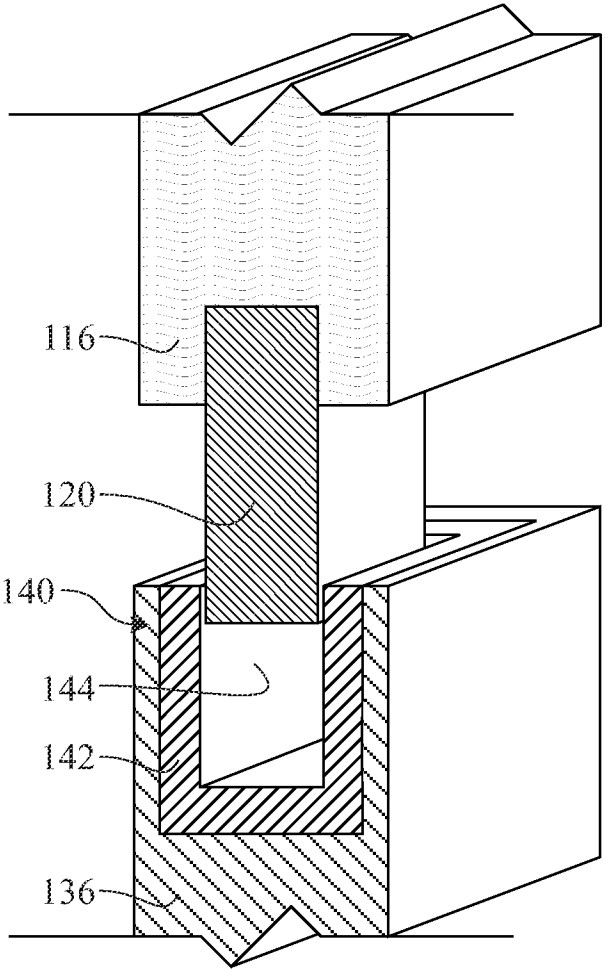
FIG. 4A presents an isometric sectioned end top view of a first exemplary upper and lower fastening system employing a tongue and sleeve arrangement, the illustration presenting the upper fastener (tongue) and the lower fastener (sleeve) being shown in a pre-engaging configuration.

Details of the exemplary footwear upper fastening element 120 and the footwear lower fastening element 140 are illustrated in FIGS. 4A and 4B. The footwear upper fastening element 120 is of a size and shape enabling insertion into a footwear lower fastening element magnet receiving cavity 144 defined by interior surfaces of a footwear lower fastening element frame 142. It is preferred that the footwear upper fastening element 120 and the footwear lower fastening element magnet receiving cavity 144 defined by interior surfaces of a footwear lower fastening element frame 142 are of very similar size and shape providing a reasonably tight fit therebetween. The footwear upper fastening element 120 is assembled to and supported by the footwear upper attachment edge 116. The footwear lower fastening element frame 142 is assembled to and supported by the footwear lower attachment edge 136. The exemplary footwear upper fastening element 120 is a stud fabricated of a magnetically charged material. The exemplary footwear lower fastening element frame 142 is fabricated of a magnetically attracted material. In an alternative design, the footwear upper fastening element 120 would be a stud fabricated of a magnetically attracted material and the footwear lower fastening element frame 142 would be fabricated of a magnetically charged material. In another alternative design, the footwear upper fastening element 120 would be a stud fabricated of a magnetically charged material and at least a portion of the footwear lower fastening element frame 142 would be fabricated of a magnetically charged material, wherein the magnetically charged material of the footwear upper fastening element 120 and the magnetically charged material of the footwear lower fastening element frame 142 would be oriented where the footwear upper fastening element 120 and the footwear lower fastening element frame 142 would be attracted to one another.

A person's foot can vary in shape and size. This becomes more of a factor when dealing with people with medical conditions, birth defects, disabilities or any other condition that might impact a fit of the footwear upon the person's foot. In one example, the person's foot becomes enlarged as a result of poor circulation. The enlarged foot commonly is either uncomfortable or worse, would not fit in commonly sized footwear. In a second example, a person may be born with one leg shorter than the other, that person commonly requires custom footwear, wherein one shoe has a different sole height compared to the other shoe. In a third example, a patient may have had a procedure done on one foot and would require sufficient sizing for any post procedure dressing.

The easy on footwear 100 provides a solution to help address conditions where custom footwear would help provide comfort, stability, and the like to the user. By providing a modular assembly of a footwear upper 110 and a footwear lower 130 to one another, the easy on footwear 100 offers an opportunity for the user to select a footwear upper 110 and/or a footwear lower 130 from a group of footwear uppers 110 and/or footwear lowers 130, wherein each group consists of a plurality of footwear uppers 110 and a plurality of footwear lowers 130 having different sizes and shapes for a specific shoe size. Examples of differences within the plurality of footwear uppers 110 includes a taller dimension, a wider dimension, a broader toe section, a broader heel section, a narrowed toe section, a larger opening, an opening extending further forward, and the like. Examples of differences within the plurality of footwear lowers 130 includes a thicker sole, a higher heel, different arches, a harder insole, a softer insole, a custom orthotic, a wider dimension, a broader toe section, a broader heel section, a narrowed toe section, and the like. Each of the different dimensions, materials, shapes, and the like are to provide an optimal combination of the footwear upper 110 and the footwear lower 130 for comfort to the person wearing the easy on footwear 100. The same provides a solution in a condition where the lower 130 or the upper 110 wears out, becomes damaged, or encounters any other condition suggesting a replacement. In another scenario, children grow at a significant rate. Instead of replacing the entire easy on footwear 100, the lower 130 can be designed to accommodate a number of sizes and the parent can replace the upper 110 as the child grows.

The easy on footwear 100 enables use of a upper 110 of any design, material, color, accessory, and the like with any mating lower 130 of any design, material, color, accessory and the like. Several examples are illustrated herein, including an introduction of an illuminating version of at least one of an upper 1210 (FIG. 17, 18) and a lower 1230 (FIG. 17, 18), introduction of wheels 2762, 2766 (FIG. 43) or powered wheels 2862, 2863, 2864, 2865 to aid in mobility, or any other suitable accessory. Another optional accessory would be an introduction of cleats in the lower 130.

Figure 5B:
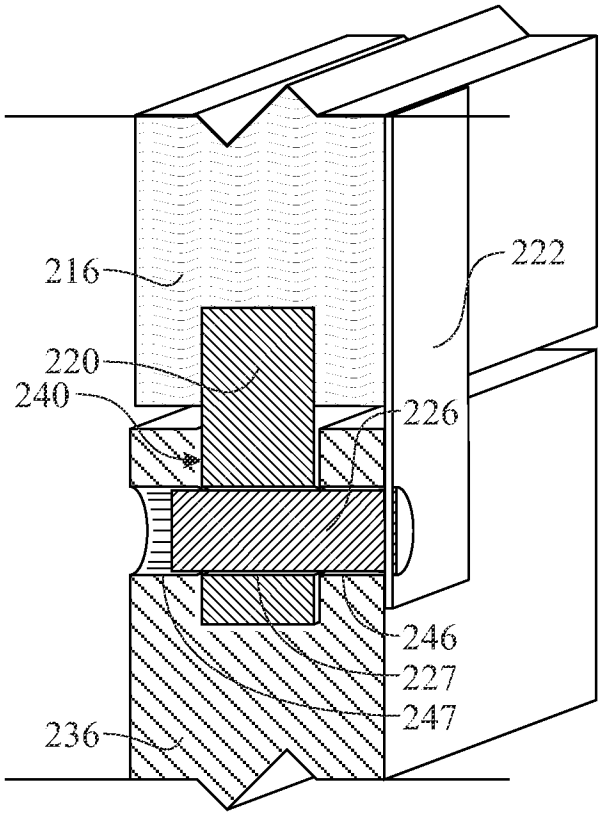
FIG. 5B presents an isometric sectioned end top view of the second exemplary upper and lower fastening system originally introduced in FIG. 5A, the illustration presenting the upper fastener (tongue) and the lower fastener (sleeve) being shown in an engaged configuration and the locking member (pin) positioned to retain the upper fastener and the lower fastener together.
Figure 5A:
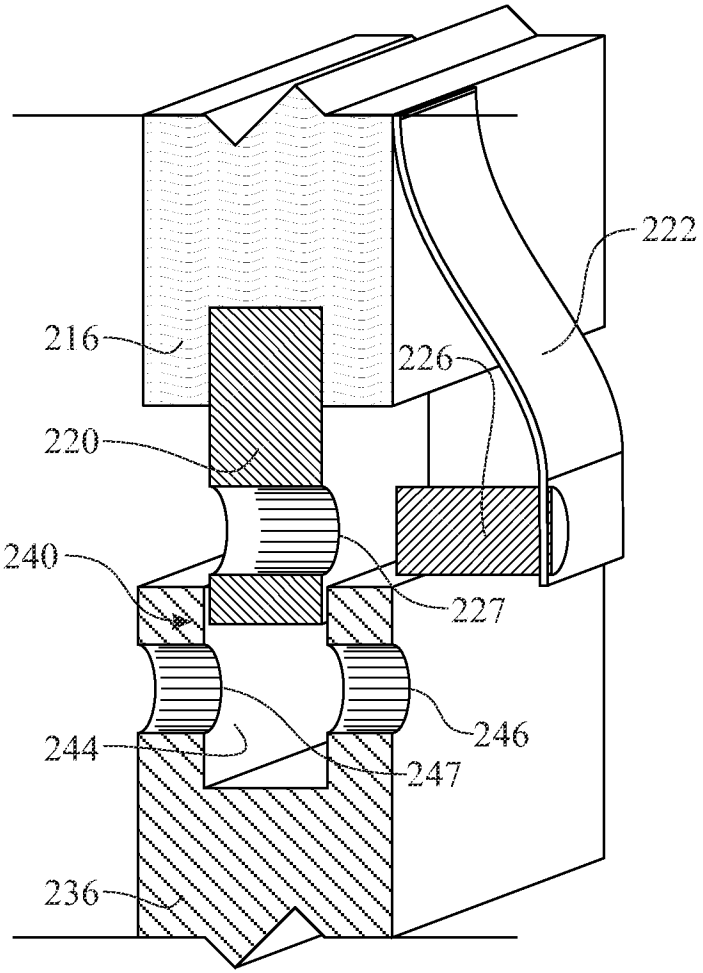
FIG. 5A presents an isometric sectioned end top view of a second exemplary upper and lower fastening system employing a tongue and sleeve arrangement and further comprising a locking member (pin), the illustration presenting the upper fastener (tongue) and the lower fastener (sleeve) being shown in a pre-engaging configuration.

The exemplary upper and lower fastening system illustrated in FIGS. 4A and 4B can be enhanced by introducing a locking member, as illustrated in an exemplary upper and lower fastening system shown in FIGS. 5A and 5B. A number of elements of the exemplary upper and lower fastening system shown in FIGS. 5A and 5B are similar to the elements of the exemplary upper and lower fastening system shown in FIGS. 4A and 4B. Like elements of the exemplary upper and lower fastening system shown in FIGS. 5A and 5B are numbered the same as those of the exemplary upper and lower fastening system shown in FIGS. 4A and 4B, wherein the elements of the exemplary upper and lower fastening system shown in FIGS. 5A and 5B are preceded by the numeral "2". A footwear lower fastening element 240 can be formed within the footwear lower attachment edge 236. In the exemplary illustration, the footwear upper fastening element 220 is fabricated of any suitable material, as the illustrated footwear lower fastening element 240 is defined by a magnetically independent material. The footwear upper fastening element 220 can be of a non-magnetic material, a magnetically charged material, or a magnetically attracting material. Alternatively, the footwear lower fastening element 240 can be formed within a frame (similar to the footwear lower fastening element frame 142) that includes a magnetically charged or magnetically attracting material. A footwear lower fastening element outer locking aperture 246 and preferably a footwear lower fastening element inner locking aperture 247 are formed through the footwear lower attachment edge 236 in an alignment with the footwear lower fastening element receiving cavity 244. Similarly, a footwear upper fastening element locking aperture 227 is formed through the footwear upper fastening element 220. A footwear upper fastening element locking pin 226 is provided and preferably secured to the footwear upper attachment edge 216 by a footwear upper fastening element locking pin tether 222. The footwear upper fastening element locking pin 226 is of a size and shape to pass through the footwear lower fastening element outer locking aperture 246, continuing through the footwear upper fastening element locking aperture 227 and at least partially into the footwear lower fastening element inner locking aperture 247.

In use, the footwear upper fastening element 220 would be inserted into the footwear lower fastening element receiving cavity 244. Once the footwear upper fastening element 220 is properly seated within the footwear lower fastening element receiving cavity 244, the footwear upper fastening element locking pin 226 is inserted through the footwear lower fastening element outer locking aperture 246, continuing through the footwear upper fastening element locking aperture 227 and at least partially into the footwear lower fastening element inner locking aperture 247, as illustrated in FIG. 5B. When the footwear is to be removed, the footwear upper fastening element 220 can be used to aid in removal of the footwear upper fastening element locking pin 226 from the bores 247, 226, 246. Once the footwear upper fastening element locking pin 226 is removed from the bores 247, 226, 246, the footwear upper fastening element 220 can be withdrawn from the footwear lower fastening element 240. Separation of the footwear upper fastening element 220 and the footwear lower fastening element 240 enables separation of the footwear upper 110 and the footwear lower 130, aiding in removal of the easy on footwear 100 from the person's foot 99.

Figure 6B:
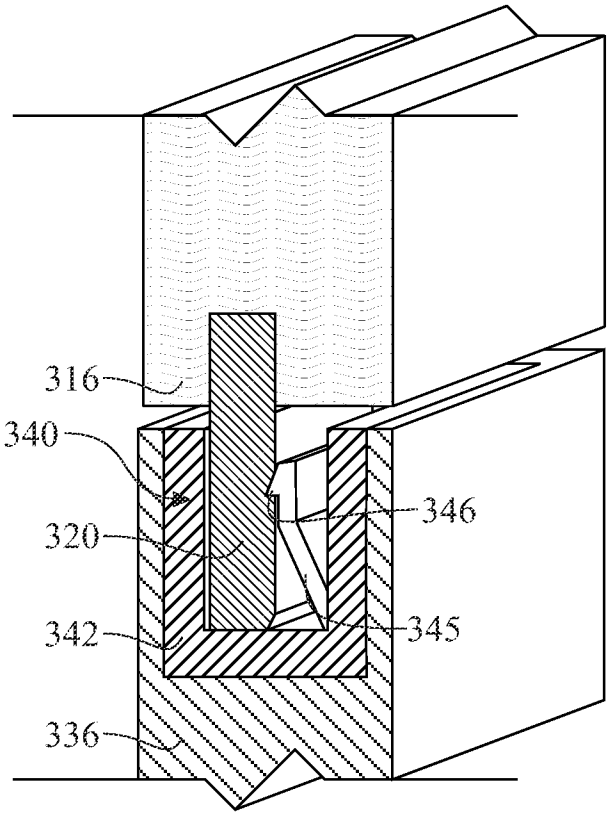
FIG. 6B presents an isometric sectioned end top view of the third exemplary upper and lower fastening system originally introduced in FIG. 6A, the illustration presenting the upper fastener (tongue) and the lower fastener (sleeve) being shown in an engaged configuration and the locking member (latching hook) positioned to retain the upper fastener and the lower fastener together.
Figure 6A:
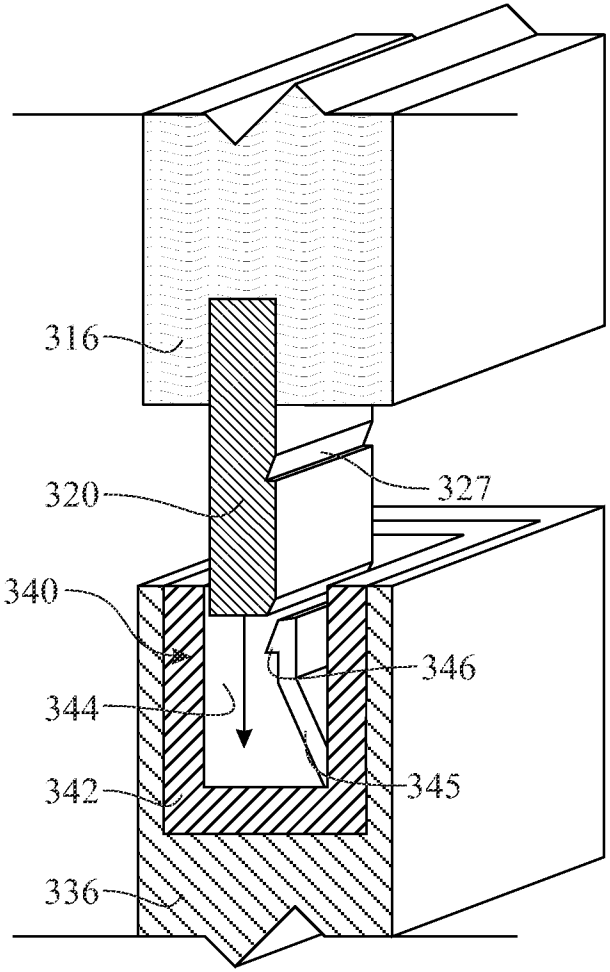
FIG. 6A presents an isometric sectioned end top view of a third exemplary upper and lower fastening system employing a tongue and sleeve arrangement and further comprising a locking member (latching hook), the illustration presenting the upper fastener (tongue) and the lower fastener (sleeve) being shown in a pre-engaging configuration.
Figure 6C:
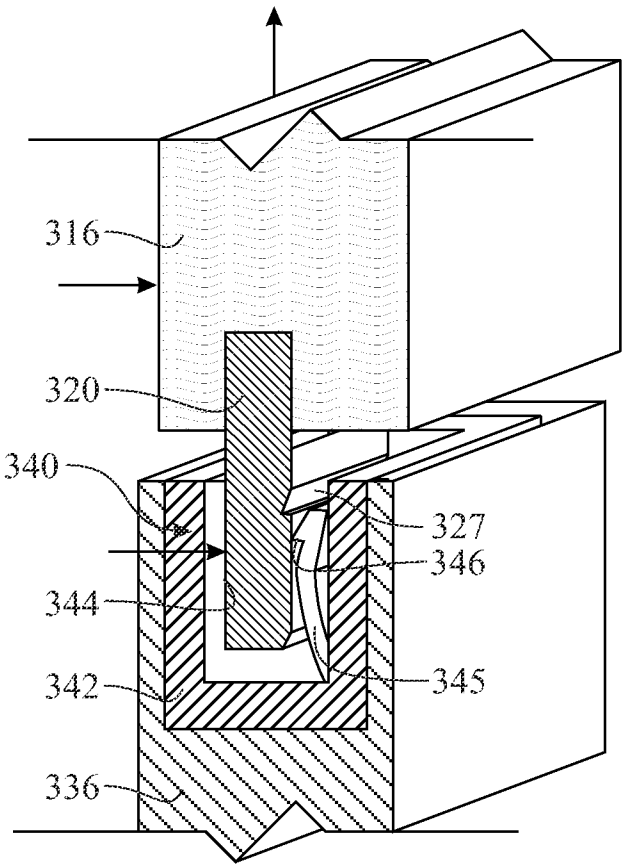
FIG. 6C presents an isometric sectioned end top view of the third exemplary upper and lower fastening system originally introduced in FIG. 6A, the illustration presenting the upper fastener (tongue) and the lower fastener (sleeve) being shown in a releasing configuration and the locking member (latching hook) positioned to enable separation of the upper fastener and the lower fastener from one another.

The exemplary upper and lower fastening system illustrated in FIGS. 6A, 6B, and 6C employs an alternative arrangement to a locking member compared to the locking pin 226 employed by the exemplary upper and lower fastening system illustrated in FIGS. 5A and 5B. A number of elements of the exemplary upper and lower fastening system shown in FIGS. 6A, 6B, and 6C are similar to the elements of the exemplary upper and lower fastening system shown in FIGS. 5A and 5B. Like elements of the exemplary upper and lower fastening system shown in FIGS. 6A, 6B, and 6C are numbered the same as those of the exemplary upper and lower fastening system shown in FIGS. 5A and 5B, wherein the elements of the exemplary upper and lower fastening system shown in FIGS. 6A, 6B and 6C are preceded by the numeral "3".

The exemplary upper and lower fastening system illustrated in FIGS. 6A, 6B, and 6C includes a footwear upper fastening element 320 carried by a footwear upper attachment edge 316 and a footwear lower fastening element 340 carried by a footwear lower attachment edge 336.

Although it is not required for this variant, in the exemplary illustration, the footwear upper fastening element 320 and a footwear lower fastening element frame 342 of the footwear lower fastening element 340 employ a magnetic attraction. A footwear upper fastening element locking ridge 327 is formed in the footwear upper fastening element 320. A footwear lower fastening element locking feature cantilever 345 extends upward into the footwear lower fastening element receiving cavity 344. A footwear lower fastening element locking feature 346 is formed at a distal end of the footwear lower fastening element locking feature cantilever 345. The footwear lower fastening element locking feature 346 is designed to engage with the footwear upper fastening element locking ridge 327 and retain the footwear upper fastening element 320 within the footwear lower fastening element receiving cavity 344. The exemplary footwear upper fastening element locking ridge 327 can be provided as a ridge extending a horizontal length or transverse dimension of the footwear upper fastening element 320. Alternatively, the footwear upper fastening element locking ridge 327 can be formed as a deboss or recess which would mate to a boss feature provided at the distal end of the footwear lower fastening element locking feature cantilever 345.

In use, the footwear upper fastening element 320 is inserted into the footwear lower fastening element receiving cavity 344. A distal edge of the footwear upper fastening element 320 can be chamfered to aid in positioning the footwear lower fastening element locking feature 346 during insertion of the footwear upper fastening element 320 into the footwear lower fastening element receiving cavity 344, as illustrated in FIG. 6A. As the footwear upper fastening element 320 is seated within the footwear lower fastening element receiving cavity 344, the footwear lower fastening element locking feature 346 engages with the footwear upper fastening element locking ridge 327. Once the footwear lower fastening element locking feature 346 engages with the footwear upper fastening element locking ridge 327, the locking interface retains the footwear upper fastening element 320 within the footwear lower fastening element receiving cavity 344, as illustrated in FIG. 6B. In a configuration where the footwear upper fastening element 320 and the footwear lower fastening element frame 342 are magnetically attracted to one another, the magnetic attraction increases the retention between the footwear upper fastening element 320 and the footwear lower fastening element receiving cavity 344. To release the locking interface, the footwear upper fastening element 320 would be pressed towards the footwear lower fastening element locking feature cantilever 345, flexing the footwear lower fastening element locking feature cantilever 345 away from the footwear upper fastening element 320 and disengaging the footwear lower fastening element locking feature 346 and the footwear upper fastening element locking ridge 327, as illustrated in FIG. 6C. Once the footwear lower fastening element locking feature 346 is disengaged from the footwear upper fastening element locking ridge 327, the footwear upper 110 and the footwear lower 130 can be separated from one another, aiding in removal of the easy on footwear 100 from the person's foot 99.

Figure 7A:
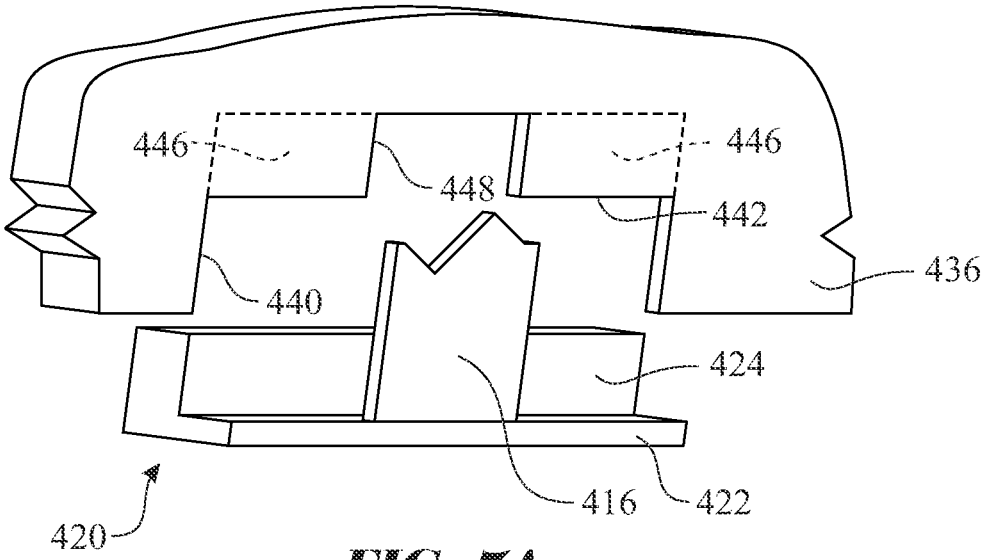
FIG. 7A presents an isometric side view of a fourth exemplary upper and lower fastening system employing a tongue and socket arrangement, the illustration presenting the upper fastener (tongue) and the lower fastener (socket) being shown in a pre-engaging configuration.
Figure 7B:
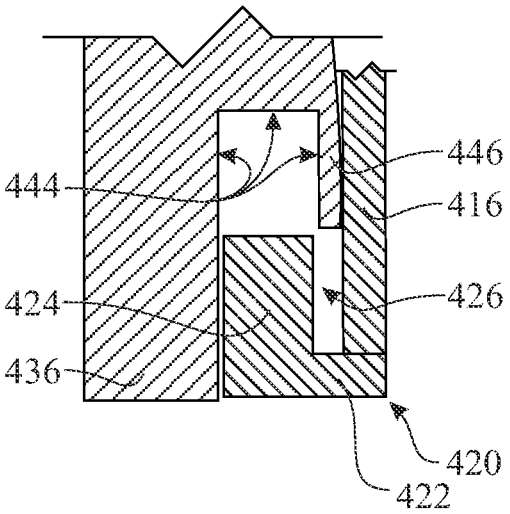
FIG. 7B presents a sectioned end elevation view of the fourth exemplary upper and lower fastening system originally introduced in FIG. 7A, the illustration presenting the upper fastener (tongue) and the lower fastener (socket) being shown in the pre-engaging configuration.
Figure 7C:
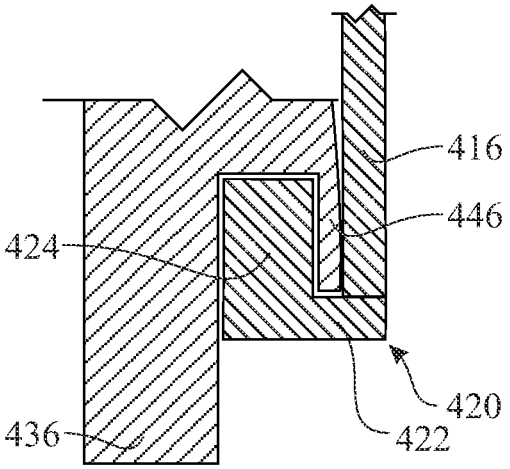
FIG. 7C presents a sectioned end elevation view of the fourth exemplary upper and lower fastening system originally introduced in FIG. 7A, the illustration presenting the upper fastener (tongue) and the lower fastener (socket) being shown in an engaged configuration.

Another exemplary upper and lower fastening system is illustrated in FIGS. 7A, 7B, and 7C. The exemplary upper and lower fastening system employs overlapping tongues and grooves. A footwear upper fastening element 420 is carried by a footwear upper attachment edge 416. A material having elastic properties can be provided proximate the footwear upper fastening element 420, enabling use of the elastic stretch during insertion and release of the footwear upper fastening element 420 and the footwear lower fastening element return tongue receptacle 444. The footwear upper fastening element 420 includes a footwear upper fastening element return tongue segment 424 extending upward from a distal end of a footwear upper fastening element base segment 422. A footwear upper fastening element lower tongue receiving clearance 426 is provided between opposing surfaces of the footwear upper fastening element return tongue segment 424 and a footwear upper attachment edge 416. A footwear lower fastening element tongue segment 446 defines a footwear lower fastening element return tongue receptacle 444 formed in a bottom region of the footwear lower attachment edge 436. The footwear lower fastening element return tongue receptacle 444 is sized and shaped to receive the footwear upper fastening element return tongue segment 424. The footwear upper fastening element lower tongue receiving clearance 426 is sized and shaped to receive the footwear lower fastening element tongue segment 446. A footwear lower attachment edge fastening feature access vertical edge 440 in combination with a footwear lower attachment edge fastening feature access horizontal edge 442 provides a pass through enabling positioning of the footwear upper fastening element return tongue segment 424 under the footwear lower fastening element return tongue receptacle 444 without requiring the bottom of the footwear upper fastening element base segment 422 to be positioned below a bottom of the footwear lower attachment edge 436. An optional footwear lower attachment edge fastening feature attachment element clearance 448 can be formed in the footwear lower attachment edge 436 to provide a clearance for the footwear upper attachment edge 416.

In use, the footwear upper fastening element return tongue segment 424 is positioned in vertical alignment with the footwear lower fastening element return tongue receptacle 444 (as illustrated in FIG. 7B); then the footwear upper fastening element return tongue segment 424 is seated within the footwear lower fastening element return tongue receptacle 444 (as illustrated in FIG. 7C). Simultaneously, the footwear lower fastening element tongue segment 446 slides into the footwear lower fastening element tongue segment 446. An elastic material can be employed to aid in the process of drawing the footwear upper fastening element 420 downward; then the elastic material would retain the footwear upper fastening element return tongue segment 424 within the footwear lower fastening element return tongue receptacle 444. Alternatively or additionally, a magnetic attraction can be employed with the selection of appropriate materials for the footwear upper fastening element return tongue segment 424 and the area defining the footwear lower fastening element return tongue receptacle 444.

Figure 8C:
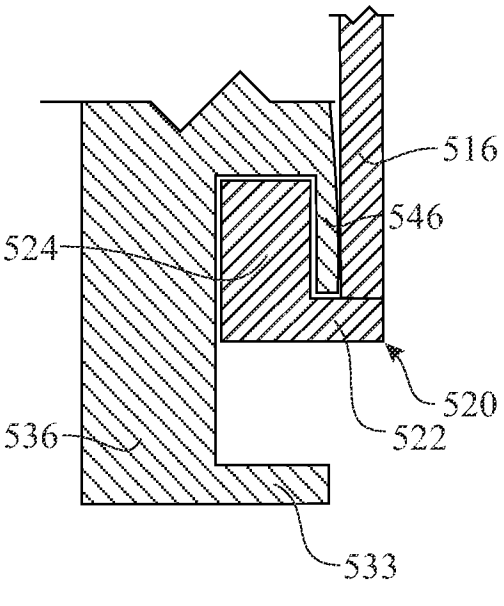
FIG. 8C presents a sectioned end view of the first exemplary upper and lower fastening system originally introduced in FIG. 8A, the illustration presenting the upper fastener (tongue) and the lower fastener (socket) being shown in an engaged configuration accomplished by a second directional motion.
Figure 8B:
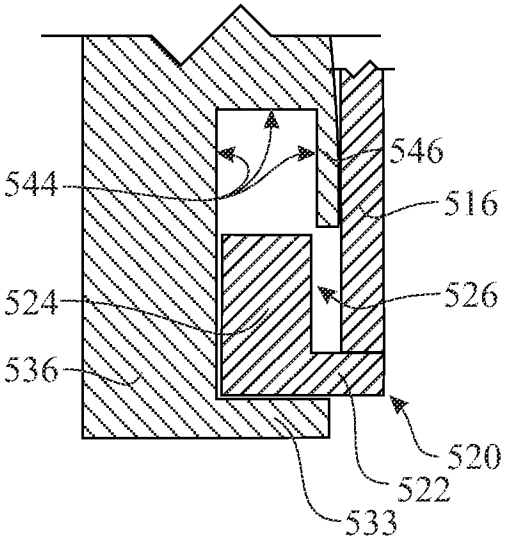
FIG. 8B presents a sectioned end view of the first exemplary upper and lower fastening system originally introduced in FIG. 8A, the illustration presenting the upper fastener (tongue) and the lower fastener (socket) being shown in an intermediary insertion step position accomplished by a first directional motion.
Figure 8A:
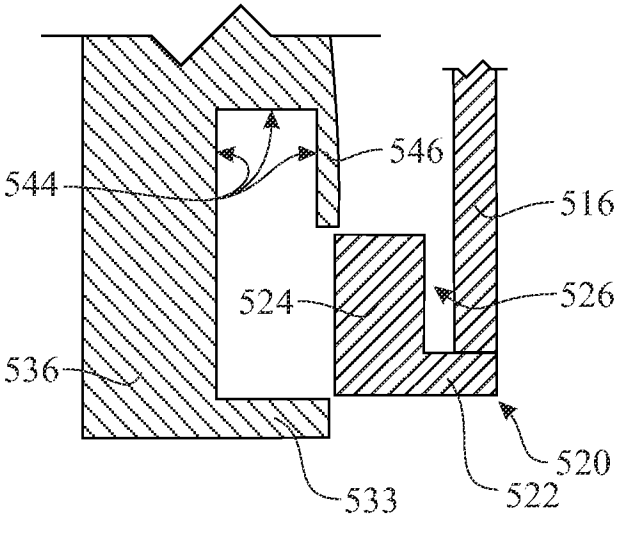
FIG. 8A presents a sectioned end elevation view of a fifth exemplary upper and lower fastening system employing another tongue and socket arrangement, the illustration presenting the upper fastener (tongue) and the lower fastener (socket) being shown in the pre-engaging configuration.

Another exemplary upper and lower fastening system is illustrated in FIGS. 8A, 8B, and 8C, wherein the illustrated upper and lower fastening system is a slightly modified version of the upper and lower fastening system illustrated in FIGS. 7A, 7B, and 7C. A majority of elements of the exemplary upper and lower fastening system shown in FIGS. 8A, 8B, and 8C are similar to the elements of the exemplary upper and lower fastening system shown in FIGS. 7A, 7B, and 7C. Like elements of the exemplary upper and lower fastening system shown in FIGS. 8A, 8B, and 8C are numbered the same as those of the exemplary upper and lower fastening system shown in FIGS. 7A, 7B, and 7C, wherein the elements of the exemplary upper and lower fastening system shown in FIGS. 8A, 8B and 8C are preceded by the numeral "5". The only distinction is an addition of a footwear lower attachment edge fastening feature access bottom retention flange 533. The footwear lower attachment edge fastening feature access bottom retention flange 533 limits any downward motion to further ensure that a footwear upper fastening element 520 is not incidentally pulled downward and dislodged from a footwear lower fastening element return tongue receptacle 544.

Figure 9B:
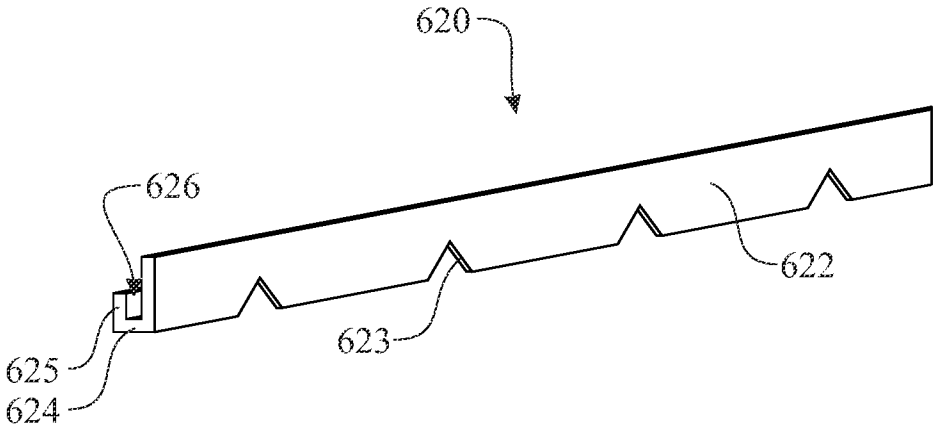
FIG. 9B presents an isometric side view of the sixth exemplary upper and lower fastening system originally introduced in FIG. 9A, the illustration presenting the upper fastener (rib) and the lower fastener (groove) being shown in an engaged configuration.

The previously described variants of the upper and lower fastening systems employ a plurality of upper fasteners and lower fasteners. An exemplary upper and lower fastening system introduced in FIGS. 9A and 9B can employ a single upper fastener 620 and a single lower fastener 640. The footwear upper fastening element 620 would be joined to and supported by a footwear upper attachment edge 616. The exemplary footwear upper fastening element 620 includes a footwear upper fastening element outer segment 622 extending upward from one edge of a footwear upper fastening element base segment 624 and a footwear upper fastening element return tongue segment 625 extending upward from a second, opposite edge of the footwear upper fastening element base segment 624. A footwear upper fastening element lower tongue receiving clearance 626 is created between opposing surfaces of the footwear upper fastening element outer segment 622 and the footwear upper fastening element return tongue segment 625. A series of footwear upper fastening element base bend assist notches 623 can be spatially formed along a length of the footwear upper fastening element outer segment 622, where the series of footwear upper fastening element base bend assist notches 623 aids in flexibility of the footwear upper fastening element 620 for both curves and insertion of the footwear upper fastening element return tongue segment 625 into a footwear lower fastening element return tongue receptacle 644 of the footwear lower fastening element 640. The footwear lower fastening element return tongue receptacle 644 is defined by recess and a footwear lower fastening element tongue segment 646.

Although the exemplary upper and lower fastening system employing the footwear upper fastening element 620 and the footwear lower fastening element 640 can utilize a single component, it is understood that a plurality of smaller segments can be utilized herein.

Figure 9A:
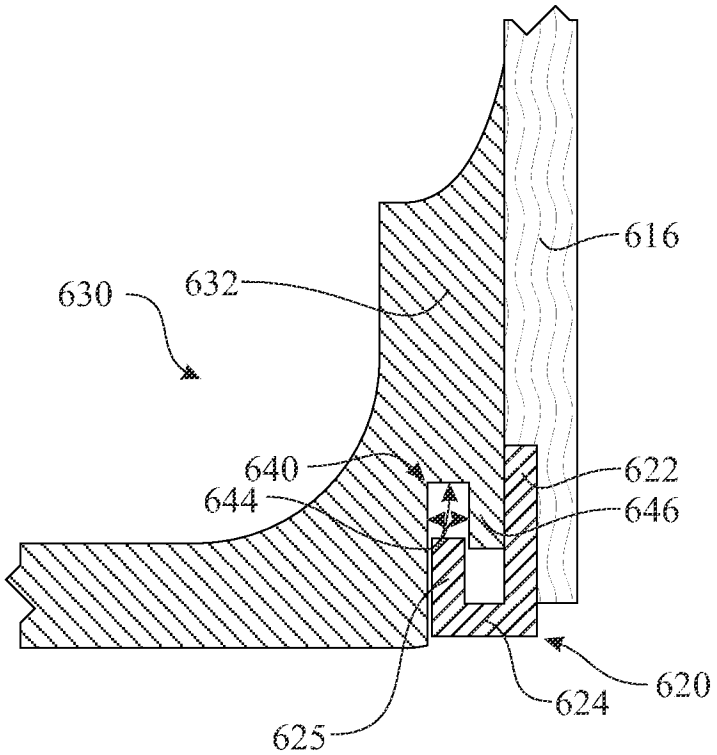
FIG. 9A presents a sectioned end view of a sixth exemplary upper and lower fastening system employing a rib and groove arrangement, the illustration presenting the upper fastener (rib) and the lower fastener (groove) being shown in an engaged configuration.

In use, the footwear upper fastening element return tongue segment 625 is inserted into the footwear lower fastening element return tongue receptacle 644 and simultaneously, the footwear lower fastening element tongue segment 646 slides into the footwear upper fastening element lower tongue receiving clearance 626, as illustrated in FIG. 9A.

The previously described variants of the upper and lower fastening systems employ a two element system comprising one or more upper fasteners and a like quantity of lower fasteners. An exemplary upper and lower fastening system introduced in FIGS. 10A and 10B employs a twist and lock fastener 750 which assembles and retains a footwear upper attachment edge 716 and a footwear lower attachment edge 736 to one another. A footwear upper fastening element 720 is formed through the footwear upper attachment edge 716. Similarly, a footwear lower fastening element 740 is formed through the footwear lower attachment edge 736. It is preferred that the footwear upper fastening element 720 and the footwear lower fastening element 740 are of a similar size and shape.

The twist and lock fastener 750 includes a twist and lock fastener operation handle 752 extending outward from a twist and lock fastener operation body 754. A twist and lock fastener lock extension 758 extends downward from a lower edge of the twist and lock fastener operation body 754. A twist and lock fastener lock 759 is supported at a distal end of the twist and lock fastener lock extension 758. The twist and lock fastener lock 759 is sized to enable insertion through each of the footwear upper fastening element 720 and the footwear lower fastening element 740, while extending beyond the side edges of the footwear upper fastening element 720 and the footwear lower fastening element 740 when the twist and lock fastener 750 is rotated. A twist and lock fastener flange 756 is integrated between the upper, connecting end of the twist and lock fastener lock extension 758 and the twist and lock fastener operation body 754. It is preferred that the twist and lock fastener lock extension 758 have a circular cross sectional shape to aid in rotation. A distance (length of the twist and lock fastener lock extension 758) between opposing surfaces of the twist and lock fastener lock extension 758 and the twist and lock fastener lock 759 is preferably approximate a thickness of the footwear upper attachment edge 716 and the footwear lower attachment edge 736 at a location proximate the footwear upper fastening element 720 and the footwear lower fastening element 740.

Figure 10B:
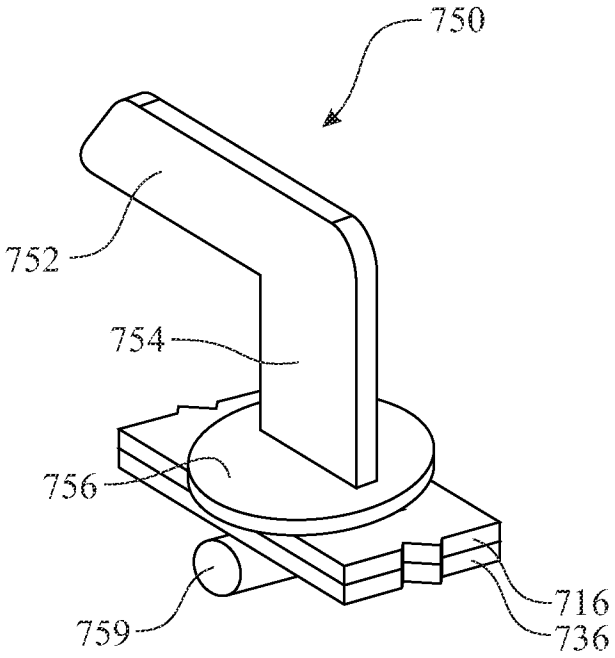
FIG. 10B presents an isometric top side view of the seventh exemplary upper and lower fastening system originally introduced in FIG. 10A, the illustration presenting the upper fastener (tongue), the lower fastener (sleeve), and the twist and lock element being shown in an engaged configuration.
Figure 10A:
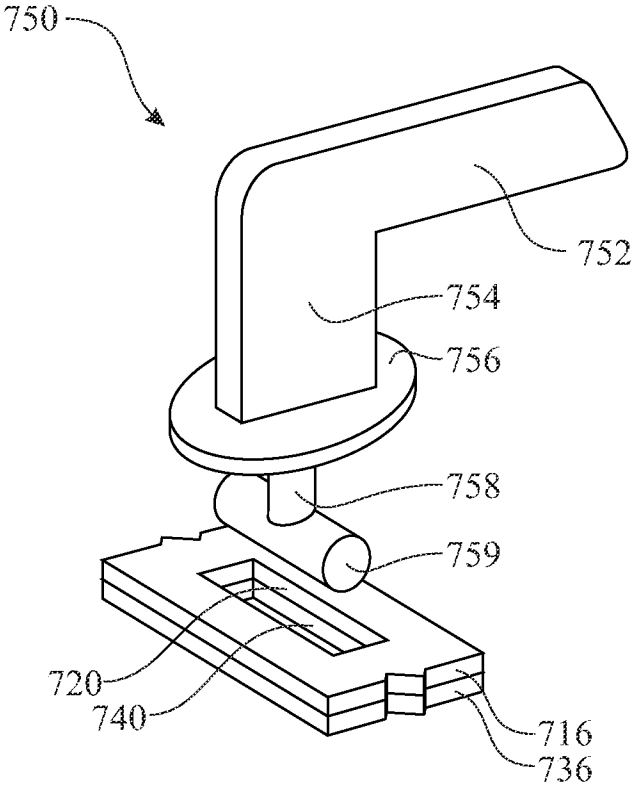
FIG. 10A presents an isometric top side view of a seventh exemplary upper and lower fastening system employing a twist and rotate arrangement, the illustration presenting the upper fastener (first aperture) and the lower fastener (second aperture) being secured by a twist and lock element, the illustration presenting the arrangement in a pre-engaging configuration.

In use, the footwear upper attachment edge 716 and the footwear lower attachment edge 736 would be positioned aligning the footwear upper fastening element 720 and the footwear lower fastening element 740. The twist and lock fastener lock 759 is inserted through each of the footwear upper fastening element 720 and the footwear lower fastening element 740, as illustrated in FIG. 10A. A force is applied to the twist and lock fastener operation handle 752 driving a 90 degree rotational motion of the twist and lock fastener 750, causing the twist and lock fastener lock 759 to rotate. This positions the twist and lock fastener lock 759 to retain the footwear upper attachment edge 716 and the footwear lower attachment edge 736 assembled to one another and the twist and lock fastener operation handle 752 against the footwear upper body 112 of the footwear upper 110, as illustrated in FIG. 10B.

Figure 11:
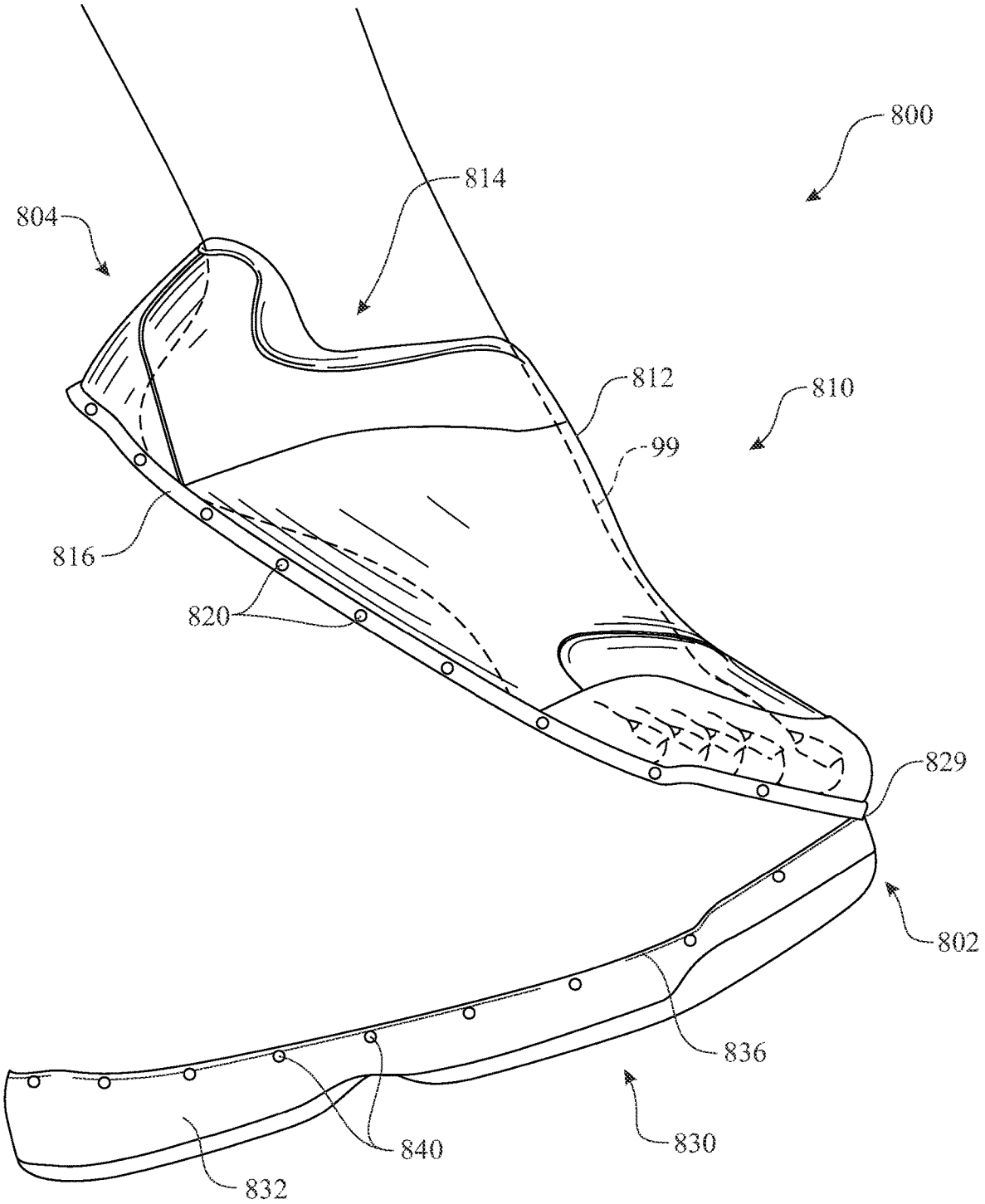
FIG. 11 presents a perspective side view of the exemplary easy on footwear similar to the easy on footwear originally introduced in FIG. 1, the footwear illustrated including a toe located hinged assembly and shown in a first exemplary placement step locating the upper upon the foot of the person.
Figure 12:
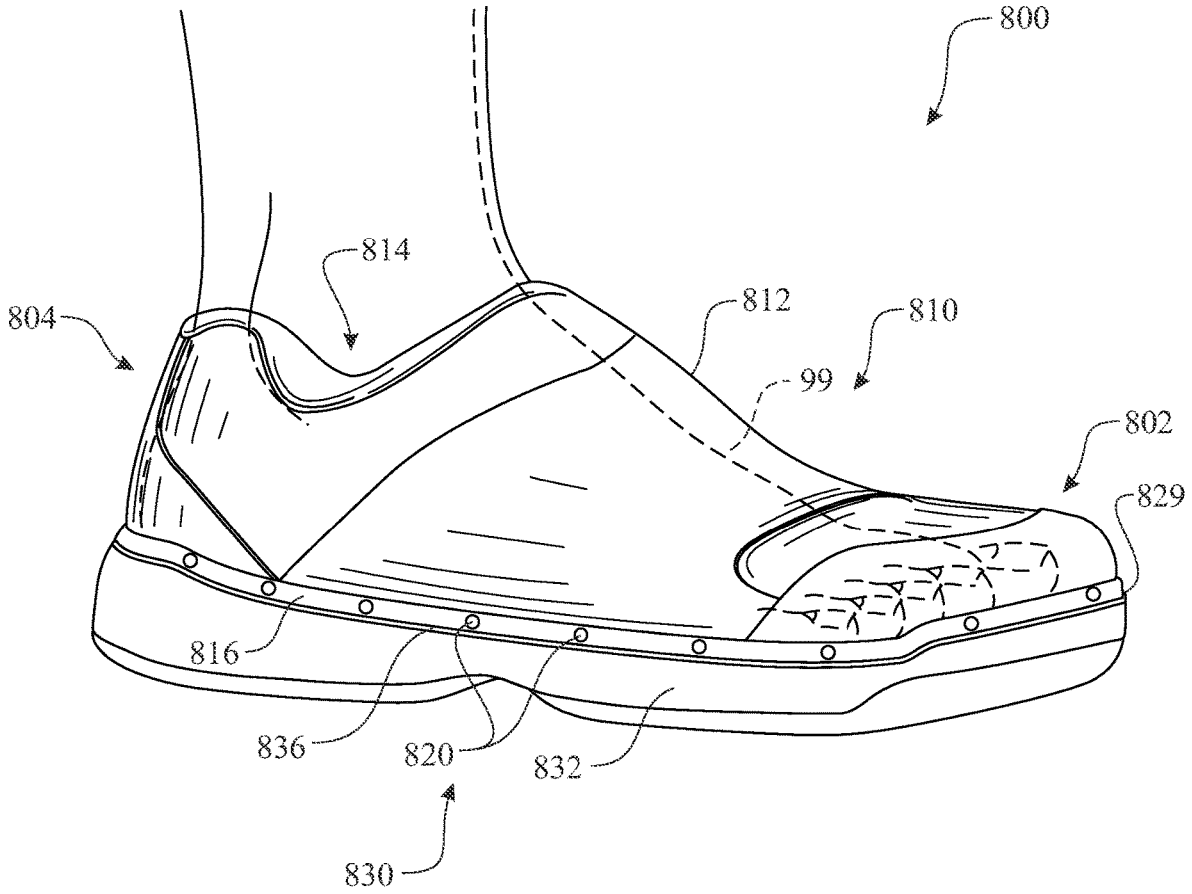
FIG. 12 presents a perspective side view of the exemplary easy on footwear originally introduced in FIG. 11, the footwear shown in a second exemplary placement step having the upper and lower joined to one another by joining a plurality of upper fasteners and lower fasteners to one another.

Each of the above examples of upper and lower fastening systems employ a vertical insertion arrangement. It is also recognized that the upper and lower fastening system can employ a horizontal insertion arrangement. An easy on footwear 800, illustrated in FIGS. 11 and 12, introduces additional upper and lower fastening systems.

The easy on footwear 800 and the easy on footwear 100 employ a number of similar elements. Elements of the easy on footwear 800 are numbered the same as like elements of the easy on footwear 100, wherein the elements of the easy on footwear 800 are preceded by the numeral "8".

The two distinctions between the easy on footwear 800 from the easy on footwear 100 is the type of fastening elements used for the upper and lower fastening systems and that the hinge 829 pivotally couples a toe end of a footwear upper 810 and a toe end of a footwear lower 830 to one another. The upper and lower toe hinge assembly 829 can be a section of flexible material, such as fabric, canvas, leather, rubber, and the like. The upper and lower toe hinge assembly 829 can include a mechanism enabling separation between the upper 810 and the lower 830, offering the consumer an ability to exchange either the upper 810 and/or the lower 830 with a different upper 810/lower 830.

A first exemplary horizontally oriented upper and lower fastening system employs a series of snaps. A combination of a footwear upper fastening element snap base 824 and a footwear upper fastening element snap head 822 form a footwear upper fastening element 820. The footwear upper fastening element snap head 822 and footwear upper fastening element snap base 824 are assembled to one another entrapping a footwear upper attachment edge 816 of a footwear upper 810 therebetween. A footwear lower fastening element 840 is assembled to a footwear lower body 832 of a footwear lower 830. A footwear upper fastening element snap surface 846 of the footwear lower fastening element 840 is designed to interface, engage with, and be retained by a footwear upper fastening element snap receiving surface 826 of the footwear upper fastening element snap base 824.

In use, the footwear upper fastening element 820 would be snapped onto the footwear lower fastening element 840, causing the footwear upper fastening element snap receiving surface 826 and the footwear upper fastening element snap surface 846 to engage with one another. A snap ring is commonly integrated with the footwear upper fastening element snap receiving surface 826 providing a reliable snap interface. The footwear upper fastening element 820 is separated from the footwear lower fastening element 840 when the easy on footwear 800 is being removed from the person's foot 99.

The easy on footwear 100 introduces an optional feature providing an upper and lower hinge assembly 129 between a heel region of the footwear upper 110 and a heel region of the footwear lower 130. In a similar arrangement, the easy on footwear 800 introduces an optional feature providing a upper and lower hinge assembly 829 between a toe region of the footwear upper 110 and a toe region of the footwear lower 130. In yet another arrangement, a hinge can be provided between the lateral side 106 of the footwear upper 110 and the lateral side 106 of the footwear lower 130 or alternatively, a hinge can be provided between the medial side 108 of the footwear upper 110 and the medial side 108 of the footwear lower 130. Essentially, the footwear upper 110 and the footwear lower 130 can either be completely detached from one another or hingeably coupling each of the footwear upper 110, 810 and the footwear lower 130, 830 along one of: (a) the heel region thereof (hinge 129), (b) the toe region thereof (hinge 829), (c) the lateral side 106, 806 region thereof, or (d) the medial side 108, 808 region thereof.

Each of the upper 110, 810 and lower 130, 830 includes a respective footwear upper attachment edge 116, 816 and a respective footwear lower attachment edge 136, 836. Each of the footwear upper attachment edge 116, 816 and a footwear lower attachment edge 136, 836 is segmented into a toe region 102, 802, a lateral side 106, 806, a heal region 104, 804, and a medial side 108, 808. The upper 110, 810 and the lower 130, 830 are detached along at least three of the following regions thereof: the toe region 102, 802, the lateral side 106, 806, the heal region 104, 804, and the medial side 108, 808.

Figure 13B:
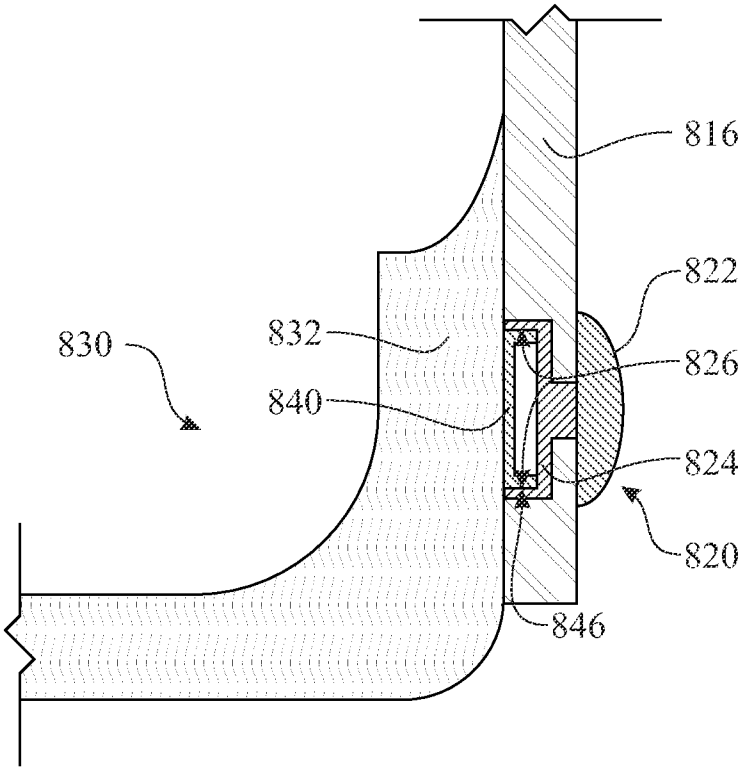
FIG. 13B presents a sectioned end view of the eighth exemplary upper and lower fastening system originally introduced in FIG. 13A, the illustration presenting the upper fastener (snap socket) and the lower fastener (snap stud) being shown in an engaged configuration.
Figure 13A:
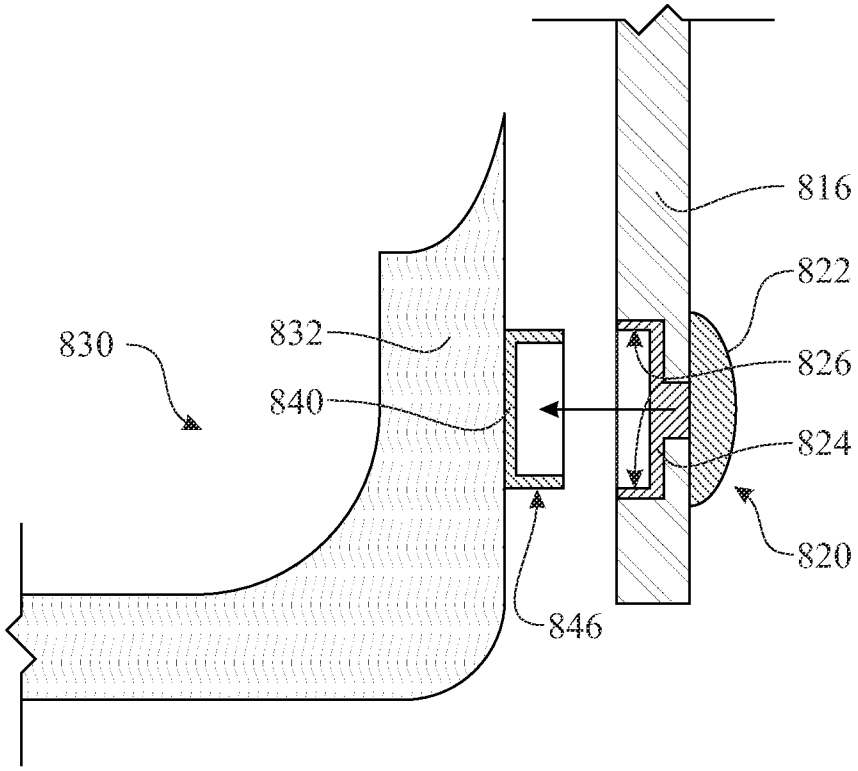
FIG. 13A presents a sectioned end view of an eighth exemplary upper and lower fastening system employing a snap arrangement, the illustration presenting the upper fastener (snap socket) and the lower fastener (snap stud) being shown in a pre-engaging configuration.
Figure 14:
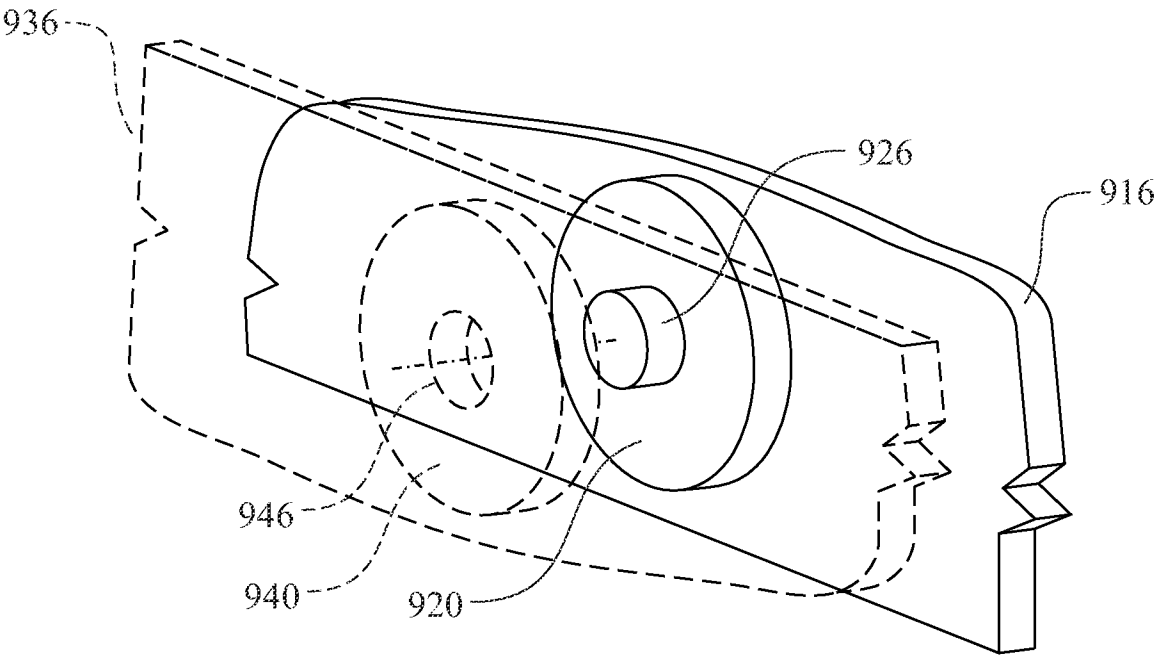
FIG. 14 presents an isometric side view of a ninth exemplary upper and lower fastening system employing a magnetic button clasp arrangement, the illustration presenting the upper fastener (magnetic disc with a button) and the lower fastener (magnetic disc with a bore) being shown in a pre-engaging configuration.

A first alternative to the upper and lower fastening system introduced in FIG. 13 is presented in FIG. 14. The exemplary upper and lower fastening system presented in FIG. 14 includes a footwear upper fastening element 920 carried by a footwear upper attachment edge 916 and a footwear lower fastening element 940 carried by a footwear lower attachment edge 936. A footwear upper fastening element stud 926 extends axially from a center of a footwear upper fastening element 920. A footwear upper fastening element stud receiving bore 946 is formed in the footwear lower fastening element 940. The footwear upper fastening element stud receiving bore 946 is located and of a size and shape to receive the footwear upper fastening element stud 926 when the footwear upper fastening element 920 and the footwear lower fastening element 940 are in alignment with one another. The footwear upper fastening element 920 is preferably fabricated of a magnetically charged material. The footwear lower fastening element 940 can be fabricated of a magnetically charged material or a magnetically attracting material. In an alternative arrangement, the footwear upper fastening element 920 can be fabricated of a magnetically attracting material or a magnetically charged material and the footwear lower fastening element 940 can be fabricated of a magnetically charged material. The desired arrangement is to have the footwear upper fastening element 920 and the footwear lower fastening element 940 magnetically attracted to one another.

In use, the footwear upper fastening element 920 and the footwear lower fastening element 940 are brought together. The footwear upper fastening element stud 926 is inserted into the footwear upper fastening element stud receiving bore 946. The magnetic attraction brings the footwear upper fastening element 920 and the footwear lower fastening element 940 towards and engaging with one another. The inserted footwear upper fastening element 920 refrains the footwear upper fastening element 920 and the footwear lower fastening element 940 from moving respective to one another in any direction other than axial. The footwear upper fastening element 920 and the footwear lower fastening element 940 are separated by applying an axial force between the two, drawing the footwear upper fastening element 920 and the footwear lower fastening element 940 apart from one another, thus allowing separation of the footwear upper 810 and the footwear lower 830 from one another.

The exemplary upper and lower fastening system presented in FIG. 14 can be modified to provide a basic upper and lower fastening system. The basic exemplary upper and lower fastening system would include a footwear upper fastening element 920 exclusive of the footwear upper fastening element stud 926 and a footwear lower fastening element 940 exclusive of a footwear upper fastening element stud receiving bore 946. The basic exemplary upper and lower fastening system would comprise one of an upper fastener 920 or a lower fastener 940 having a magnetically charged surface and the other of the upper fastener 920 or the lower fastener 940 having either a magnetically attracting surface or a magnetically charged surface, where the magnetically charged surface of the one of an upper fastener 920 or a lower fastener 940 and the magnetically attracting surface or a magnetically charged surface of the other of the upper fastener 920 or the lower fastener 940 would be magnetically coupled to one another forming a magnetically coupled butt joint.

Figure 15:
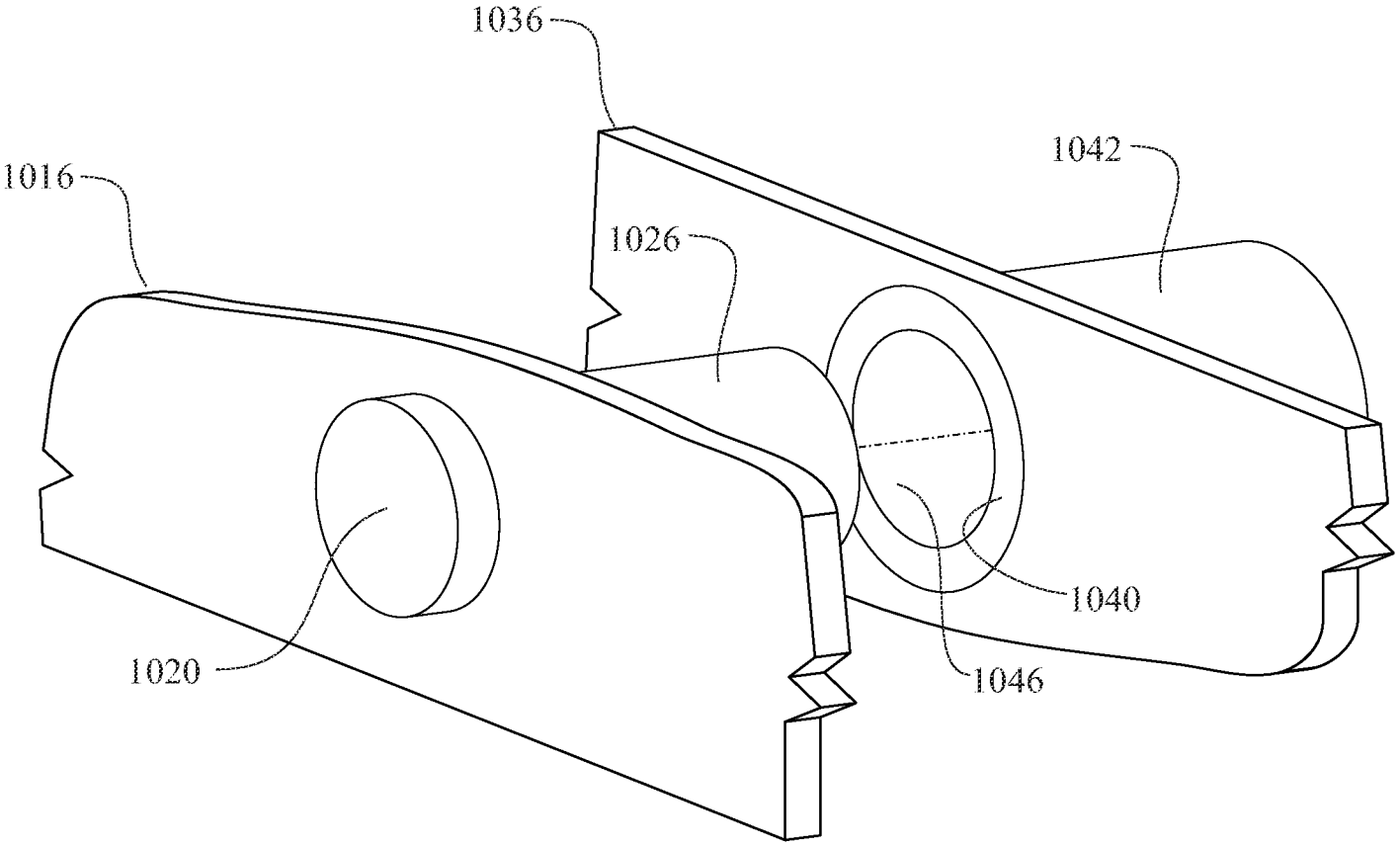
FIG. 15 presents an isometric side view of a tenth exemplary upper and lower fastening system employing a magnetic pin arrangement, the illustration presenting the upper fastener (magnetic pin) and the lower fastener (magnetic bore) being shown in a pre-engaging configuration.

The upper and lower fastening system illustrated in FIG. 14 employs an upper fastener and a lower fastener relying upon a magnetic attraction in combination with a mechanical engagement between a stud and a bore. An upper and lower fastening system introduced in FIG. 15 utilizes an upper fastener and a lower fastener relying upon a mechanical engagement with an optional enhancement of a magnetic attraction. The upper and lower fastening system introduced in FIG. 15 includes a footwear upper fastening element 1020 comprising a footwear upper fastening element retention pin 1026 extending horizontally from a footwear upper attachment edge 1016. The footwear upper fastening element retention pin 1026 is of a size and shape to be received by a footwear upper fastening element retention pin receiving aperture 1046 formed within a footwear lower fastening element body 1042, collectively forming a footwear lower fastening element 1040. The footwear lower fastening element 1040 is carried by a footwear lower attachment edge 1036.

The horizontally inserted footwear upper fastening element retention pin 1026 is retained within the footwear upper fastening element retention pin receiving aperture 1046 by the footwear upper attachment edge 1016. The footwear upper fastening element retention pin 1026 can be additionally retained within the footwear upper fastening element retention pin receiving aperture 1046 by fabricating the footwear upper fastening element retention pin 1026 and the footwear lower fastening element body 1042 of materials providing a magnetic attraction between the footwear upper fastening element retention pin 1026 and the footwear lower fastening element body 1042, such as the arrangements having a magnetic attraction previously described herein.

In use, the footwear upper attachment edge 1016 would be extended outward and the footwear upper fastening element retention pin 1026 would be inserted into the footwear upper fastening element retention pin receiving aperture 1046 of the footwear lower fastening element body 1042. The retention force provided by the footwear upper attachment edge 1016 in combination with the optional magnetic attraction between materials of the footwear upper fastening element retention pin 1026 and the footwear lower fastening element body 1042 retain the footwear upper fastening element retention pin 1026 within the footwear upper fastening element retention pin receiving aperture 1046, thus assembling the footwear upper 810 and the footwear lower 830 to one another. When removing the easy on footwear 800 from the person's foot 99, the easy on footwear 800 can either be slipped off, or the footwear upper attachment edge 1016 can be extended outward, separating the footwear upper fastening element retention pin 1026 from the footwear upper fastening element retention pin receiving aperture 1046. Once the footwear upper fastening element retention pin 1026 and the footwear upper fastening element retention pin receiving aperture 1046 are separated from one another, the footwear upper 810 and the footwear lower 830 can be separated from one another.

Figure 16:
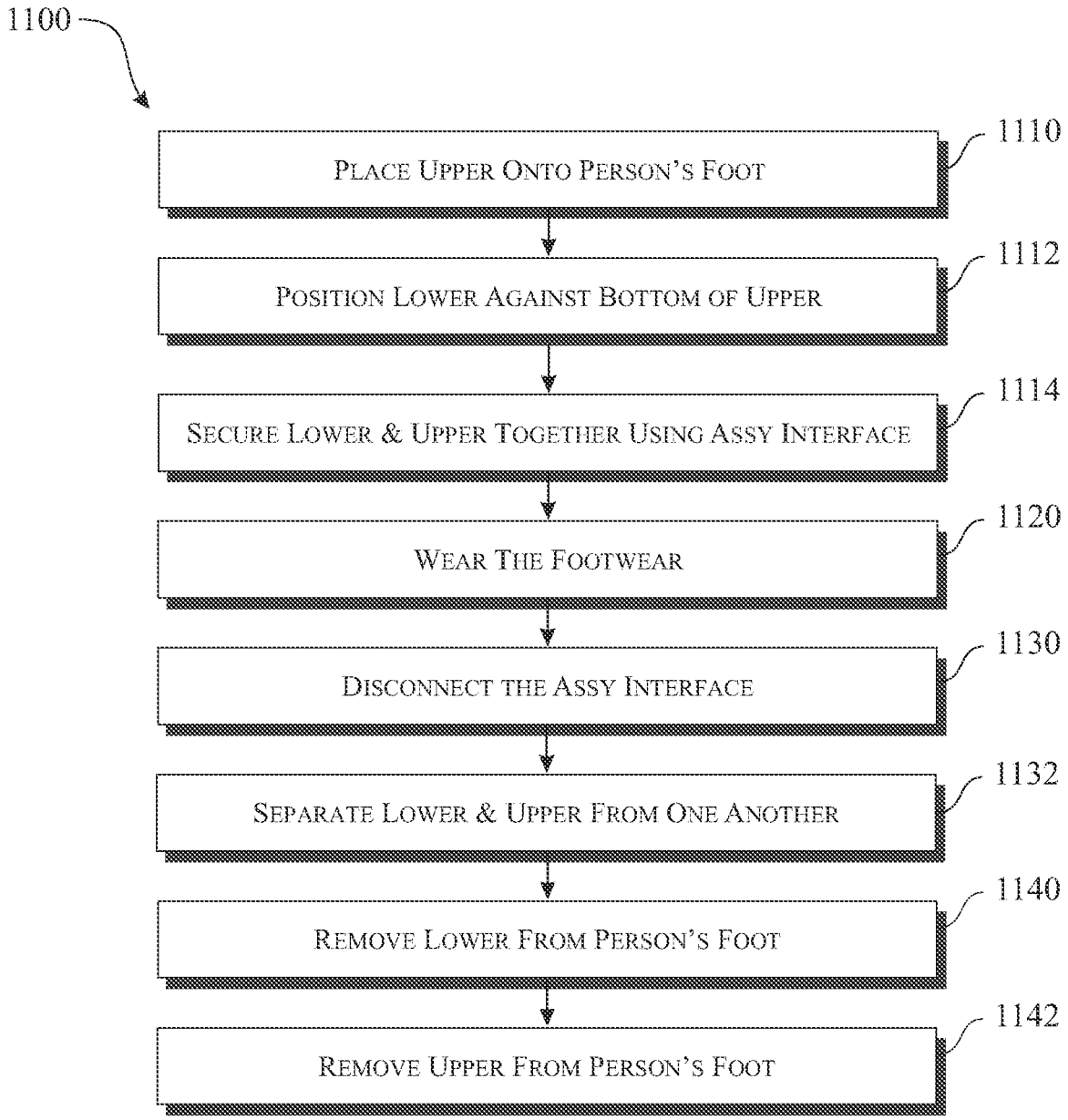
FIG. 16 presents an exemplary flow diagram describing steps of using the easy on footwear originally introduced in FIGS. 1, 2 and 11.

A first method of placing a footwear 100, 800 onto a person's foot 99 is described in an easy on footwear method of use flow diagram 1100 illustrated in FIG. 16. Prior to starting the process, a pair of footwear 100, 800 comprising a left footwear 100, 800 and a right footwear 100, 800 are located. Each footwear 100, 800 includes an upper 110, 810 and a lower 130, 830. The upper 110, 810 can be selected from a group of uppers 110, 810 having different dimensions, shapes, colors, and the like. The lower 130, 830 can be selected from a group of lowers 130, 830 having different dimensions, size ranges, sole thicknesses, shapes, colors, and the like. The easy on footwear method of use flow diagram 1100 initiates with a step of placing an upper 110, 810 onto a person's foot 99 (block 1110). Once the upper 110, 810 is in position, an assembly edge 136, 836 of a lower 130, 830 is positioned against a mating assembly edge 116, 816 of the upper 110, 810 (block 1112). The upper fasteners 120, 820 and the lower fasteners 140, 840 are joined with one another securing the upper 110, 810 and the lower 130, 830 with one another (block 1114), securing the footwear 100, 800 onto the person's foot 99. The footwear 100, 800 is then worn by the user over a period of time (block 1120). When the user desires to remove the footwear, the upper fasteners 120, 820 and the lower fasteners 140, 840 are separated from one another (block 1130). With the upper fasteners 120, 820 and the lower fasteners 140, 840 separated from one another, the upper 110, 810 and the lower 130, 830 are then separated from one another (block 1132). The lower 130, 830 is removed from the person's foot 99 (block 1140). The upper 110, 810 is then removed from the person's foot 99 (block 1142).

The footwear 100, 800 is designed to have the upper 110, 810 placed upon the person's foot 99 prior to placement of the lower 130, 830. In an alternate arrangement, the footwear can be designed to enable the lower to be placed upon the foot prior to the upper. One exemplary arrangement is an easy on footwear 1200 illustrated in FIGS. 17 and 18. The easy on footwear 1200 and the easy on footwear 100, 800 employ the same elements in a modified arrangement. Elements of the easy on footwear 1200 are numbered the same as like elements of the easy on footwear 100, 800, wherein the elements of the easy on footwear 1200 are preceded by the numeral "12". The distinction between the easy on footwear 1200 and the easy on footwear 100, 800 is the design of the interface between the footwear upper attachment edge 1216 and the footwear lower attachment edge 1236. In the easy on footwear 1200, the footwear upper attachment edge 1216 and the footwear lower attachment edge 1236 is designed to follow the sole in the toe portion of the easy on footwear 1200 and then splits the upper where the design segments the opening defining the footwear upper foot passageway 1214, where a first half of the opening defining the footwear upper foot passageway 1214 is a footwear upper body 1212, which is included with the footwear upper 1210 and a second half of the opening defining the footwear upper foot passageway 1214 is a footwear lower body heel section 1234, which is included with the footwear lower 1230.

Figure 17:
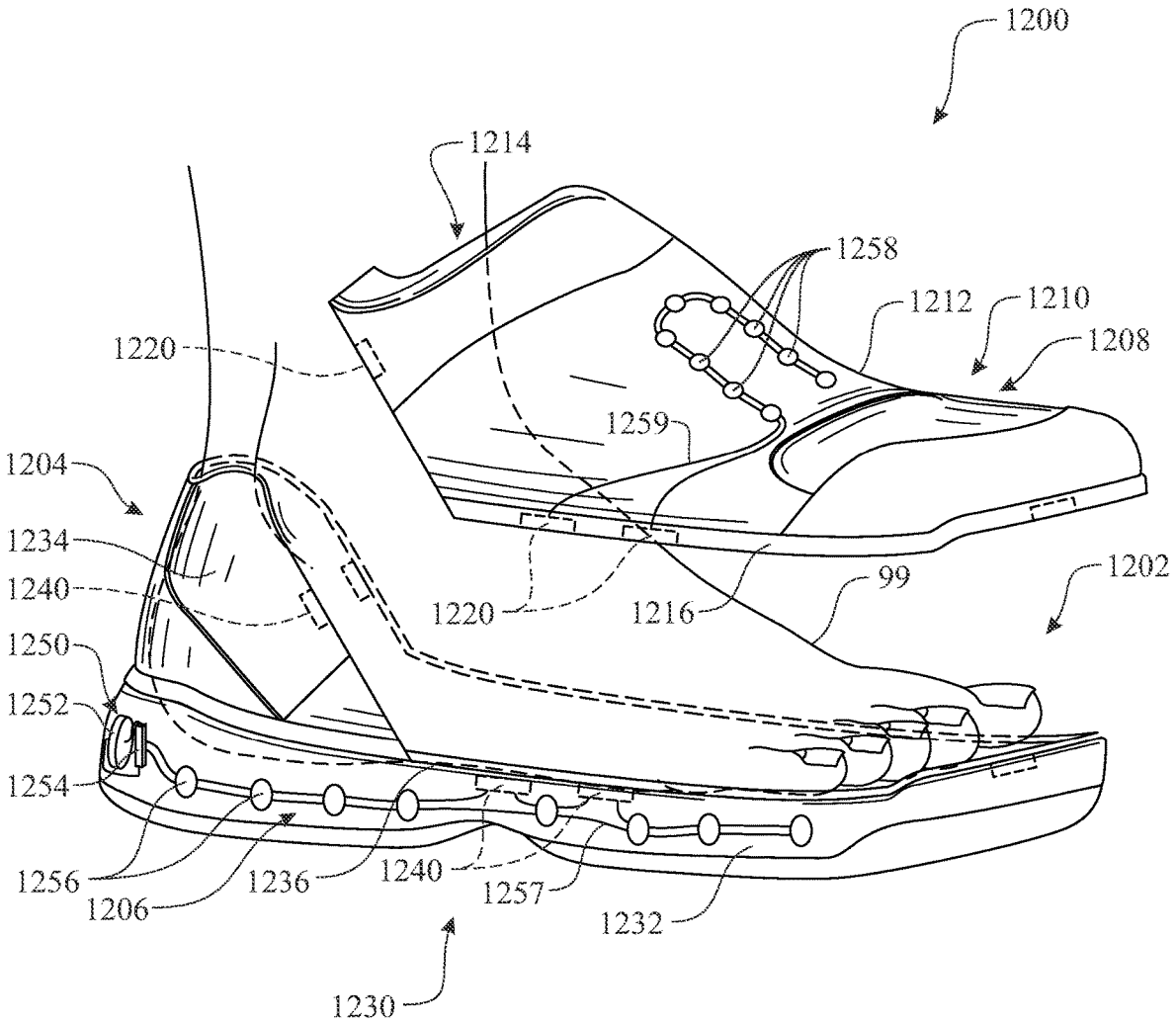
FIG. 17 presents a perspective exploded assembly side view of an exemplary easy on footwear, the footwear shown in a first exemplary placement step having the lower positioned against a sole of the foot of the person and the upper being staged for assembly to the lower.
Figure 18:
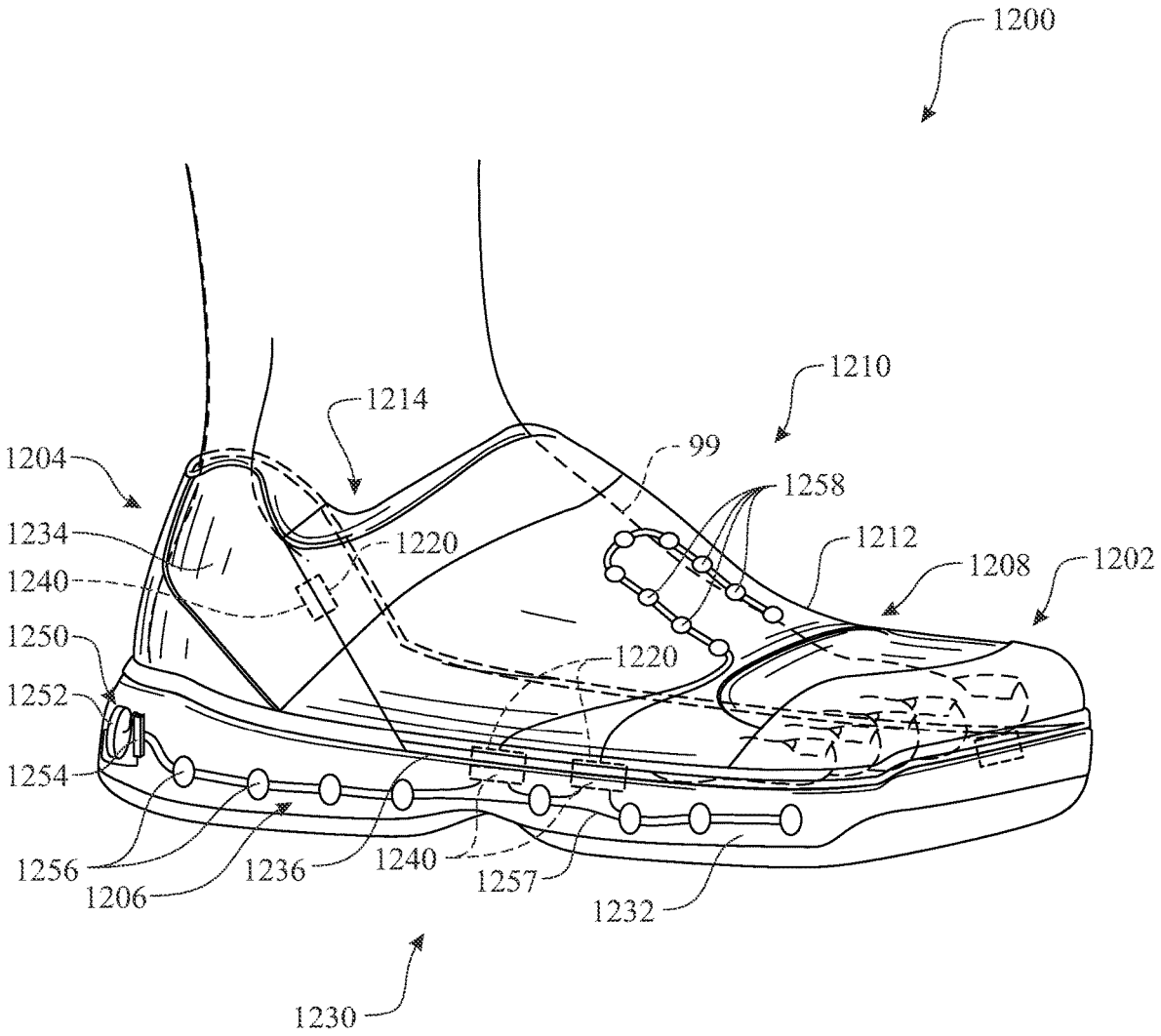
FIG. 18 presents a perspective side view of the exemplary easy on footwear originally introduced in FIG. 17, the footwear shown in a second exemplary placement step having the upper and lower joined to one another by joining a plurality of upper fasteners and lower fasteners to one another.
Figure 19:
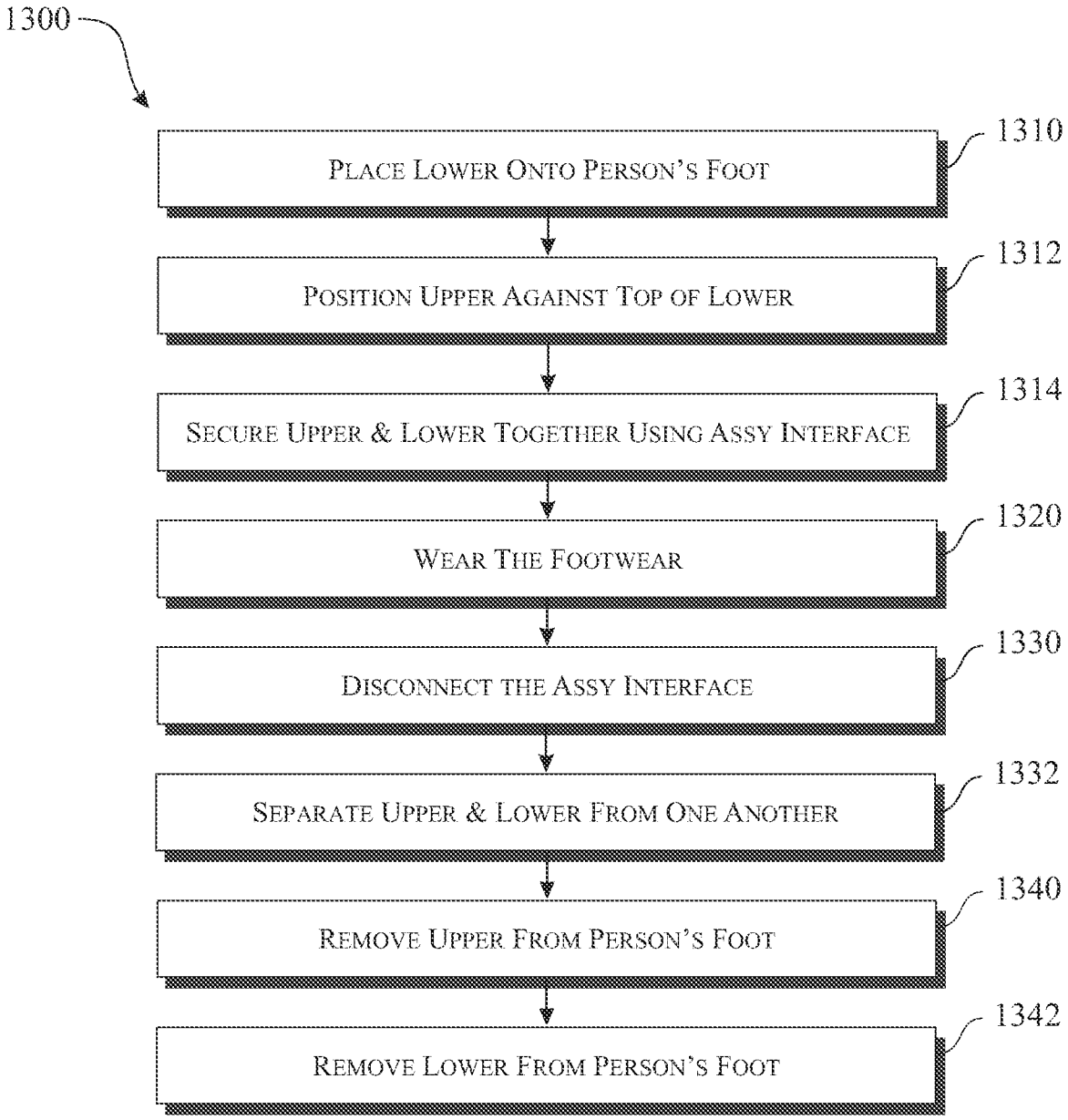
FIG. 19 presents an exemplary flow diagram describing steps of using the easy on footwear originally introduced in FIG. 17.

A modified version of the exemplary upper and lower fastening system presented in FIG. 14 was described providing a magnetically coupled butt joint. This arrangement described a horizontally mating design. Conversely, the exemplary upper and lower fastening system presented in FIGS. 17 and 18 is arranged providing a vertical mating design. The magnetic coupling introduces an opportunity. The magnetic coupling enables easy connection and disconnection between portions of an electrical circuit. A first portion can be provided in the footwear lower 1230 and a second portion can be provided in the footwear upper 1210. This split circuit can allow for integration of any suitable electronics circuit.

One exemplary circuit is a light emitting system 1250 integrated into the easy on footwear 1200 illustrated in FIGS. 17 and 18. The exemplary light emitting system 1250 provides a lighting circuit comprising a portable power source (battery) 1252, a motion activated switch 1254, a series of lower located light emitting elements 1256 spatially arranged about the footwear lower 1230 and a series of upper located light emitting elements 1258 spatially arranged about the footwear upper 1210. A lower located wiring portion 1257 conveys power from the portable power source (battery) 1252 to each of the lower located light emitting elements 1256. A combination of the lower located wiring portion 1257 and an upper located wiring portion 1259 conveys power from the portable power source (battery) 1252 to each of the upper located light emitting elements 1258. Power is transferred between the lower located wiring portion 1257 and the upper located wiring portion 1259 by the electro-mechanical joints formed between the respective footwear upper fastening element 1220 and the mating footwear lower fastening element 1240.

In operation, the user would assemble the footwear upper 1210 and the footwear lower 1230 to one another by joining each respective footwear upper fastening element 1220 with the associated footwear lower fastening element 1240. The connection between the footwear upper fastening element 1220 included in the upper circuit and the associated footwear lower fastening element 1240 included in the lower circuit completes the circuit. When the motion activated switch 1254 is subjected to motion (or a change in pressure), the motion activated switch 1254 provides power to each of the series of lower located light emitting elements 1256 and the series of upper located light emitting elements 1258. The connection between the footwear upper fastening element 1220 included in the upper circuit and the associated footwear lower fastening element 1240 included in the lower circuit can additionally be utilized to deactivate the light emitting system 1250 when the easy on footwear 1200 is removed from the person's foot 99.

Although a light emitting system 1250 is illustrated, it is understood that any electrical circuit can be integrated into the footwear upper 1210 and the footwear lower 1230 using the footwear upper fastening element 1220 included in the upper circuit and the associated footwear lower fastening element 1240 included in the lower circuit to complete the circuit between the two sections.

A second method of placing a footwear 1200 onto a person's foot 99 is described in an easy on footwear method of use flow diagram 1300. The easy on footwear method of use flow diagram 1300 initiates with a step of placing a lower 1230 against a sole of a person's foot 99 (block 1310). Once the lower 1230 is in position, an assembly edge 1216 of an upper 1210 is positioned against a mating assembly edge 1236 of the lower 1230 (block 1312). The upper fasteners 1220 and the lower fasteners 1240 are joined with one another securing the upper 1210 and the lower 1230 with one another (block 1314), securing the footwear 1200 onto the person's foot 99. The footwear 1200 is then worn by the user over a period of time (block 1320). When the user desires to remove the footwear, the upper fasteners 1220 and the lower fasteners 1240 are separated from one another (block 1330). With the upper fasteners 1220 and the lower fasteners 1240 separated from one another, the upper 1210 and the lower 1230 are then separated from one another (block 1332). The upper 1210 is removed from the person's foot 99 (block 1140). The lower 1230 is then removed from the person's foot 99 (block 1342).

The footwear 100, 800, 1200 includes an upper 110, 810, 1210 and a lower 130, 830, 1230 which is designed to be assembled to one another and disassembled from one another by an upper fastener 120, 820, 1220 and a lower fastener 140, 840, 1240.

The footwear 2000 and the footwear 100, 800 employ a number of similar elements. Elements of the footwear 2000 are numbered the same as like elements of the easy on footwear 100, 800, wherein the elements of the footwear 2000 are preceded by the numeral "20". The footwear 2000 differs from the footwear 100, 800 by having the upper 110, 810 and the lower 130, 830 assembled to one another. A footwear heel securing and release member is employed to aid in an insertion and removal of a person's foot 99 from the footwear 2000. The footwear heel securing and release member can be of any suitable design, with a number of examples being presented herein.

A first exemplary footwear heel securing and release member is a footwear heel securing and release system 2040, as illustrated in FIGS. 20 through 23. The exemplary footwear heel securing and release system 2040 includes a footwear heel securing and release member 2050 and a footwear heel securing and release control member subassembly 2060. The footwear heel securing and release member 2050 includes a footwear heel securing and release contact panel 2052 and a footwear heel securing and release support panel 2054. The footwear heel securing and release contact panel 2052 and the footwear heel securing and release support panel 2054 can define a footwear heel securing and release support member interior volume 2056. The footwear heel securing and release support panel 2054 is designed to be seated against an interior surface of a heel of the footwear 2000. The footwear heel securing and release control member subassembly 2060 enables a user to contract the footwear heel securing and release contact panel 2052 towards footwear heel securing and release support panel 2054. In the exemplary illustration, the footwear heel securing and release control member subassembly 2060 includes a footwear heel securing and release control member shaft 2064, wherein the footwear heel securing and release control member shaft 2064 engages with the footwear heel securing and release contact panel 2052 at a first end and a footwear heel securing and release control member grip 2062 affixed to the footwear heel securing and release control member shaft 2064 at a second end. Engagement between the first end of the footwear heel securing and release control member shaft 2064 and the footwear heel securing and release contact panel 2052 can be provided by any suitable design. In the exemplary illustration, a footwear heel securing and release control member attachment 2066 is secured to the footwear heel securing and release control member shaft 2064, wherein the footwear heel securing and release control member subassembly 2060 contacts an external surface of the footwear heel securing and release contact panel 2052. The footwear heel securing and release control member grip 2062 would be located externally to the footwear 2000. In the exemplary illustration, the footwear heel securing and release control member shaft 2064 is routed passing through the footwear upper body 2012 of the footwear 2000.

Figure 20:
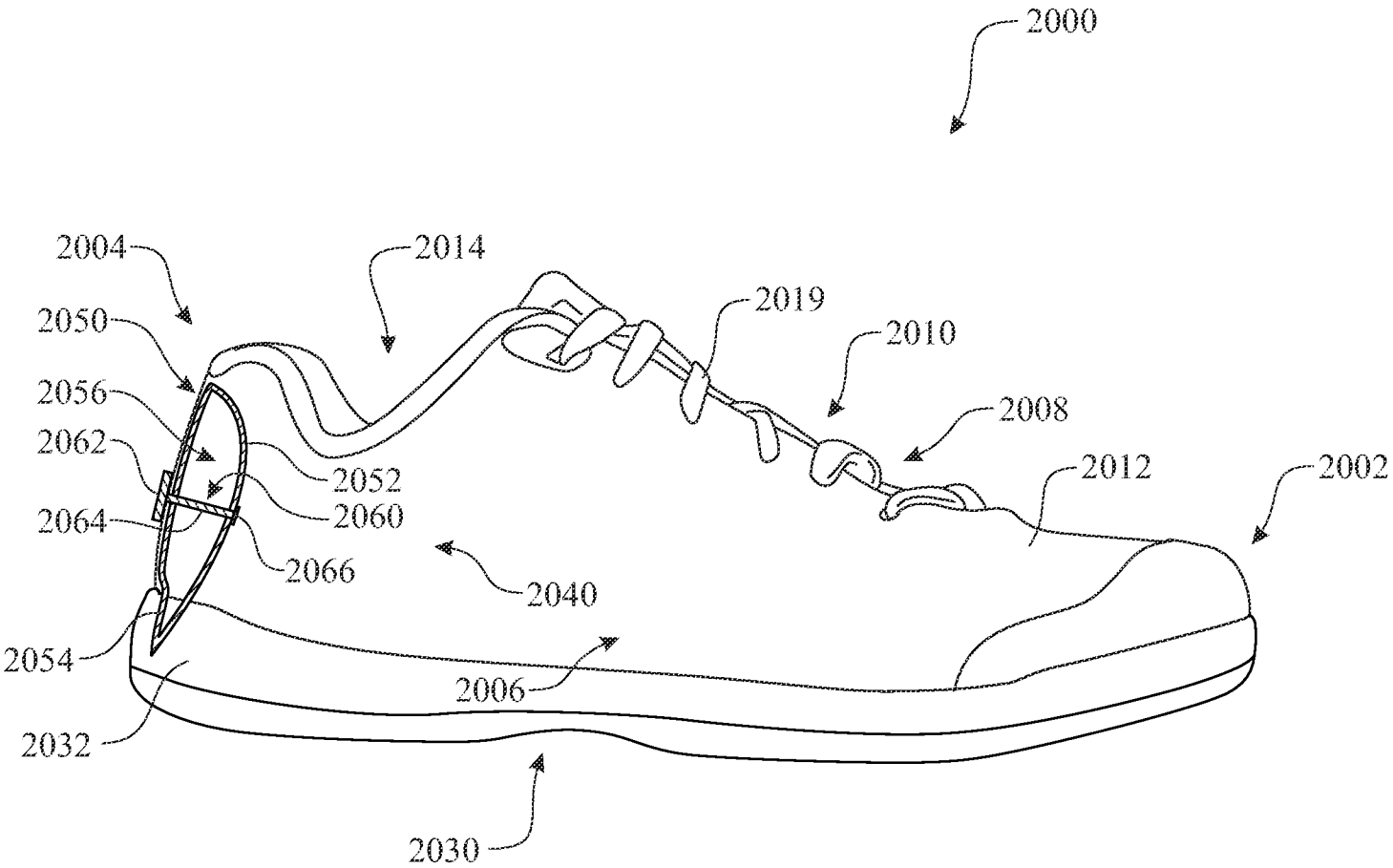
FIG. 20 presents an elevation view of a first exemplary footwear heel securing and release member, the first exemplary footwear heel securing and release member being illustrated in a relaxed state.
Figure 21:
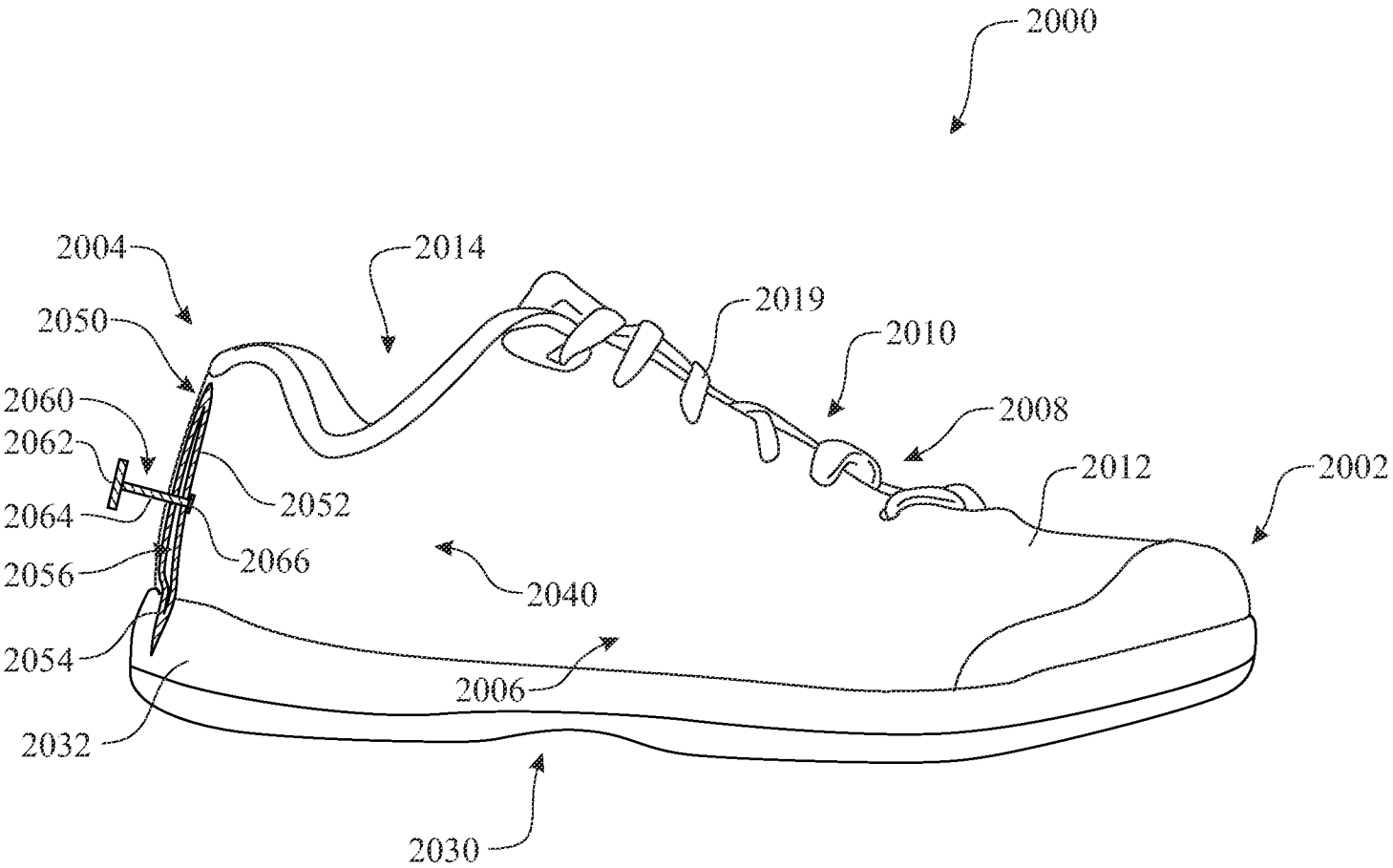
FIG. 21 presents an elevation view of the first exemplary footwear heel securing and release member originally introduced in FIG. 20, the first exemplary footwear heel securing and release member being illustrated in a fully contracted state.
Figure 22:
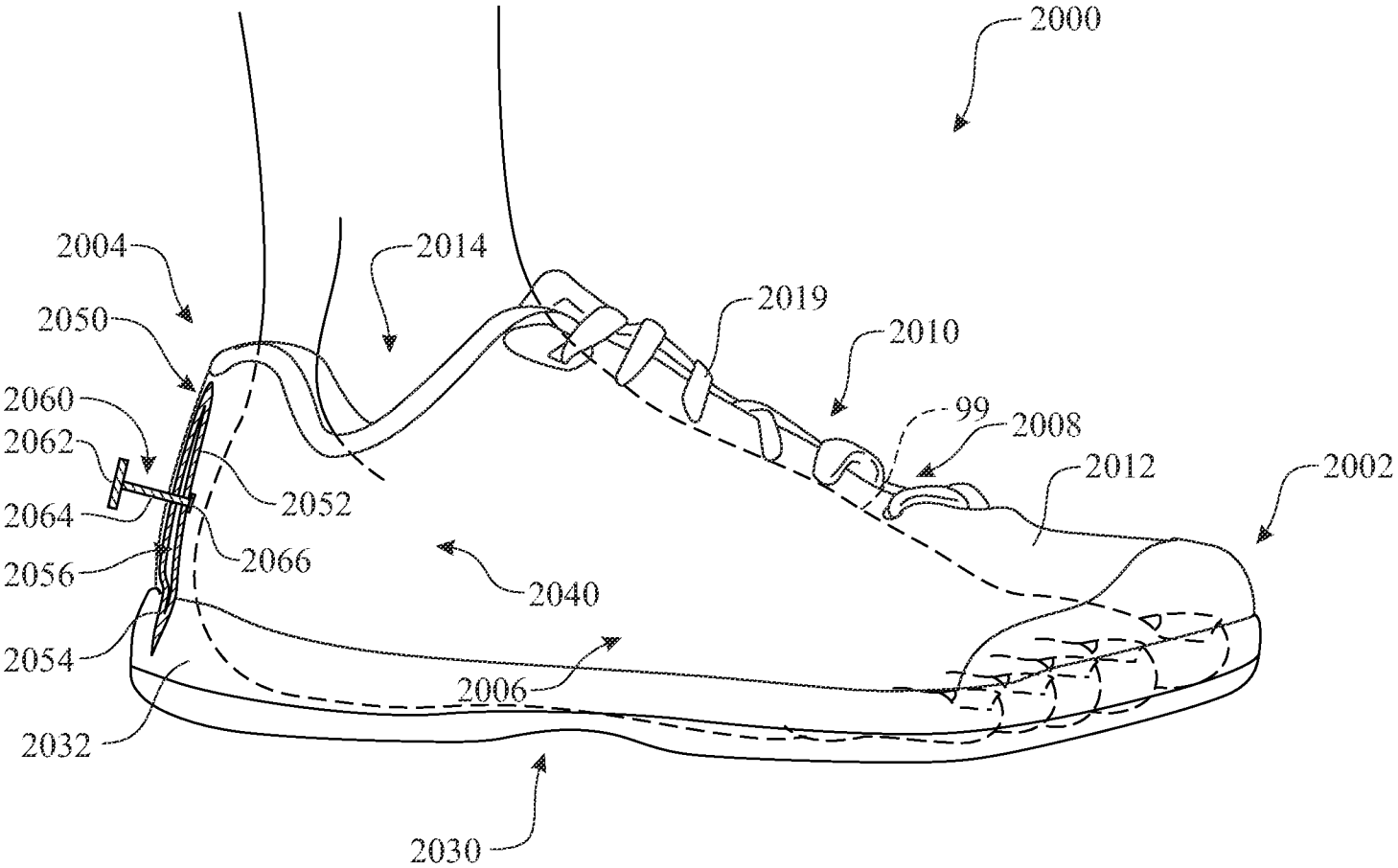
FIG. 22 presents an elevation view of the first exemplary footwear heel securing and release member originally introduced in FIG. 20, the first exemplary footwear heel securing and release member being illustrated in a fully contracted state enabling insertion of a foot of a person.
Figure 23:
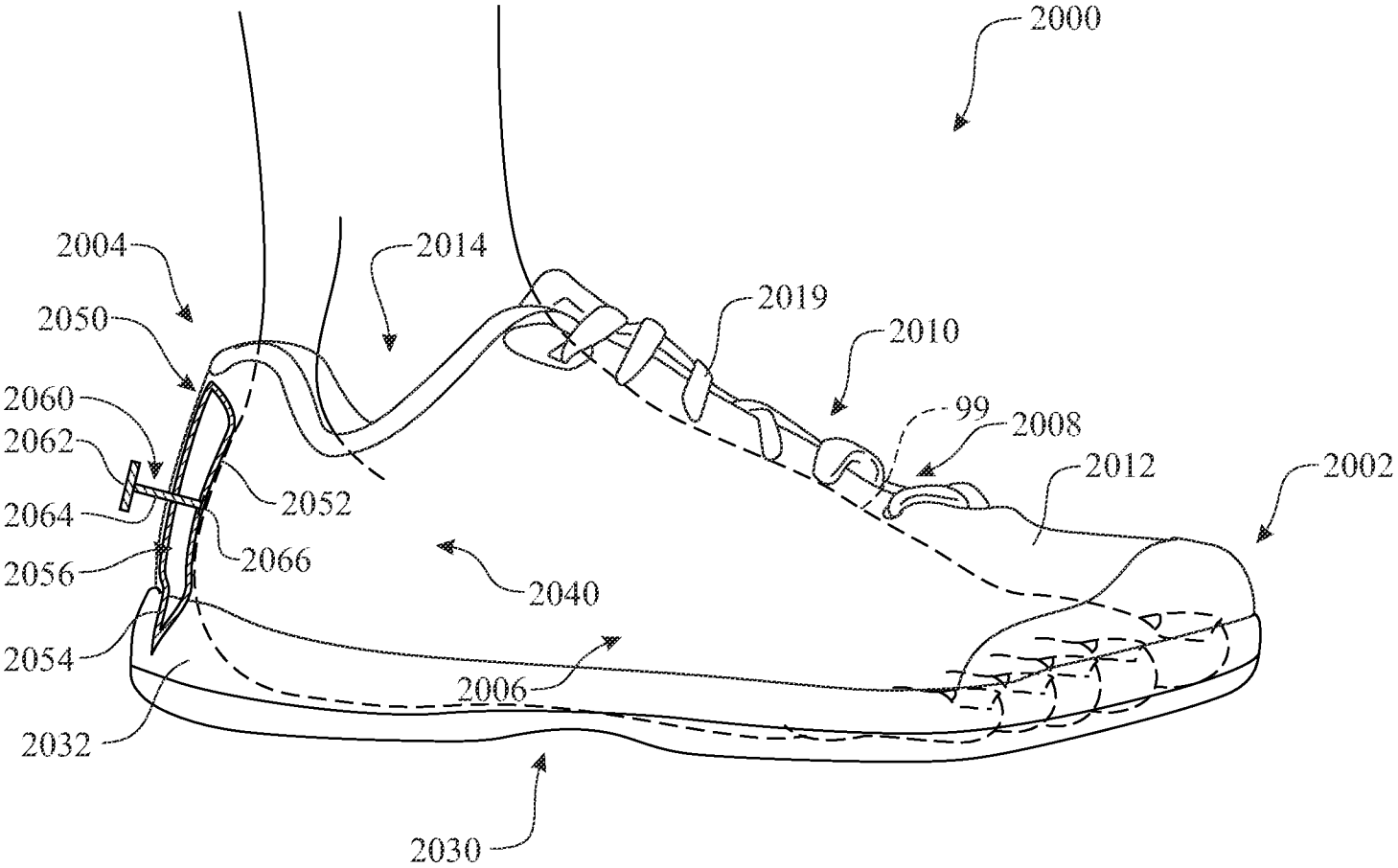
FIG. 23 presents an elevation view of the first exemplary footwear heel securing and release member originally introduced in FIG. 20, the first exemplary footwear heel securing and release member being illustrated in a relaxed state retaining the foot of the person within the footwear.

In use, the footwear heel securing and release system 2040 is integrated into the footwear 2000, which is illustrated in a relaxed state in FIG. 20. The footwear heel securing and release control member grip 2062 would be drawn away from the footwear upper body 2012. The motion of the footwear heel securing and release control member grip 2062 draws the second end of the footwear heel securing and release control member shaft 2064 towards the footwear heel securing and release support panel 2054, which draws the footwear heel securing and release contact panel 2052 towards the footwear heel securing and release support panel 2054, as illustrated in FIG. 21. Retraction of the footwear heel securing and release member 2050 provides a clearance for insertion of a person's foot 99 of a person, as illustrated in FIG. 22. A gap between a rear surface of a heel of the person's foot 99 and an exterior surface of the contracted footwear heel securing and release contact panel 2052 is clearly illustrated in FIG. 22. Once the person's foot 99 is in position, the contracting force is released from the footwear heel securing and release control member grip 2062, enabling the footwear heel securing and release member 2050 to return to a relaxed state taking a partial shape of the heel of the person's foot 99, thus providing retention force against the heel of the person's foot 99, as illustrated in FIG. 23. This can be accomplished using any of a variety of restoration processes. In a first example, the structure and material of the footwear heel securing and release contact panel 2052 and the footwear heel securing and release support panel 2054 can be used to restore the footwear heel securing and release contact panel 2052 towards a relaxed state. In a second example, the footwear heel securing and release support member interior volume 2056 can be filled with a material that aids in restoring the footwear heel securing and release member 2050 to a relaxed state. The material can be air (when the footwear heel securing and release member 2050 is air tight), a foam, a spring, a gel, or any other temporarily compressible material. Removal of the person's foot 99 from the footwear 2000 is achieved by applying a tensile force to the footwear heel securing and release control member grip 2062, which generates a compression force upon the footwear heel securing and release member 2050, enabling removal of the person's foot 99 from the footwear 2000.

Figure 24:
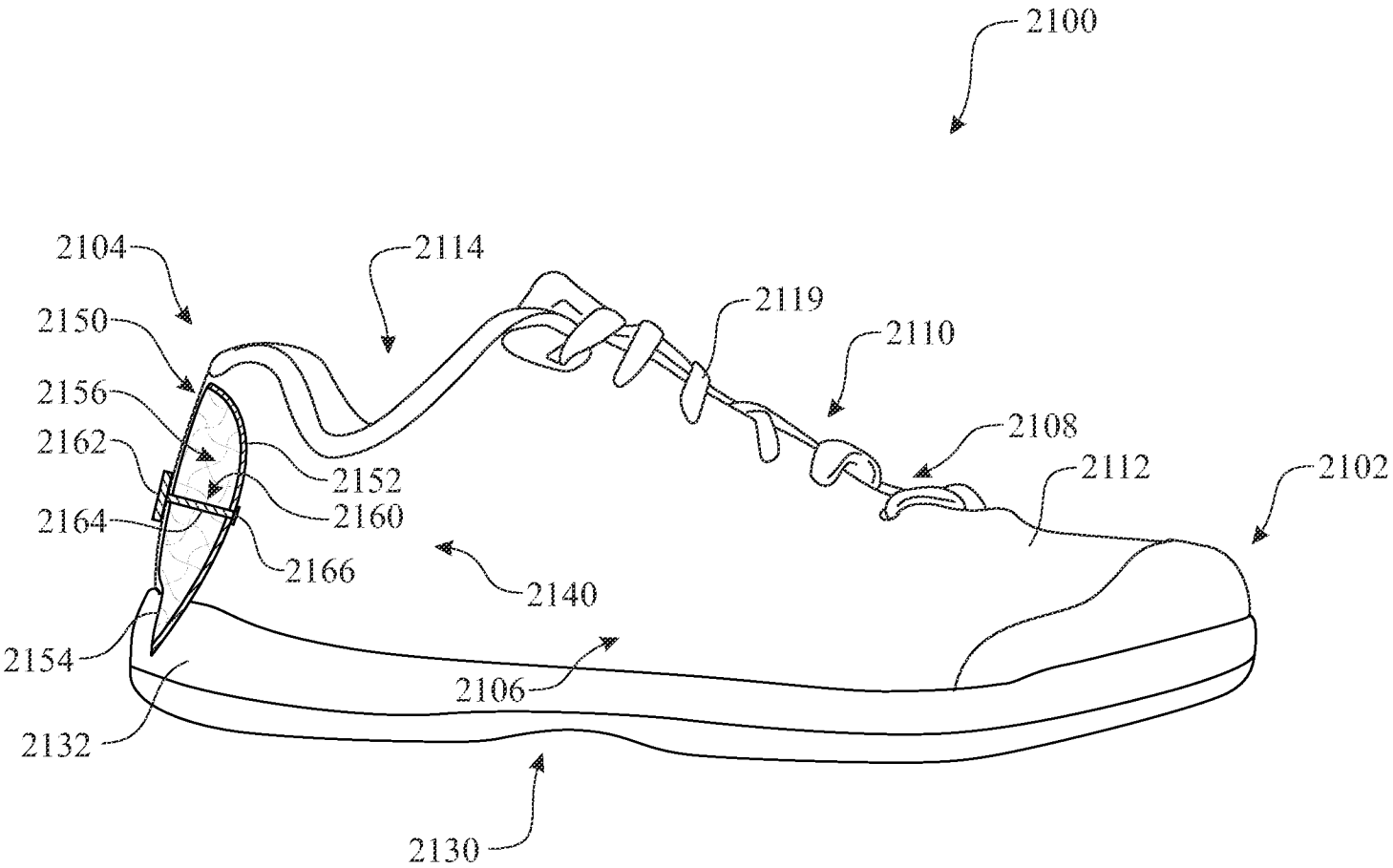
FIG. 24 presents an elevation view of a second exemplary footwear heel securing and release member, the second exemplary footwear heel securing and release member being illustrated in a relaxed state.
Figure 25:
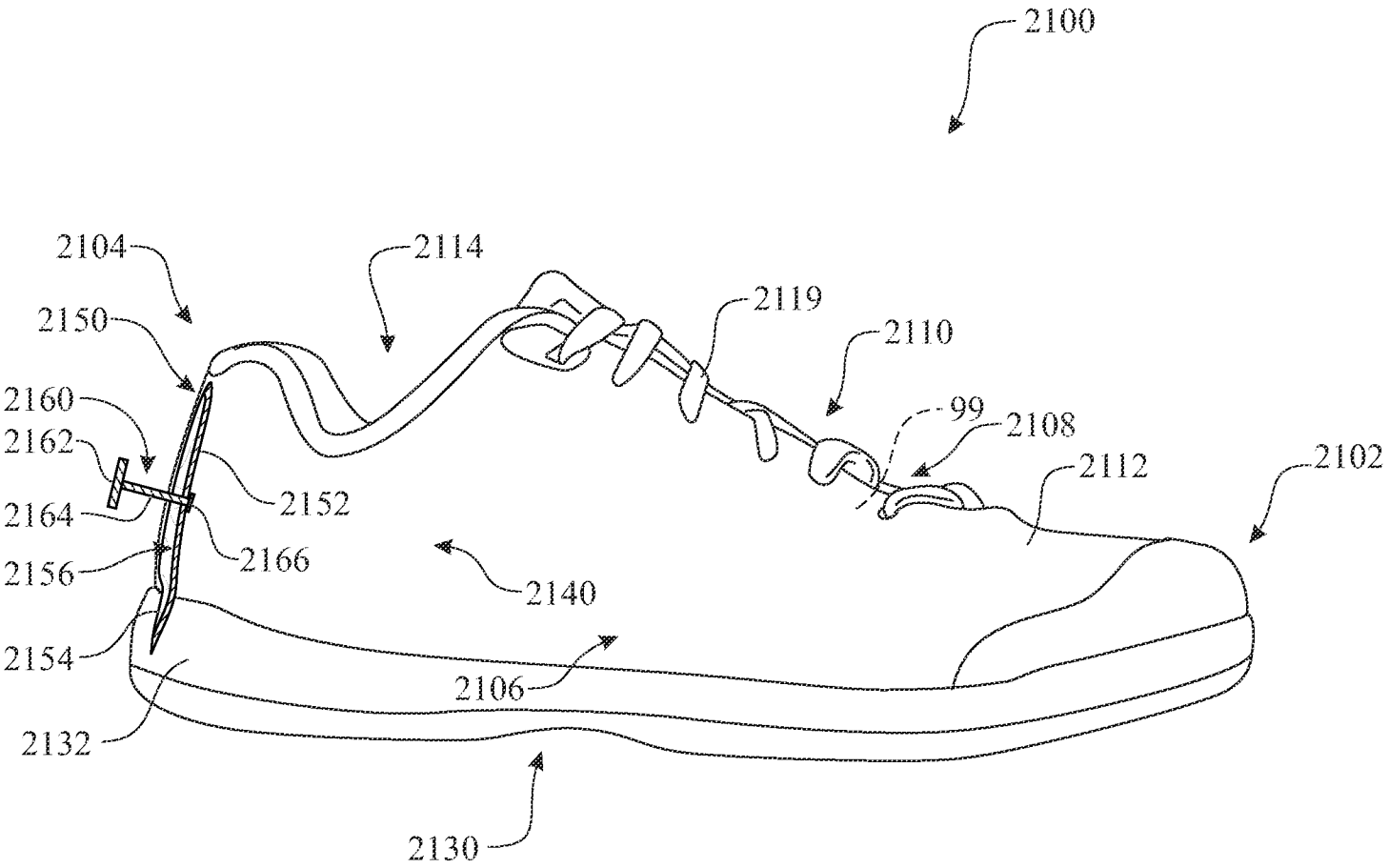
FIG. 25 presents an elevation view of the second exemplary footwear heel securing and release member originally introduced in FIG. 24, the second exemplary footwear heel securing and release member being illustrated in a fully contracted state.

A second exemplary footwear heel securing and release member is a footwear heel securing and release system 2140, as illustrated in FIGS. 24 and 25. The footwear 2100 and the footwear 2000 include a number of similar elements. Elements of the footwear 2100 are numbered the same as like elements of the footwear 2000, wherein the elements of the footwear 2100 are preceded by the numeral "21". The footwear heel securing and release system 2140 is integrated into the footwear 2100. An exemplary footwear heel securing and release member 2150 includes a footwear heel securing and release member body 2156, which is fabricated of a compressible material, such as a foam. A rear surface of the footwear heel securing and release member 2150 defines a footwear heel securing and release member support surface 2154. The material of the footwear heel securing and release member body 2156 is compressible, which can affect the compression when a compression force is applied to a small area. A footwear heel securing and release member retraction mesh 2152 can be utilized to distribute the compression force. The footwear heel securing and release member retraction mesh 2152 partially covers and controls a forward surface of the footwear heel securing and release member body 2156. In one example, the footwear heel securing and release member retraction mesh 2152 can be shaped similar to a common spider web, including both axial branches and radial segments.

In use, the footwear heel securing and release system 2140 is integrated into the footwear 2100, which is illustrated in a relaxed state in FIG. 24. The footwear heel securing and release control member subassembly 2160 is operated in the same manner in which the footwear heel securing and release control member subassembly 2060 is operated. The motion of the footwear heel securing and release control member subassembly 2160 contracts the footwear heel securing and release member retraction mesh 2152, which contracts the heel surface of the footwear heel securing and release member body 2156. Retraction of the footwear heel securing and release member retraction mesh 2152 and the footwear heel securing and release member body 2156 provides a clearance for insertion of a person's foot 99 of a person, as illustrated in FIG. 25. Once the person's foot 99 is in position, the contracting force is released from the footwear heel securing and release control member grip 2162, enabling the properties of the footwear heel securing and release member body 2156 to cause the footwear heel securing and release member body 2156 to return to a relaxed state taking a partial shape of the heel of the person's foot 99, thus providing retention force against the heel of the person's foot 99. Removal of the person's foot 99 from the footwear 2100 is achieved by applying a tensile force to the footwear heel securing and release control member grip 2162, which draws the footwear heel securing and release member retraction mesh 2152 towards the heel, generating a distributed compression force upon the footwear heel securing and release member 2150, enabling removal of the person's foot 99 from the footwear 2100.

A third exemplary footwear heel securing and release member is a footwear heel securing and release system 2240, as illustrated in FIGS. 24 and 25. The footwear 2200 and the footwear 2000 include a number of similar elements. Elements of the footwear 2200 are numbered the same as like elements of the footwear 2000, wherein the elements of the footwear 2200 are preceded by the numeral "22". The footwear heel securing and release system 2240 is integrated into the footwear 2200. An exemplary footwear heel securing and release member 2250 is preferably fabricated of a material that allows for flexibility, while returning to a relaxed state when a compression force is removed. The exemplary footwear heel securing and release member 2250 includes a footwear heel securing and release panel 2252, a footwear heel securing and release panel upper support member 2254, and a footwear heel securing and release panel lower support member 2255, preferably fabricated as a unitary structure. The footwear heel securing and release panel upper support member 2254 and the footwear heel securing and release panel lower support member 2255 provide support at opposite ends of the footwear heel securing and release panel 2252. A footwear heel securing and release control member subassembly 2260 can optionally include a footwear heel securing and release control biasing element 2268. The exemplary footwear heel securing and release control member subassembly 2260 is directly assembled to the footwear heel securing and release panel 2252. The assembly can be provided by any suitable assembly method, such as included in a molding of the footwear heel securing and release member 2250, threadably assembling the footwear heel securing and release control member shaft 2264 and the footwear heel securing and release panel 2252, a welding process, or any other suitable assembly process. The footwear heel securing and release control member grip 2262 can be assembled to the footwear heel securing and release control member shaft 2264 using any of the same described techniques.

Figure 26:
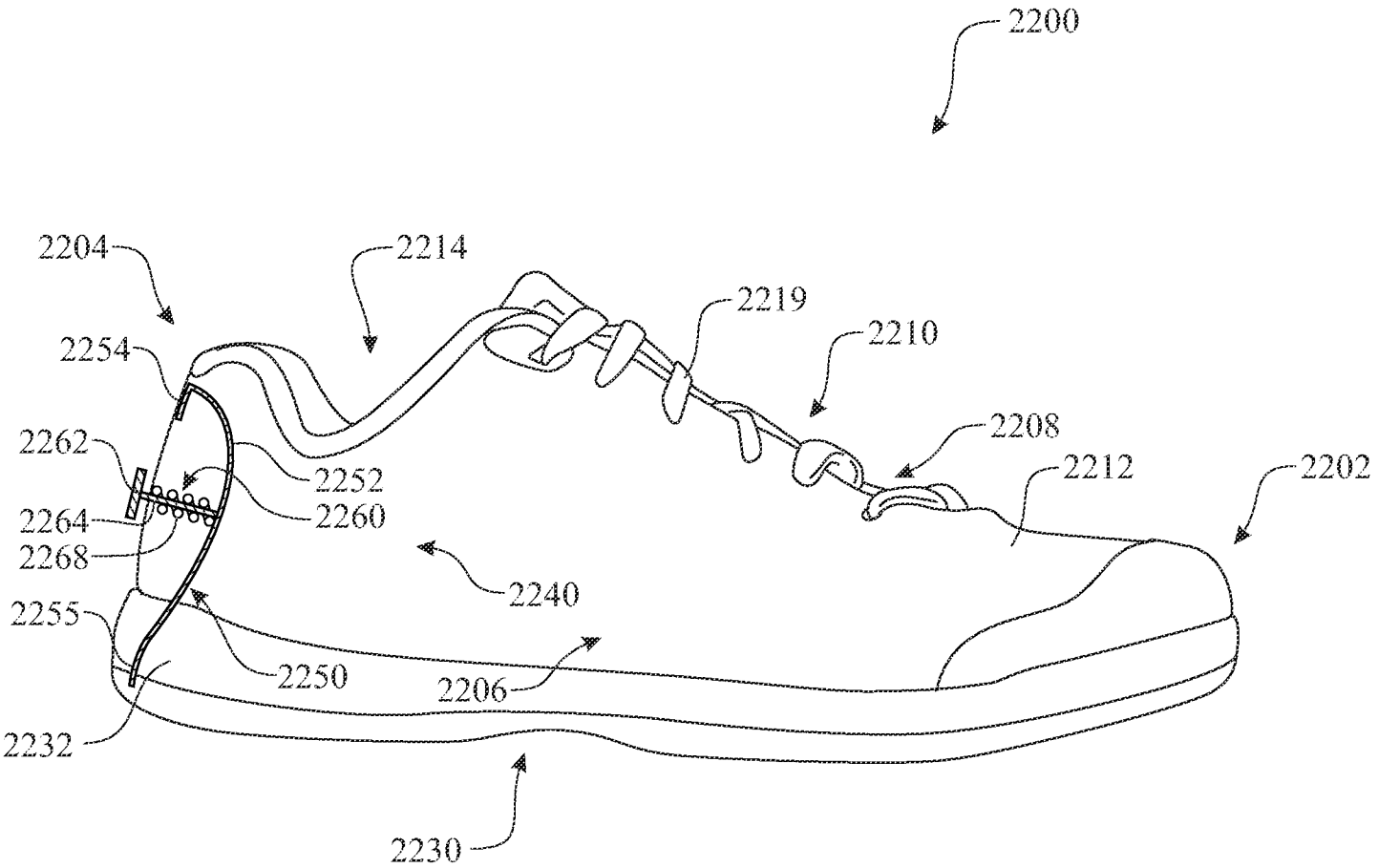
FIG. 26 presents an elevation view of a third exemplary footwear heel securing and release member, the third exemplary footwear heel securing and release member being illustrated in a relaxed state.
Figure 27:
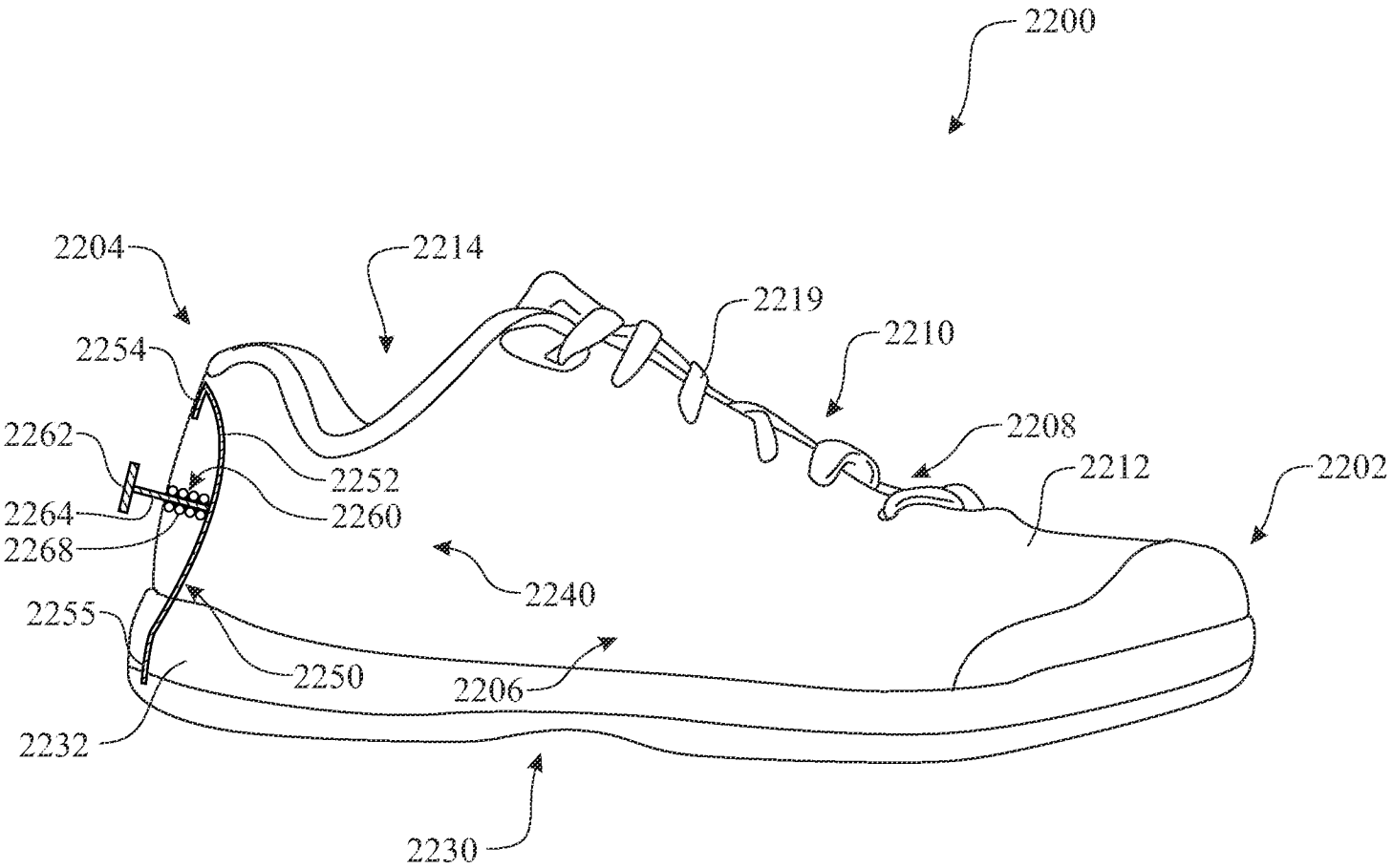
FIG. 27 presents an elevation view of the third exemplary footwear heel securing and release member originally introduced in FIG. 26, the third exemplary footwear heel securing and release member being illustrated in a fully contracted state.

In use, the footwear heel securing and release system 2240 is integrated into the footwear 2200, which is illustrated in a relaxed state in FIG. 26. The footwear heel securing and release control member subassembly 2260 is operated in the same manner in which the footwear heel securing and release control member subassembly 2060 is operated. The motion of the footwear heel securing and release control member subassembly 2260 contracts the footwear heel securing and release panel 2252. Retraction of the footwear heel securing and release panel 2252 provides a clearance for insertion of a person's foot 99 of a person, as illustrated in FIG. 27. Once the person's foot 99 is in position, the contracting force is released from the footwear heel securing and release control member grip 2262, enabling either the properties of the footwear heel securing and release member 2250 and/or the footwear heel securing and release control biasing element 2268 to cause the footwear heel securing and release member retraction mesh 2152 to return to a relaxed state taking a partial shape of the heel of the person's foot 99, thus providing retention force against the heel of the person's foot 99. Removal of the person's foot 99 from the footwear 2200 is achieved by applying a tensile force to the footwear heel securing and release control member grip 2262, which draws the footwear heel securing and release panel 2252 towards the heel, enabling removal of the person's foot 99 from the footwear 2200.

Figure 28:
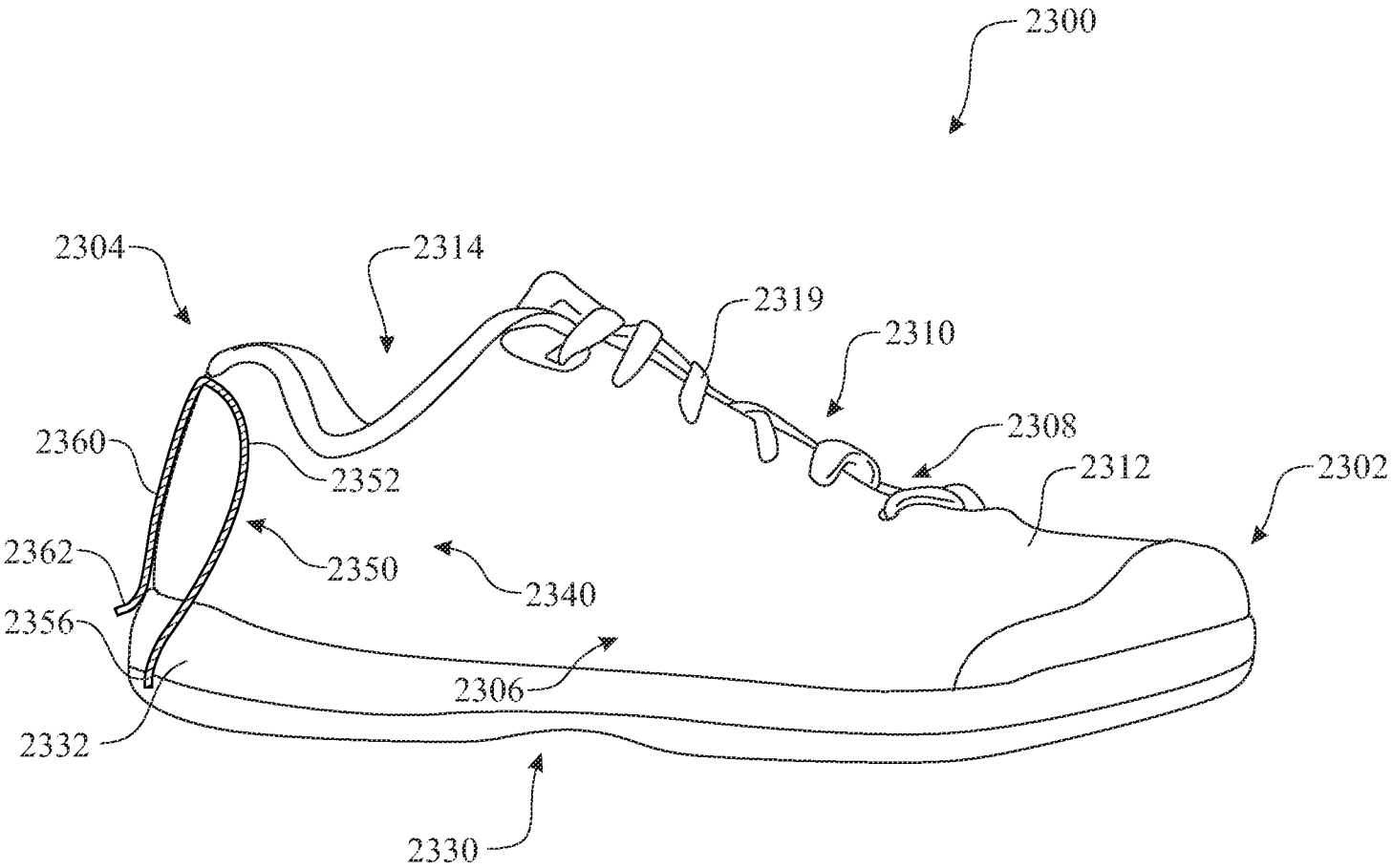
FIG. 28 presents an elevation view of a fourth exemplary footwear heel securing and release member, the fourth exemplary footwear heel securing and release member being illustrated in a relaxed state.
Figure 29:
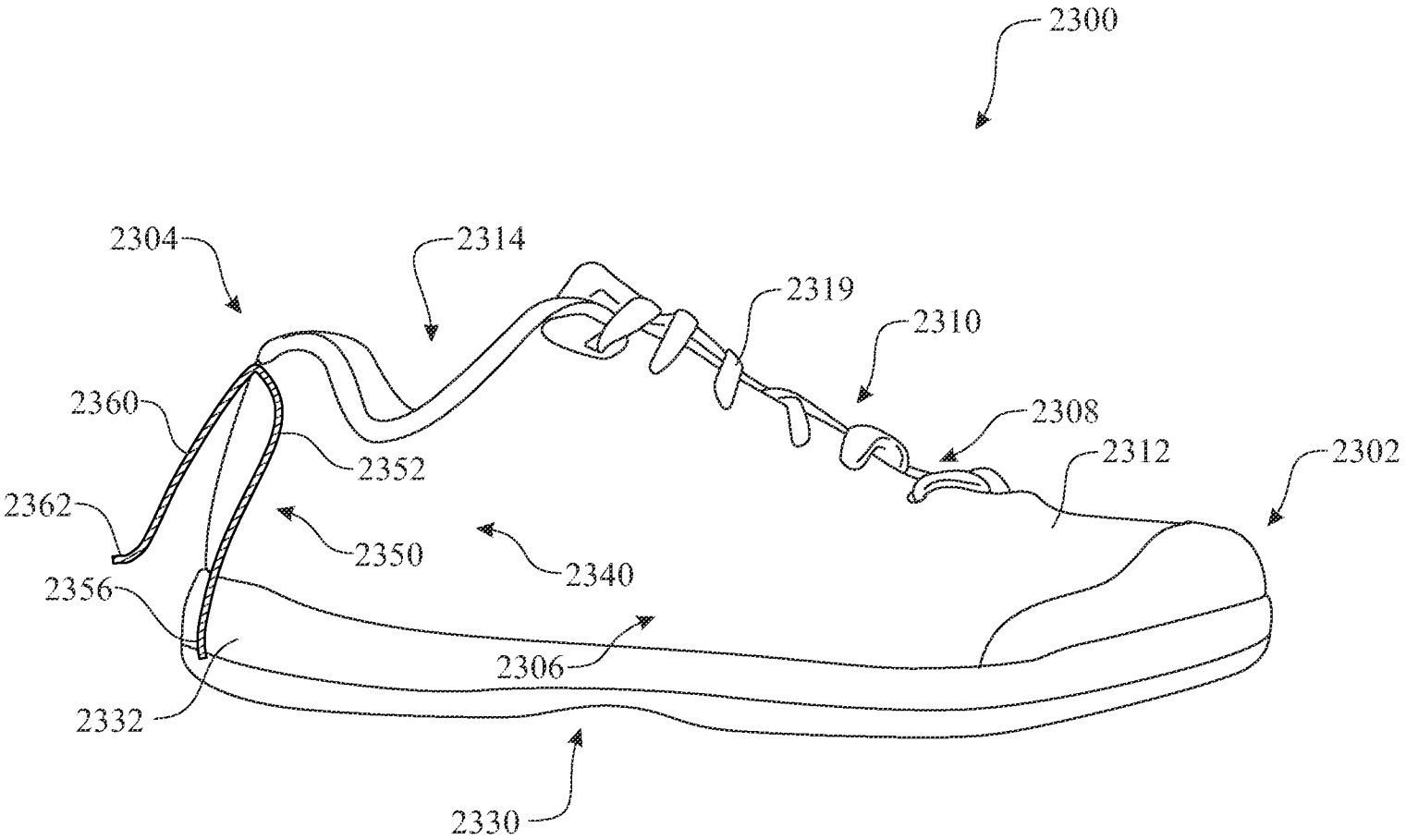
FIG. 29 presents an elevation view of the fourth exemplary footwear heel securing and release member originally introduced in FIG. 28, the fourth exemplary footwear heel securing and release member being illustrated in a fully contracted state.
Figure 30:
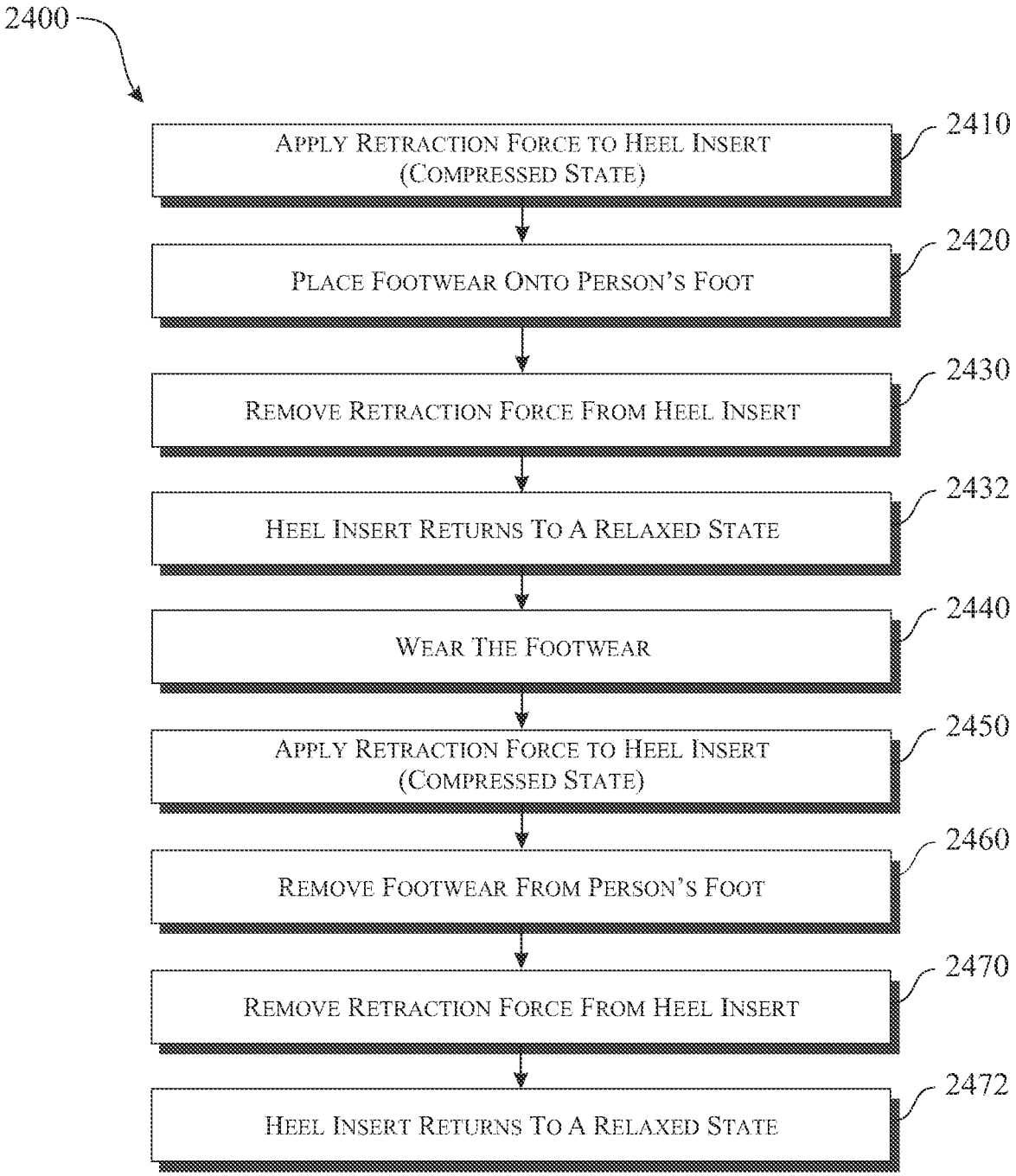
FIG. 30 presents an exemplary flow diagram describing steps of using the heel securing and release member.
Figure 31:
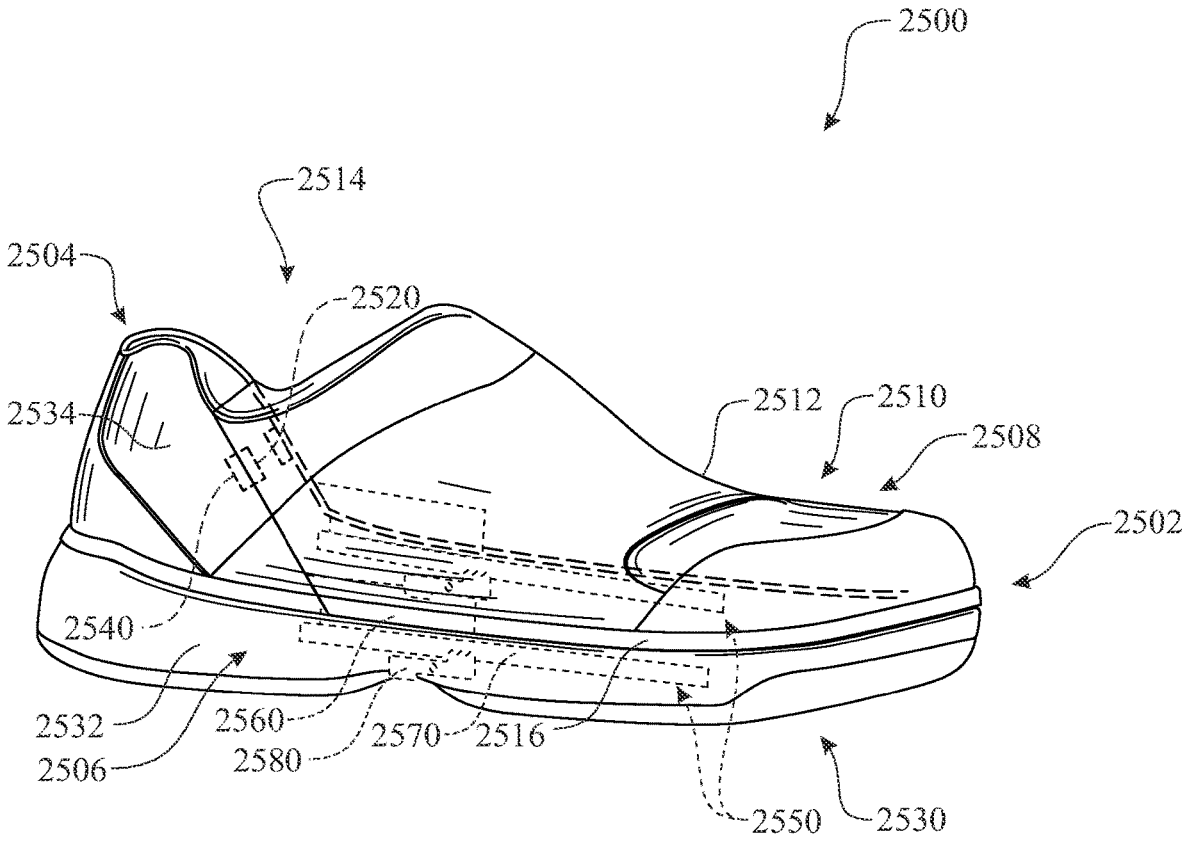
FIG. 31 presents a perspective side view of another exemplary easy on footwear, the easy on footwear shown in an stored state.

A fourth exemplary footwear heel securing and release member is a footwear heel securing and release system 2340, as illustrated in FIGS. 28 and 29. The footwear 2300 and the footwear 2000 include a number of similar elements. Elements of the footwear 2300 are numbered the same as like elements of the footwear 2000, wherein the elements of the footwear 2300 are preceded by the numeral "23". The footwear heel securing and release system 2340 is integrated into the footwear 2300. An exemplary footwear heel securing and release member 2250 is preferably fabricated of a material that allows for flexibility, while returning to a relaxed state when a rotational force is removed. The exemplary footwear heel securing and release member 2350 includes a footwear heel securing and release panel 2352, a footwear heel securing and release panel lower support member 2356, a footwear heel securing and release control member 2360, and a footwear heel securing and release control member grip 2362, preferably fabricated as a unitary structure. The footwear heel securing and release panel 2352 of the footwear heel securing and release system 2340 is inserted into interior of the footwear 2300 and the footwear heel securing and release control member 2360 would be located external to the footwear 2300. The footwear heel securing and release member 2350 can either pass over an upper edge of the heel or pass through a slot formed through the heel. The upper edge of the heel or the pass through slot can be utilized as a fulcrum for the footwear heel securing and release member 2350. The footwear heel securing and release control member grip 2362 is preferably formed to act as a handle or grip.

In use, the footwear heel securing and release system 2340 is integrated into the footwear 2300, which is illustrated in a relaxed state in FIG. 28. A lifting force would be applied to the footwear heel securing and release control member grip 2362. The lifting force will pivot or rotate the footwear heel securing and release panel 2352. The footwear heel securing and release panel lower support member 2356 engages with the interior surface of the heel portion of the footwear 2300 creating a spring effect along the footwear heel securing and release panel 2352, as illustrated in FIG. 29 and the footwear heel securing and release panel 2352contracts into an insertion condition. While the footwear heel securing and release panel 2352 is contracted, the person's foot 99 is inserted into the footwear 2300. When the lifting force is released from the footwear heel securing and release control member grip 2362, the footwear heel securing and release panel 2352 returns to a relaxed state, retaining the person's foot 99 within the footwear 2300. When the footwear 2300 is being removed, the lifting force is reapplied to the footwear heel securing and release control member grip 2362, retracting the footwear heel securing and release panel 2352 from the heel and allowing removal of the person's foot 99 from the footwear 2300.

A method of placing a footwear 2000 onto a person's foot 99 is described in a footwear heel insert retention and release method of use flow diagram 2400. The footwear heel insert retention and release method of use flow diagram 2400 references the footwear heel securing and release system 2040 as an example of any of the footwear heel securing and release members 2040, 2140, 2240, 2230. A precursor to the footwear heel insert retention and release method of use flow diagram 2400 is integration of the footwear heel securing and release system 2040 into the footwear 2000. The footwear heel insert retention and release method of use flow diagram 2400 initiates with a step of applying a retraction force (block 1310) to the footwear heel securing and release contact panel 2052 of the footwear heel securing and release system 2040 (block 2410). With the footwear heel securing and release contact panel 2052 retracted, the person's foot 99 is inserted through the footwear upper foot passageway 2014 and into the footwear 2000 (block 2420). The retraction force is removed from the footwear heel securing and release system 2040 (block 2430). The footwear heel securing and release system 2040 returns to a relaxed state, contouring against the inserted heel (block 2432) and retaining the person's foot 99 within the footwear 2000. When the user desires to remove the footwear, the retraction force (block 1310) would be reapplied to the footwear heel securing and release contact panel 2052 of the footwear heel securing and release system 2040 (block 2450). The person's foot 99 would be removed from the footwear 2000 (block 2460). The retraction force is then removed from the footwear heel securing and release system 2040 (block 2470). The footwear heel securing and release system 2040 returns to a relaxed state (block 2472). If the footwear heel securing and release system 2040 is used in multiple footwear 2000, the footwear heel securing and release system 2040 can be removed from the current footwear 2000 and inserted into a different footwear 2000.

Although the above describes a number of different footwear heel securing and release members, it is understood that any arrangement that functions in a similar manner can be utilized.

Another exemplary easy on footwear design is an easy on footwear 2500, illustrated in FIGS. 31 through 36. Orientation of the easy on footwear 2500 can be described as having a footwear toe 2502 and a footwear heel 2504. Similar to the other variants described above, the easy on footwear 2500 includes a footwear upper 2510 and a footwear lower 2530 slideably assembled to one another using a sliding mechanism assembly 2550. Details of the sliding mechanism assembly 2550 are presented in FIGS. 37 through 41. The footwear upper 2510 includes a footwear upper body 2512. A shoe element motion first guide member 2560 of the sliding mechanism assembly 2550 is secured to the footwear upper body 2512 along a footwear upper bottom mating edge 2517 thereof. At least one footwear upper fastening element 2520 can be secured to the footwear upper body 2512. A footwear upper foot passageway 2514 is formed between upper edges of the footwear upper body 2512 and the footwear lower body 2532 when the footwear upper 2510 and the footwear lower 2530 are located in a closed or worn position.

The footwear lower 2530 includes a footwear lower body heel section 2534 extending upward from a footwear lower body 2532. A shoe element motion second guide member 2570 of the sliding mechanism assembly 2550 is secured to the footwear lower body 2532 along a footwear lower top mating edge 2537 thereof and slideably assembled to the shoe element motion first guide member 2560. At least one footwear lower fastening element 2540 can be secured to the footwear lower body 2532 at a location to engage with the footwear upper fastening element 2520 when the footwear upper 2510 and the footwear lower 2530 are placed into a closed or worn position, as shown in the exemplary illustrations presented in FIGS. 31 and 36. At least one footwear lower fastening element 2540 can be secured to the footwear lower body heel section 2534 at a location to engage with a respective footwear upper fastening element 2520 when the footwear upper 2510 and the footwear lower 2530 are placed into a closed or worn position, as shown in the exemplary illustrations presented in FIGS. 31 and 36.

The shoe element motion first guide member 2560 of the sliding mechanism assembly 2550 includes a shoe element motion first guide member slide portion 2564 preferably located along an engaging edge of a shoe element motion first guide member attachment portion 2562. The shoe element motion first guide member attachment portion 2562 is carried by a footwear upper attachment edge 2516 of the footwear upper body 2512. The shoe element motion second guide member 2570 of the sliding mechanism assembly 2550 includes a shoe element motion second guide member slide portion 2574 preferably located along an engaging edge of a shoe element motion second guide member attachment portion 2572. The shoe element motion first guide member slide portion 2564 is of a shape and size enabling the shoe element motion first guide member slide portion 2564 to slide within a shoe element motion second guide member slide portion 2574. In the exemplary illustration, the shoe element motion first guide member slide portion 2564 has a cross section that is circular in shaped and the shoe element motion second guide member slide portion 2574 has a cross section that has a C shape. Although the exemplary illustrations present a circular interface shape, it is understood that any suitable interface shape can be utilized, including a T shape, an I shape, an L shape, a trapezoidal shape, a dovetail shape, a square shape, a rectangular shape, or any other suitable cross sectional shape.

The shoe element motion first guide member 2560 and the shoe element motion second guide member 2570 are preferably fabricated of a flexible material, such as a flexible plastic, a nylon, or any other suitable material. The shoe element motion first guide member 2560 and the shoe element motion second guide member 2570 can be linear or include a curve or a complex curve to accommodate the shape of the easy on footwear 2500 while enabling the sliding motion.

A shoe element motion controlling member 2580 can be utilized to lock and release the shoe element motion first guide member 2560 within the shoe element motion second guide member 2570. The shoe element motion controlling member 2580 can be provided in any form factor and functioning in accordance with the form factor. Examples can include a pivoting action (as illustrated), a push/pull design, a sliding design, or any other form factor enabling application of a retention position and a release position. In a retention position, engagement between the locking mechanism and the shoe element motion first guide member slide portion 2564 would restrain the shoe element motion first guide member 2560 from moving respective to the shoe element motion second guide member 2570. The engagement can be a friction interface, a mechanical interference interface (as illustrated), a magnetic attraction interface, or any other suitable interface which applies a motion restriction in one position and a release in a second position.

In the exemplary illustrations, the shoe element motion controlling member 2580 includes a shoe element motion controlling member actuator section 2584 provided at one end of a shoe element motion controlling member pivot arm 2582 and a shoe element motion controlling member locking section 2586 provided at a second, opposite end of the shoe element motion controlling member pivot arm 2582. The shoe element motion controlling member 2580 pivots 2589 about a pivot element (not shown, but well understood by those skilled in the art) inserted through a shoe element motion controlling member pivoting aperture 2588. Alternatively, a pivot element can be integrated or assembled to the shoe element motion controlling member pivot arm 2582 and inserted through an aperture formed in the footwear lower body 2532.

A shoe element motion controlling member bias element 2583 can be included to retain the locking mechanism in a motion restricting position; requiring a force to overcome the shoe element motion controlling member bias element 2583 in order to release or disengage the locking mechanism. In the exemplary illustration, the shoe element motion controlling member bias element 2583 is a cantilevered spring that is integral with the shoe element motion controlling member 2580. The shoe element motion controlling member bias element 2583 can be of any form factor that has spring like or elastic properties, including a cantilevered spring (as illustrated), a compression spring, a coil spring, or when located on an opposite side, a tension spring, an elastic member, or when located about the pivoting axis a torsion spring, or any other suitable biasing element. The shoe element motion controlling member bias element 2583 can be integral with the shoe element motion controlling member 2580 (as illustrated) or a separate element located in an appropriate position respective to the shoe element motion controlling member 2580. In an alternate arrangement, the locking mechanism can employ a magnetic attraction between the shoe element motion controlling member 2580 and the shoe element motion first guide member 2560 to retain the locking mechanism in engagement until purposely released.

The sliding mechanism assembly 2550 is assembled to the easy on footwear 2500 by joining the shoe element motion first guide member attachment portion 2562 to the footwear upper attachment edge 2516 and by joining the shoe element motion second guide member attachment portion 2572 to the footwear lower body 2532. The shoe element motion first guide member slide portion 2564 can be inserted within the shoe element motion second guide member slide portion 2574 either prior to assembly of the sliding mechanism assembly 2550 to the easy on footwear 2500 or following assembly of the sliding mechanism assembly 2550 to the easy on footwear 2500. The shoe element motion controlling member 2580 can be pivotally assembled to the shoe element motion second guide member 2570, the footwear lower body 2532, or both.

The shoe element motion controlling member 2580 includes a locking feature. The exemplary locking feature includes a series of shoe element motion controlling member locking engagement surfaces 2587 formed on the shoe element motion controlling member locking section 2586 of the shoe element motion controlling member 2580, wherein the series of shoe element motion controlling member locking engagement surfaces 2587 are designed and located to engage and disengage with a series of shoe element motion first guide member locking engagement surface 2567 formed on the shoe element motion first guide member slide portion 2564 of the shoe element motion first guide member 2560. A locking member passage 2576 passes through the shoe element motion second guide member slide portion 2574 facilitating contact between the shoe element motion first guide member locking engagement surface 2567 and the shoe element motion controlling member locking engagement surface 2587 to retain and release the position of the shoe element motion first guide member 2560 respective to the shoe element motion second guide member 2570. It is preferred, but not necessary, that the size and shape of the shoe element motion first guide member locking engagement surfaces 2567 and the size and shape of the shoe element motion controlling member locking engagement surfaces 2587 are similar to one another.

At least one shoe element motion first guide member movement restoring member 2569 can optionally be included in the easy on footwear 2500 to aid in returning and retaining the footwear upper 2510 into a wearing position. At least one shoe element motion first guide member movement restoring member 2569 has a first end secured to the shoe element motion first guide member 2560 and a second, opposite end secured to the footwear lower 2530. The shoe element motion first guide member movement restoring member 2569 is preferably fabricated of a material having elastic properties, such as a length of elastic. The shoe element motion first guide member movement restoring member 2569 can be any suitable element that creates a return force when placed in tension, such as elastic, a tensile spring, or any other suitable component.

Another retention system can be integrated into the easy on footwear 2500 to aid in retaining the footwear upper 2510 in a worn position respective to the footwear lower 2530. The exemplary retention system employs a plurality of footwear upper fastening element 2520 carried by the footwear upper body 2512 and a plurality of footwear lower fastening element 2540 carried by the footwear lower 2530 and the footwear lower body heel section 2534. The footwear upper fastening element 2520 and the footwear lower fastening element 2540 are preferably a magnetically attracting pair of elements. Alternatively, the footwear upper fastening element 2520 and the footwear lower fastening element 2540 can be a mechanically engaging pair of elements, such as a snap, a hoop and loop, a strap and hook, or any other suitable mechanically engaging interface.

Figure 32:
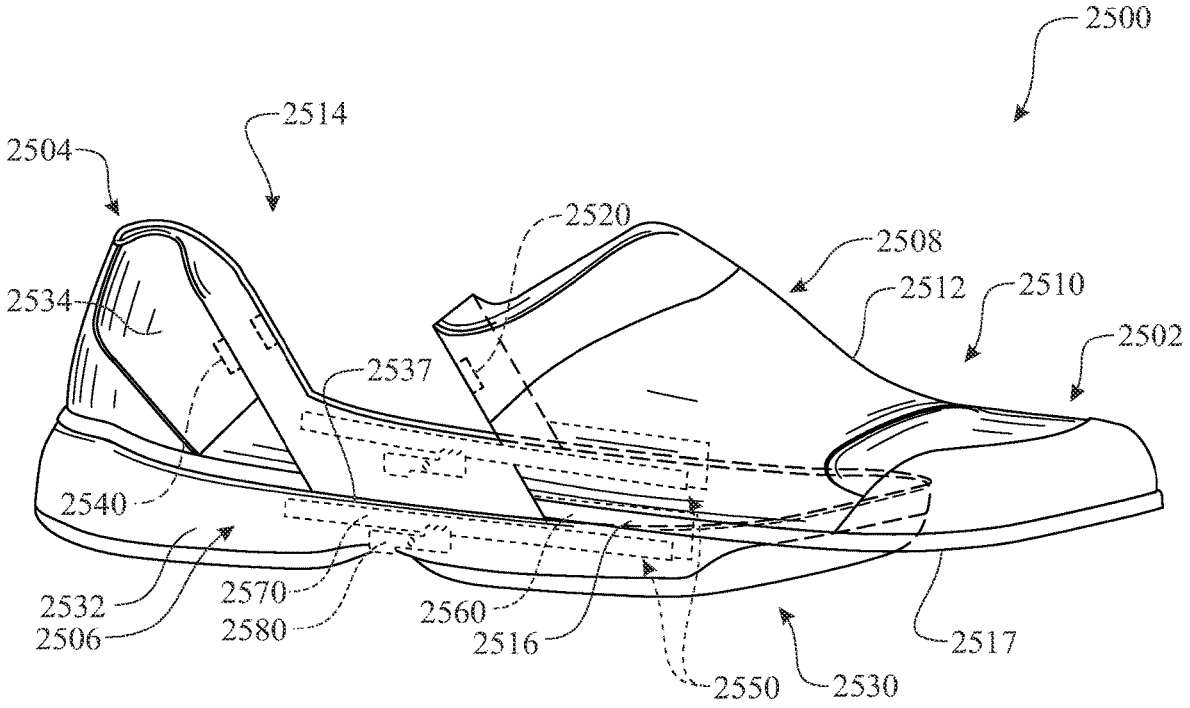
FIG. 32 presents a perspective side view of the exemplary easy on footwear originally introduced in FIG. 31, the easy on footwear being shown in a staged configuration having the upper slid forward enabling insertion of a person's foot into the footwear.
Figure 33:
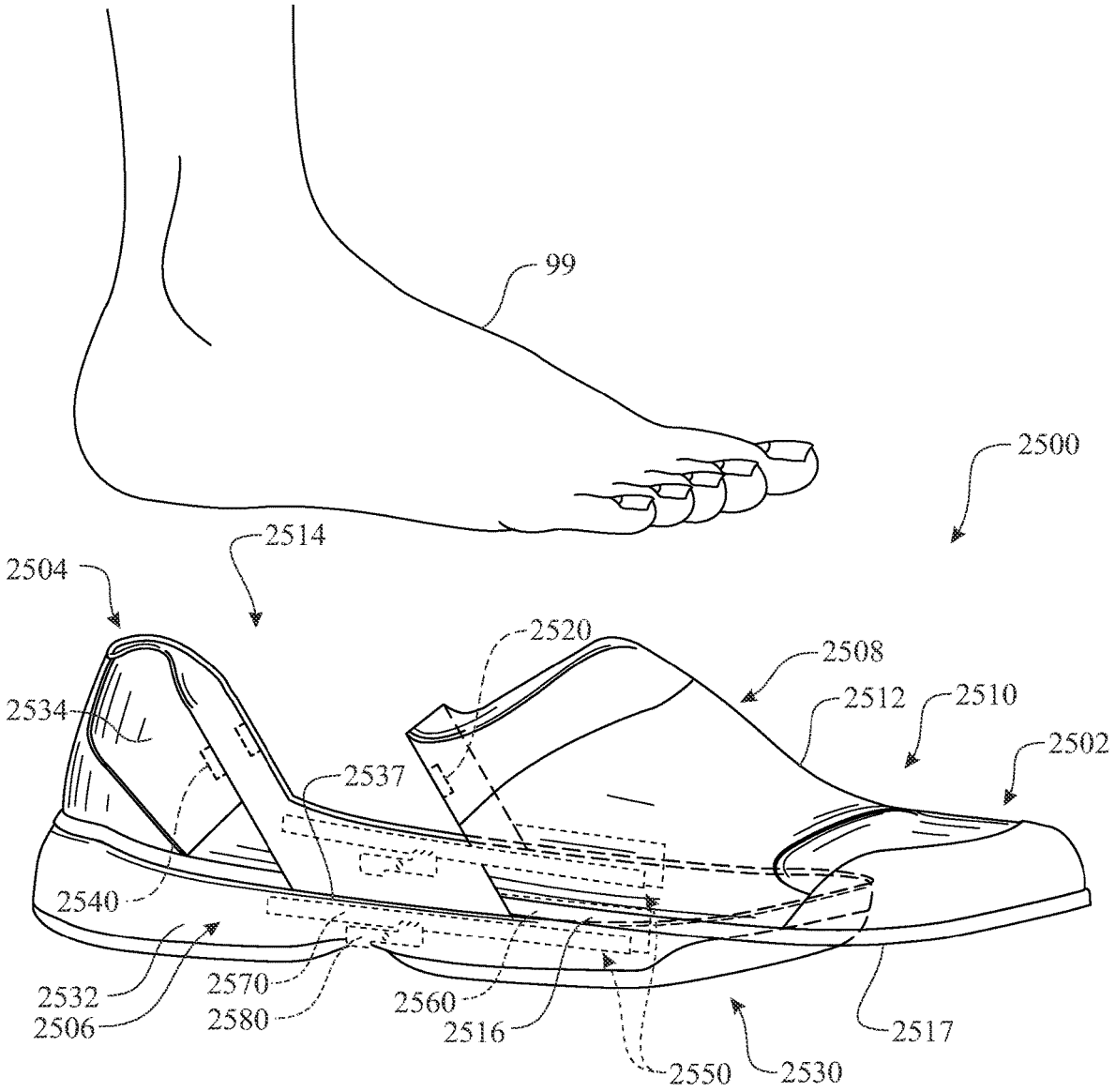
FIG. 33 presents a perspective side view of the exemplary easy on footwear originally introduced in FIG. 31, the illustration presenting a person's foot prior to insertion into the easy on footwear.
Figure 34:
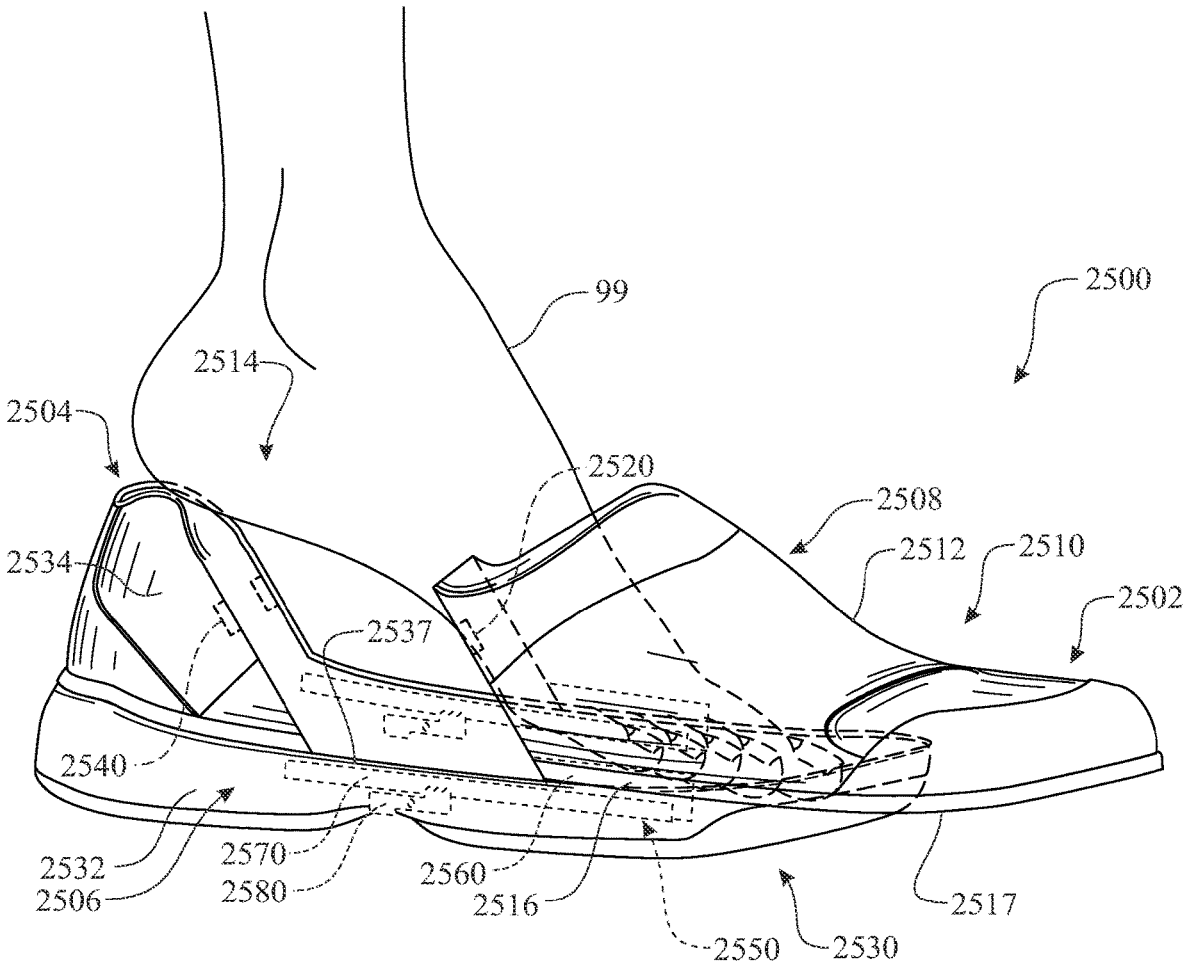
FIG. 34 presents a perspective side view of the exemplary easy on footwear originally introduced in FIG. 31, the illustration presenting a person's foot being partially inserted into the easy on footwear.
Figure 35:
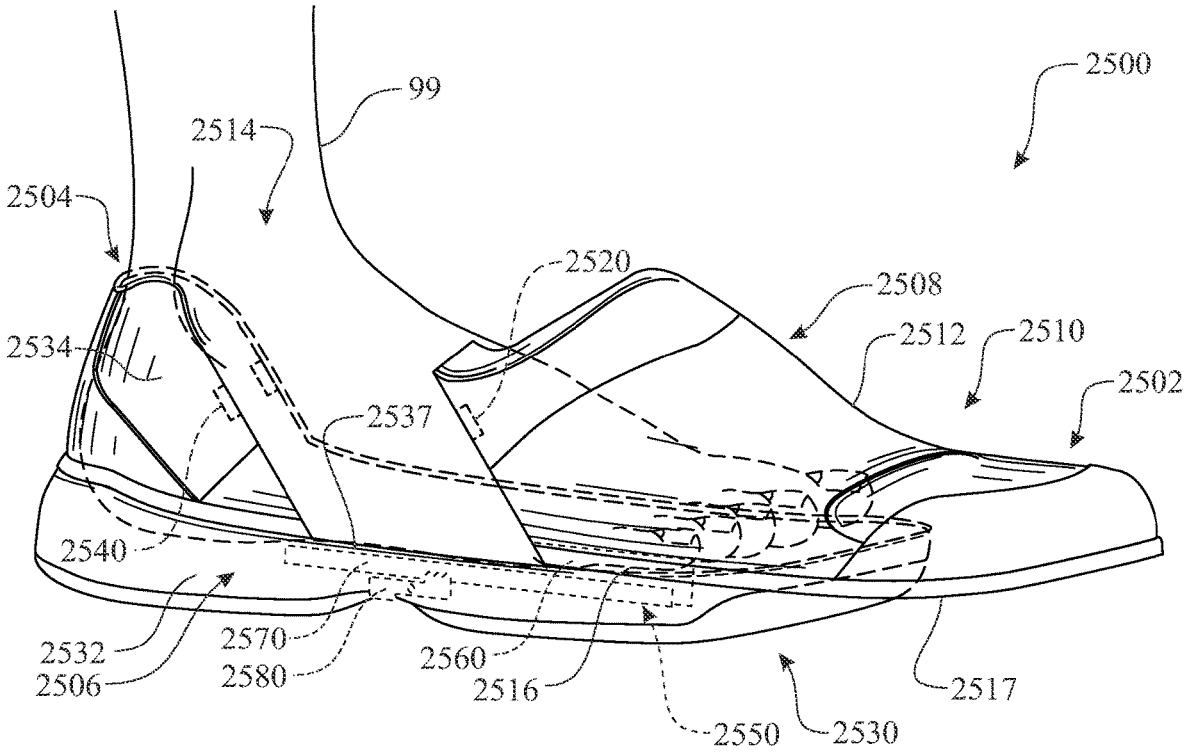
FIG. 35 presents a perspective side view of the exemplary easy on footwear originally introduced in FIG. 31, the illustration presenting a person's foot seated within the easy on footwear, the upper remaining in an insertion position.
Figure 36:
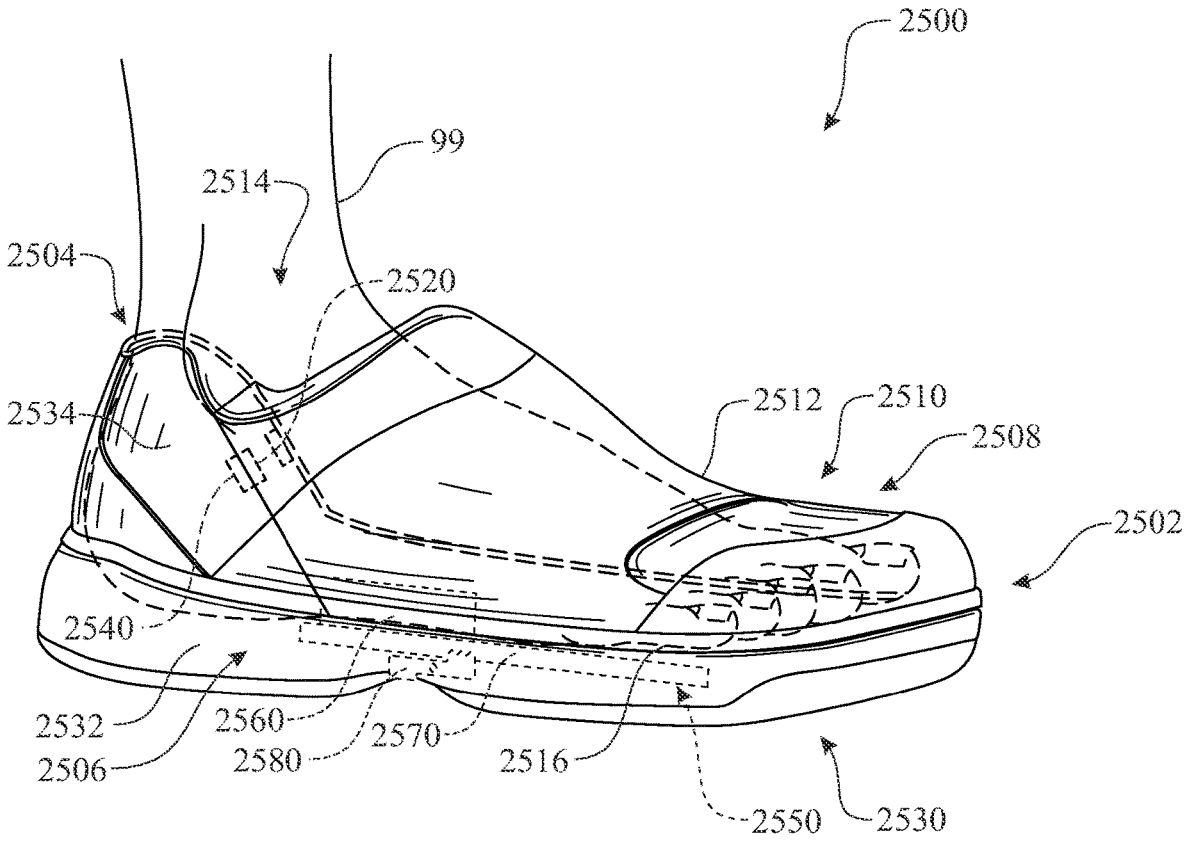
FIG. 36 presents a perspective side view of the exemplary easy on footwear originally introduced in FIG. 31, the illustration presenting a person's foot being shown seated within the easy on footwear and the footwear having the upper repositioned into a closed, in use condition.
Figure 37:
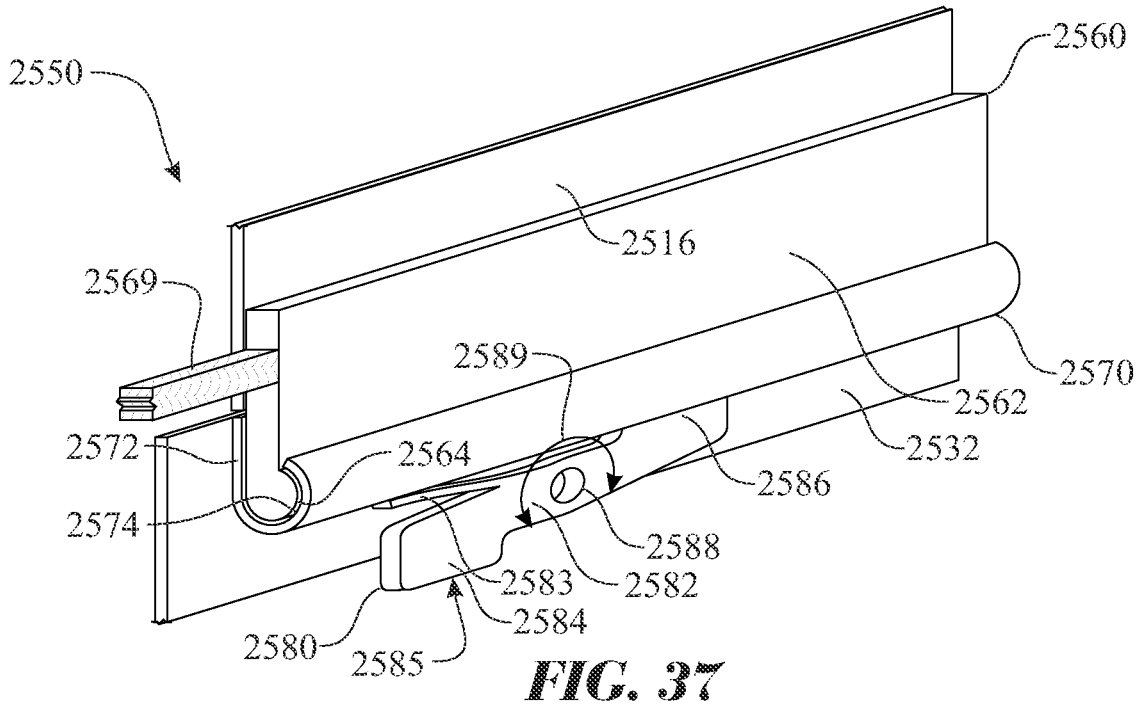
FIG. 37 presents an isometric side top view of a sliding mechanism integrated into the easy on footwear.
Figure 38:
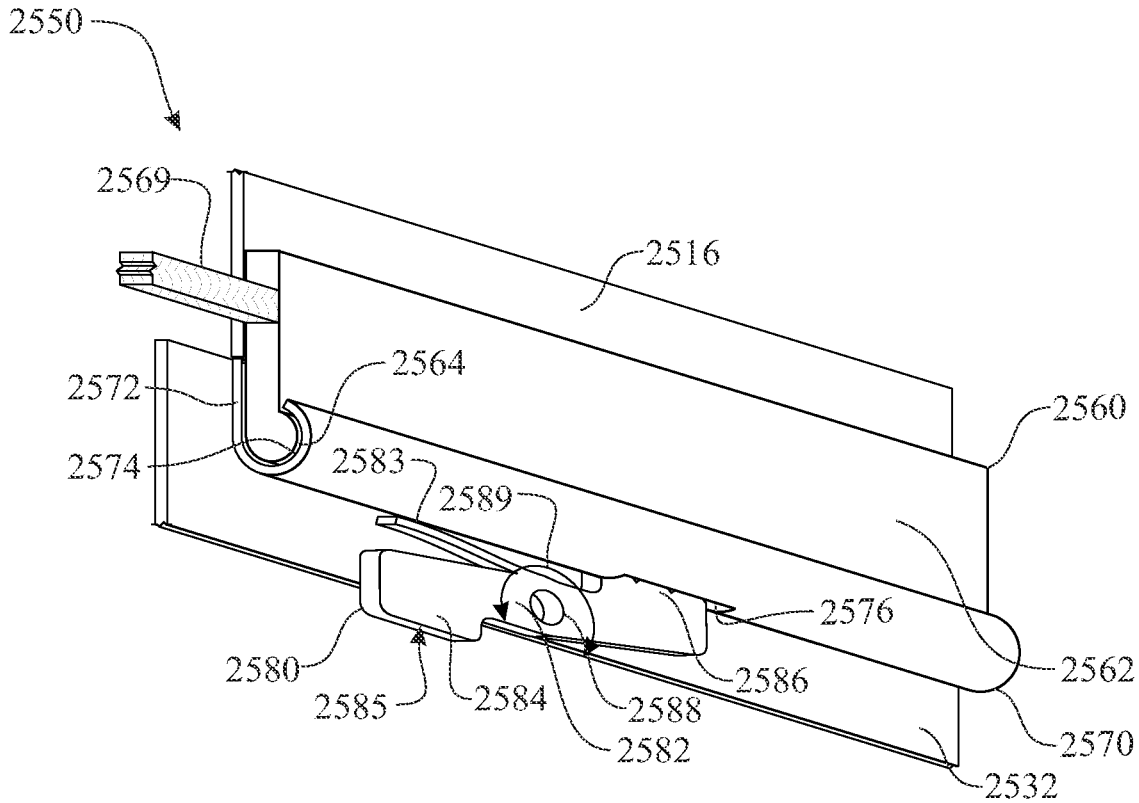
FIG. 38 presents an isometric side bottom view of the sliding mechanism originally introduced in FIG. 37.
Figure 39:
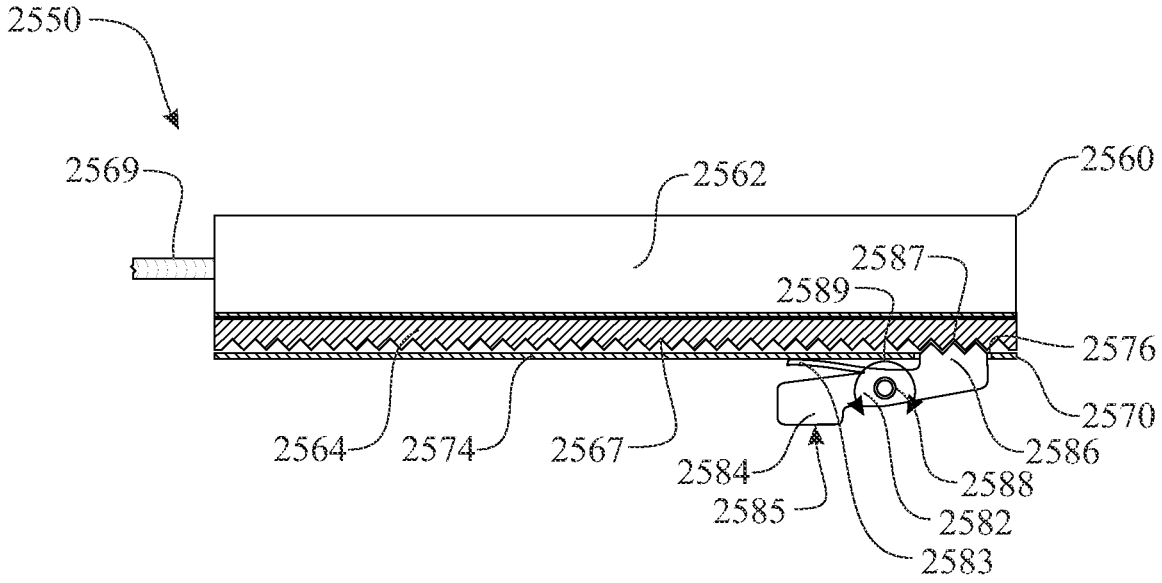
FIG. 39 presents a side section view of the sliding mechanism originally introduced in FIG. 37, the illustration presenting a locking member in a retracted and retaining configuration.
Figure 40:
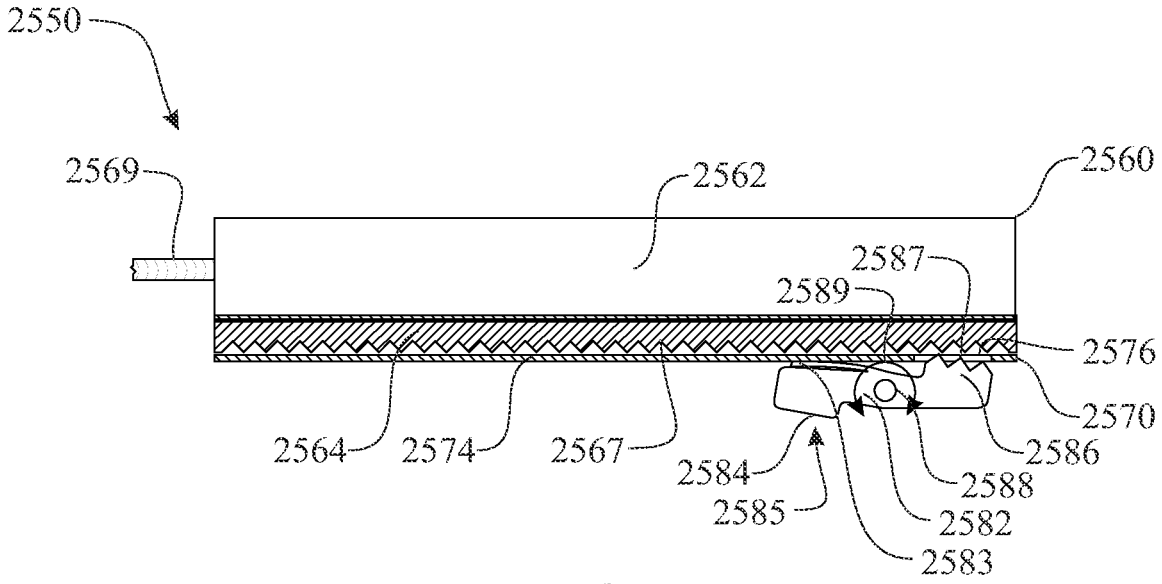
FIG. 40 presents a side section view of the sliding mechanism originally introduced in FIG. 37, the illustration presenting the locking member in a retracted and released configuration.
Figure 41:
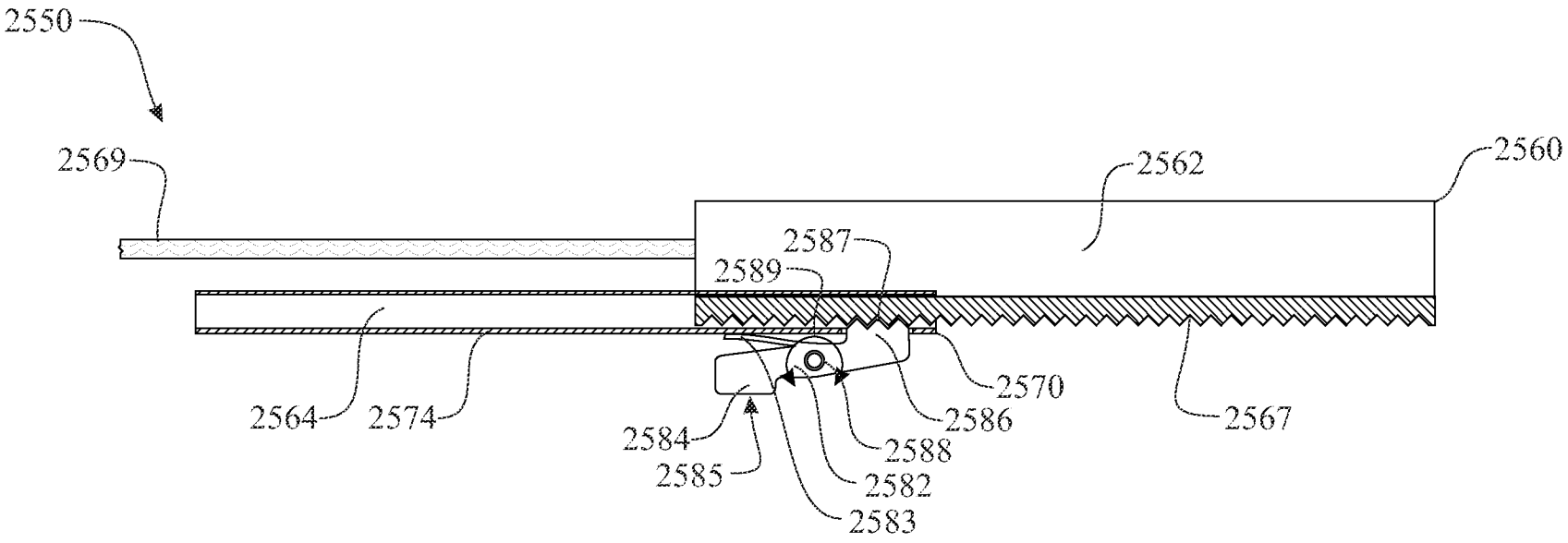
FIG. 41 presents a side section view of the sliding mechanism originally introduced in FIG. 37, the illustration presenting the locking member in an extended and retaining configuration.
Figure 42:
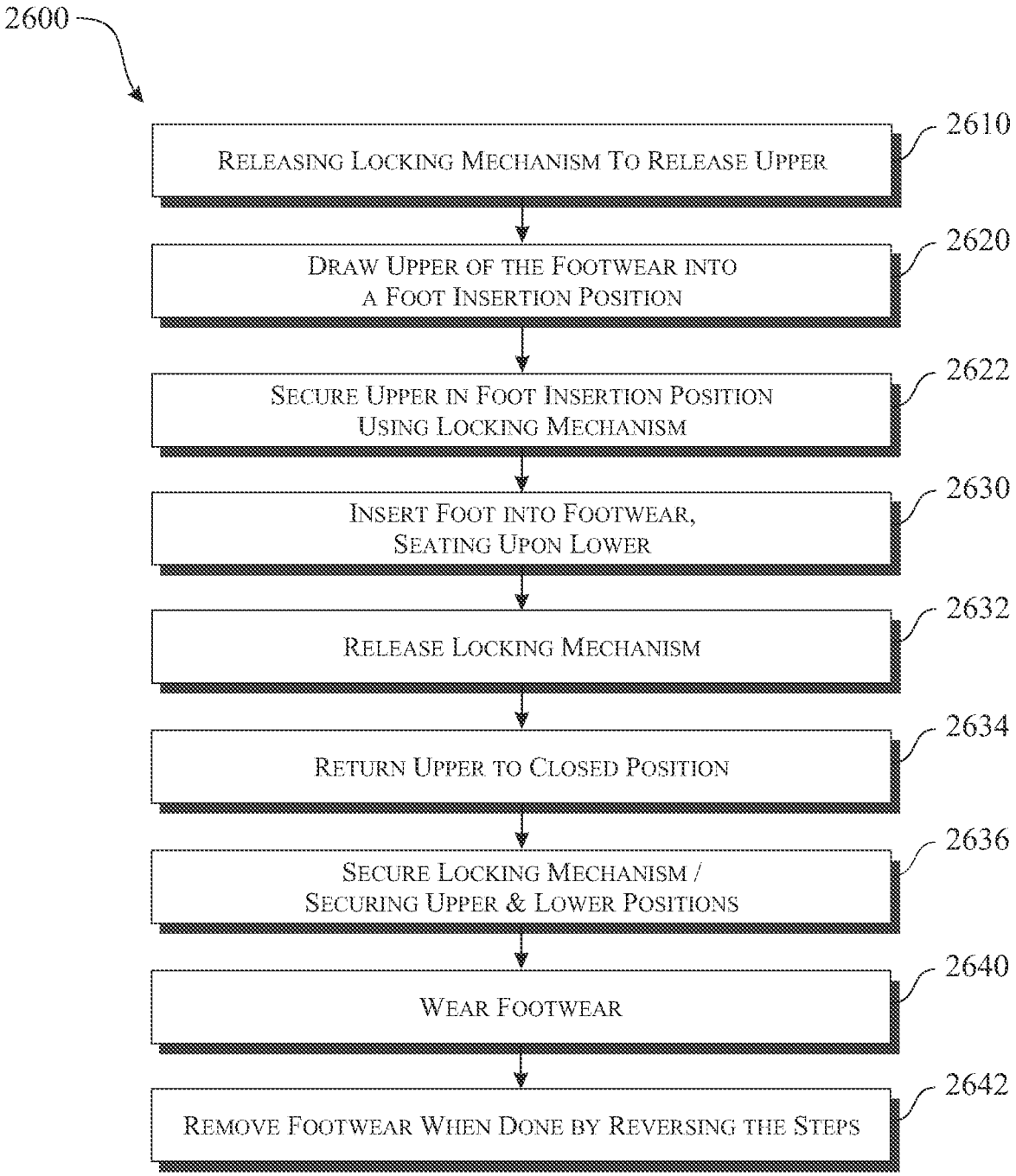
FIG. 42 presents an exemplary flow diagram describing steps of using the sliding mechanism.

Use of the easy on footwear 2500 is described in a footwear upper release and retention method of use flow diagram 2600 presented in FIG. 42. The footwear upper release and retention method of use flow diagram 2600 initiates when one desires to place the easy on footwear 2500 onto the person's foot 99 of a person. The sliding mechanism assembly 2550 is toggled into a release state to facilitate movement of the footwear upper 2510 (step 2610). Step 2610 is illustrated in FIG. 40 where a pressure is applied to the shoe element motion controlling member actuator contact surface 2585 of the shoe element motion controlling member actuator section 2584, causing the shoe element motion controlling member 2580 to pivot 2589, disengaging the shoe element motion controlling member locking engagement surface 2587 from the shoe element motion first guide member locking engagement surface 2567. Once the shoe element motion controlling member locking engagement surface 2587 and the shoe element motion first guide member locking engagement surface 2567 disengage, the shoe element motion first guide member 2560 is free to move. The footwear upper 2510 would be pulled forward, opening the footwear upper foot passageway 2514, placing the easy on footwear 2500 into a foot insertion configuration, as illustrated in FIG. 33 (step 2620). Once the easy on footwear 2500 is pulled into the foot insertion configuration, the shoe element motion controlling member 2580 is released, allowing the shoe element motion controlling member locking engagement surface 2587 and the shoe element motion first guide member locking engagement surface 2567 to reengage with one another, as illustrated in FIGS. 32 and 41 (step 2622). Once the easy on footwear 2500 is in the foot insertion configuration, the person's foot 99 is inserted into the easy on footwear 2500, as illustrated in FIGS. 33 through 35 (step 2630). Upon seating the person's foot 99 against the inner sole of the footwear lower 2530 (as illustrated in FIG. 35), the shoe element motion controlling member 2580 is actuated to separate the shoe element motion controlling member locking engagement surface 2587 and the shoe element motion first guide member locking engagement surface 2567 from one another, releasing the footwear upper 2510 (step 2634). When the shoe element motion controlling member 2580 removes the retention force from the sliding mechanism assembly 2550, the shoe element motion first guide member movement restoring member 2569 (or a force applied by a person) returns the footwear upper 2510 to the worn configuration, as illustrated in FIG. 36 (step 2634). The footwear upper 2510 and the footwear lower 2530 can be secured in the worn configuration by engaging each footwear upper fastening element 2520 with each respective footwear lower fastening element 2540 (step 2636). The combination of the engagement between the footwear upper fastening elements 2520 and the footwear lower fastening elements 2540 and the engagement of the shoe element motion controlling member locking engagement surface 2587 and the shoe element motion first guide member locking engagement surface 2567 from a step of releasing the shoe element motion controlling member 2580 (step 2636) retains the easy on footwear 2500 on the person's foot 99 while being worn by the user (step 2640). When the user is done wearing the easy on footwear 2500, the easy on footwear 2500 is removed from the person's foot 99 by reversing the steps described herein.

Footwear has been accessorized over the years. For example, the easy on footwear 1200 introduces footwear that includes a series of lighted elements. Another common accessory is wheels. Shoes having integrated, retractable wheels such as an example described in U.S. Pat. No. 6,450,509 (incorporated herein by reference) offered by companies such as a HEELYS, another example includes SPEEDS offered by ROLLERKICK, powered retractable wheels such as an example described in U.S. Pat. No. 7,900,731 (incorporated herein by reference), with another example described in US 2020/0129844 A1 and US 2022/0118345 A1 (both being incorporated herein by reference) being offered as a presale under the trade name MOONWALKERS by SHIFT ROBOTICS. A portion of the wheeled footwear incorporate enclosed uppers, requiring placement in accordance with known processes (and the associated limitations) for placing footwear onto a person's foot. Another portion of the wheeled footwear is designed to be placed over worn footwear, such as sneakers; again, requiring placement of the supporting footwear onto the person's foot in accordance with known processes (and the associated limitations).

The present invention introduces integrated of fixed wheels, retractable wheels, powered wheels and powered retractable wheels into two-piece easy on footwear (such as the easy on footwear 100, the easy on footwear 800, the easy on footwear 1200, and the easy on footwear 2500) that improves a process for placement of the footwear onto a person's foot 99, particularly when being placed upon feet of young children, handicapped persons, disabled persons, elderly persons, and other persons with limitations.

Figure 43:
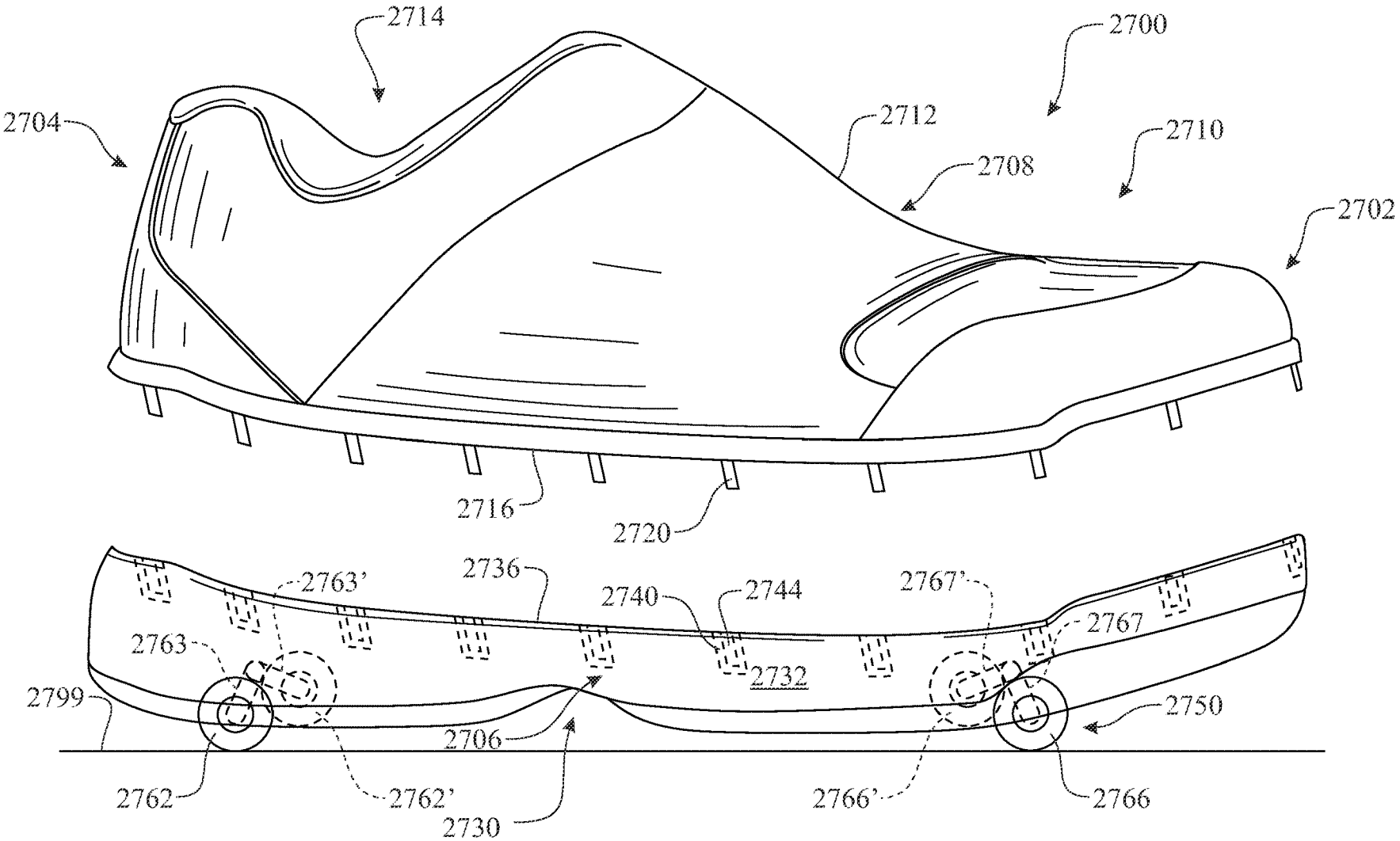
FIG. 43 presents a perspective side elevation exploded assembly view of another exemplary easy on footwear, the illustrated footwear introducing a first exemplary wheeled sole.

A easy on footwear 2700, introduced in FIG. 43, presents an easy on footwear 100 having a set of wheels 2762, 2766 integrated into a footwear lower 2730. The easy on footwear 2700 and the easy on footwear 100 include a number of like elements. Like elements of the easy on footwear 2700 and the easy on footwear 100 are numbered the same wherein elements of the easy on footwear 2700 are preceded by the numeral "27". The easy on footwear 2700 would be placed upon the person's foot 99 using the same process as described above in FIGS. 2 and 3. The use of this arrangement significantly eases a process of placing the easy on footwear 2700 onto the person's foot 99, particularly when placing the easy on footwear 2700 onto the foot 99 of a child. The easy on footwear 2700 also provide another advantage. The easy on footwear 2700 offers a user an option to exchange the footwear lower 2730 with a footwear lower 130, converting the easy on footwear 2700 into the easy on footwear 100 and vice versa, converting the easy on footwear 100 into the easy on footwear 2700 by using the footwear lower 2730 in conjunction with the footwear upper 110. Another advantage allows the user to exchange a footwear upper 2710 of one design, material, etc. with a footwear upper 2710 of a different design, material, etc. This allows for use of easy on footwear 2700 having different appearances without the costs of associated with a mobility system 2750. A retailer can offer a variety of footwear uppers 2710 to the consumer, providing flexibility for different appearances. When worn down, the consumer can replace worn wheels 2762, 2766, worn bearings (not shown) or replace the entire footwear lower 2730. In another scenario, the consumer can upgrade (or downgrade) the footwear lower 2730 as desired. Examples of different configurations are described below.

The exemplary easy on footwear 2700 includes a mobility system 2750. The mobility system 2750 can be any suitable arrangement comprising at least one wheel 2762, 2766 as described below.

In a first example, the easy on footwear 2700 includes a series of retractable wheels 2762, 2766. The exemplary easy on footwear 2700 (as illustrated) includes a pair of retractable rear wheels 2762 and a pair of retractable front wheels 2766. The pair of rear wheels 2762 can be rotationally supported by a single rear wheel strut 2763, wherein each of the rear wheels 2762 would be located on a respective side of the rear wheel strut 2763. Alternatively, each rear wheel 2762 can be rotationally supported by a respective rear wheel strut 2763. Each rear wheel 2762, 2767 would pivot about a pivot member (not illustrated) located proximate an upper end of the rear wheel 2762, 2767.

The wheels 2762, 2766 are illustrated in an extended position (solid line) and a retracted position 2762', 2766' (broken line). The wheels 2762, 2766 toggle between an extended position (wheels 2762, 2766) and a retracted position (wheels 2762', 2766') by rotating a respective strut 2763, 2767 between an extended position (strut 2763, 2767) and a retracted position (strut 2763', 2767'). The rotation is one configuration that toggles the wheels (2762, 2766) between an extended position (wheels 2762, 2766) and a retracted position (wheels 2762', 2766'). In an alternative arrangement, the wheels can toggle between an extended position (wheels 2762, 2766) and a retracted position (wheels 2762', 2766') in a linear motion, such as the retracting mechanism taught in U.S. Pat. No. 6,450,509 B2 (incorporated herein by reference). When the wheels 2762', 2766' are retracted, the wheels 2762', 2766' would be positioned above a contacting surface of the footwear lower 2730. When the wheels 2762, 2766 are extended, a bottom quadrant of the wheels 2762, 2766 would be positioned below the contacting surface of the footwear lower 2730.

A retention member (not shown) can retain the rear wheel 2762, 2767 in either a retracted position or an extended position. The retracting mechanism can be any suitable retracting mechanism. One example is presented in U.S. Pat. No. 7,900,731 (incorporated herein by reference). Another retracting mechanism can utilize a spring and biasing ball system, such as the retractable assembly presented in U.S. Pat. No. 6,450,509 (incorporated herein by reference). Any suitable retracting mechanism can be integrated into the easy on footwear 2700.

In another alternative arrangement, the easy on footwear 2700 can include a single, preferably wide, 2762 and a single, preferably wide, 2766. In one design, each of the rear wheels 2762, 2766 can be approximately one-half of the width of the footwear lower 2730. In a second design, each of the rear wheels 2762, 2766 can be greater than one-half of the width of the footwear lower 2730.

The pair of front wheels 2766 would be assembled to the footwear lower 2730 in a manner similar to the assembly of the pair of rear wheels 2762 to the footwear lower 2730 using the rear wheel strut 2763.

In another alternative arrangement, the easy on footwear 2700 can include a single, preferably wide, rear wheel 2762, as taught in U.S. Pat. No. 6,450,509 (incorporated herein by reference). In one design, the rear wheel 2762 can be approximately one-half of the width of the footwear lower 2730. In a second design, the rear wheel 2762 can be greater than one-half of the width of the footwear lower 2730. The same arrangement can be modified to include a narrower pair of rear wheel 2762, both being located at the heel end 2704 of the footwear lower 2730. Using either arrangement, the user would raise the toe end 2702 of the easy on footwear 2700, balancing on the single rear wheel 2762 of each foot in order to use the wheel 2762 as a roller and lean slightly forward placing the toe end 2702 onto a ground surface 2799. When the toe end 2702 is placed upon the ground surface 2799, the person wearing the easy on footwear 2700 can use the easy on footwear 2700 as normal shoes.

Although the easy on footwear 2700 employs an upper 2710 to lower 2730 assembly interface comprising a plurality of footwear upper fastening elements 2720 that engage with mating series of footwear lower fastening element magnet receiving cavities 2744 of a footwear lower fastening element 2740, any assembly interface, including those described herein, can be used to join the footwear upper 2710 and the footwear lower 2730 to one another.

Figure 44:
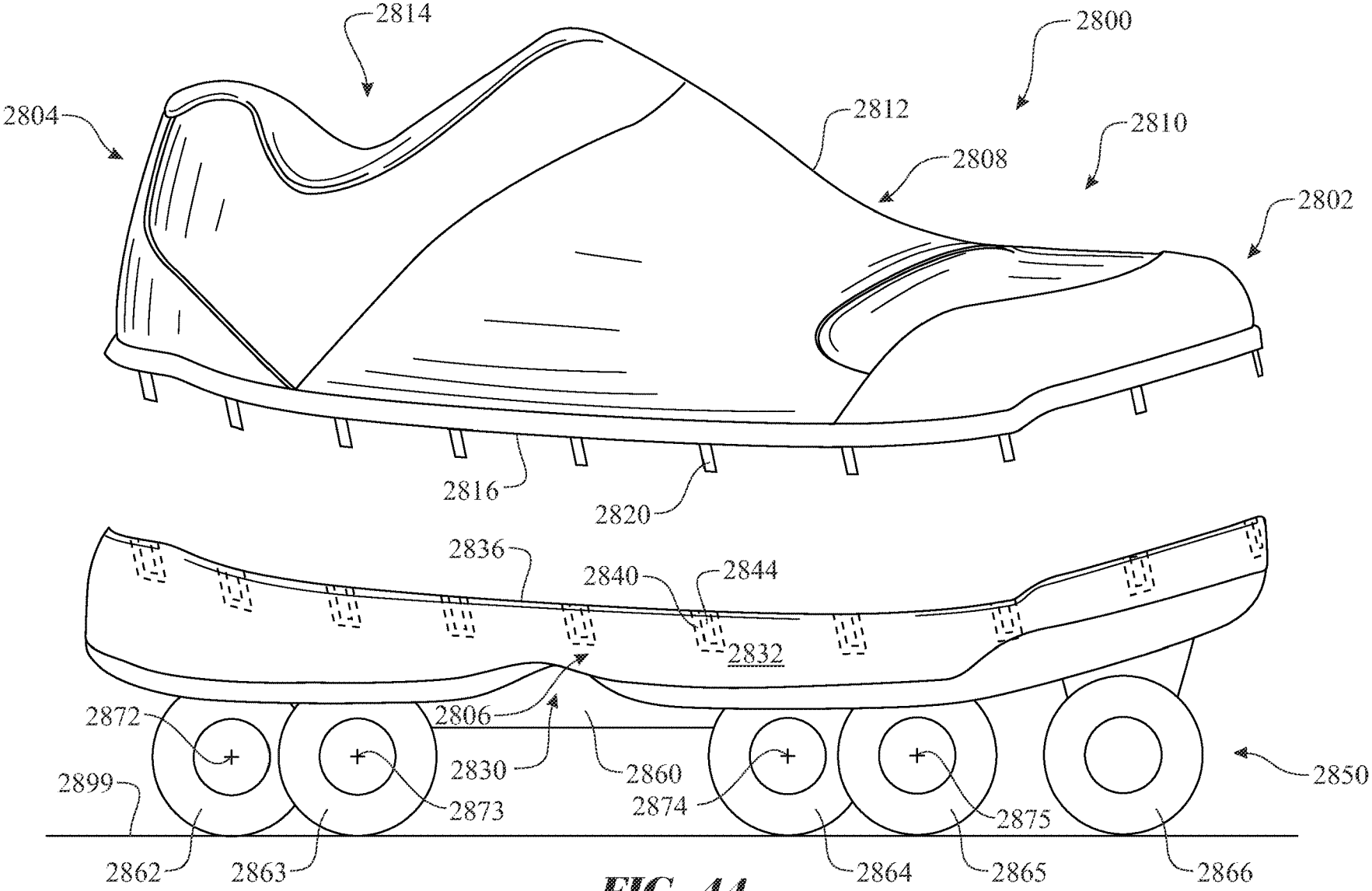
FIG. 44 presents a perspective side elevation exploded assembly view of another exemplary easy on footwear, the illustrated footwear introducing a second exemplary wheeled sole.

An easy on footwear 2800, introduced in FIG. 44, is a variant of the easy on footwear 2700. The easy on footwear 2800 and the easy on footwear 2700 include a number of like elements. Like elements of the easy on footwear 2800 and the easy on footwear 2700 are numbered the same wherein elements of the easy on footwear 2800 are preceded by the numeral "28". The key distinctions of the easy on footwear 2800 are that the easy on footwear 2800 employs a mobility assistance system controller 2860 for driving a rotational motion of at least one of the wheels 2862, 2863, 2864, 2865 of a mobility assistance system 2850. Additionally, the arrangement of the wheels 2862, 2863, 2864, 2865 aids in travel over a ground surface 2899 having a rougher terrain. The mobility assistance system controller 2860 would include at least one motor, preferably a torque converter to convert a torque output from the at least one motor to a drive to at least one wheel 2862, 2863, 2864, 2865, a portable power source, and any supporting control circuitry. Details of one exemplary mobility assistance system controller 2860 are described in US 2022/0118345 A1 (incorporated herein by reference).

The wheels 2862, 2863, 2864, 2865 are located in an overlapping arrangement. In the exemplary illustration, a pair of rear inner wheels 2862 is located rearmost of the set of wheels 2862, 2863, 2864, 2865. A pair of rear outer wheels 2863 are located adjacent to and overlapping with the pair of rear inner wheels 2862. The pair of rear inner wheels 2862 rotates about a first rearward wheel rotational axis 2872. The pair of rear outer wheels 2863 rotates about a second rearward wheel rotational axis 2873. A distance between the first rearward wheel rotational axis 2872 and the second rearward wheel rotational axis 2873 is less than a diameter of either of the wheels 2862, 2863.

Additionally, in the exemplary illustration, a pair of forward outer wheel 2865 are located foremost of the set of wheels 2862, 2863, 2864, 2865. A pair of forward inner wheels 2864 is located adjacent to and overlapping with the pair of forward outer wheel 2865. The pair of forward inner wheels 2864 rotates about a first forward wheel rotational axis 2874. The pair of forward outer wheel 2865 rotates about a second forward wheel rotational axis 2875. A distance between the first forward wheel rotational axis 2874 and the second forward wheel rotational axis 2875 is less than a diameter of either of the wheels 2864, 2865.

The overlap between the rear inner wheel 2862 and the rear outer wheel 2863 and similarly the overlap between the forward inner wheel 2864 and the forward outer wheel 2865 provides a reduced distance between ground contacting points, thus limiting the distance in which each wheel 2862,

2863, 2864, 2865 can drop into a crevice within the ground surface 2899. The exemplary illustration presents the easy on footwear 2800 having two pair of overlapping wheels 2862, 2863; 2864, 2865 on each side of the easy on footwear 2800. The easy on footwear 2800 can have more wheels positioned in an overlapping arrangement, thus providing more opportunities for wheels to create a span over any low points in the ground surface 2899.

Other benefits of an easy on footwear 2800 comprising a footwear upper 2810 and a separate footwear lower 2830 are the same as those of the easy on footwear 2700 described above.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

ELEMENT DESCRIPTIONS

Ref. No. Description

99 person's foot
100 easy on footwear
102 footwear toe
104 footwear heel
106 footwear lateral side
108 footwear medial side
110 footwear upper
112 footwear upper body
114 footwear upper foot passageway
116 footwear upper attachment edge
120 footwear upper fastening element
129 upper and lower hinge assembly
130 footwear lower
132 footwear lower body
136 footwear lower attachment edge
140 footwear lower fastening element
142 footwear lower fastening element frame
144 footwear lower fastening element magnet receiving cavity
216 footwear upper attachment edge
220 footwear upper fastening element
222 footwear upper fastening element locking pin tether
226 footwear upper fastening element locking pin
227 footwear upper fastening element locking aperture
236 footwear lower attachment edge
240 footwear lower fastening element
244 footwear lower fastening element receiving cavity
246 footwear lower fastening element outer locking aperture
247 footwear lower fastening element inner locking aperture
316 footwear upper attachment edge
320 footwear upper fastening element
327 footwear upper fastening element locking ridge
336 footwear lower attachment edge
340 footwear lower fastening element
342 footwear lower fastening element frame
344 footwear lower fastening element receiving cavity
345 footwear lower fastening element locking feature cantilever
346 footwear lower fastening element locking feature
416 footwear upper attachment edge
420 footwear upper fastening element
422 footwear upper fastening element base segment
424 footwear upper fastening element return tongue segment
426 footwear upper fastening element lower tongue receiving clearance
436 footwear lower attachment edge
440 footwear lower attachment edge fastening feature access vertical edge
442 footwear lower attachment edge fastening feature access horizontal edge
444 footwear lower fastening element return tongue receptacle
446 footwear lower fastening element tongue segment
448 footwear lower attachment edge fastening feature attachment element clearance
516 footwear upper attachment edge
520 footwear upper fastening element
522 footwear upper fastening element base segment
524 footwear upper fastening element return tongue segment
526 footwear upper fastening element lower tongue receiving clearance
536 footwear lower attachment edge
533 footwear lower attachment edge fastening feature access bottom retention flange
544 footwear lower fastening element return tongue receptacle
546 footwear lower fastening element tongue segment
616 footwear upper attachment edge
620 footwear upper fastening element
622 footwear upper fastening element outer segment
623 footwear upper fastening element base bend assist notch
624 footwear upper fastening element base segment
626 footwear upper fastening element lower tongue receiving clearance
625 footwear upper fastening element return tongue segment
640 footwear lower fastening element
644 footwear lower fastening element return tongue receptacle
646 footwear lower fastening element tongue segment
716 footwear upper attachment edge
720 footwear upper fastening element
736 footwear lower attachment edge
740 footwear lower fastening element
750 twist and lock fastener
752 twist and lock fastener operation handle
754 twist and lock fastener operation body
756 twist and lock fastener flange
758 twist and lock fastener lock extension
759 twist and lock fastener lock
800 easy on footwear
802 footwear toe
804 footwear heel
806 footwear lateral side
808 footwear medial side
810 footwear upper
812 footwear upper body
814 footwear upper foot passageway
816 footwear upper attachment edge
820 footwear upper fastening element
822 footwear upper fastening element snap head
824 footwear upper fastening element snap base

826 footwear upper fastening element snap receiving surface
829 upper and lower hinge assembly
830 footwear lower
832 footwear lower body
836 footwear lower attachment edge
840 footwear lower fastening element
846 footwear upper fastening element snap surface
916 footwear upper attachment edge
920 footwear upper fastening element
926 footwear upper fastening element stud
936 footwear lower attachment edge
940 footwear lower fastening element
946 footwear upper fastening element stud receiving bore
1016 footwear upper attachment edge
1020 footwear upper fastening element
1026 footwear upper fastening element retention pin
1036 footwear lower attachment edge
1040 footwear lower fastening element
1042 footwear lower fastening element body
1046 footwear upper fastening element retention pin receiving aperture
1100 easy on footwear method of use flow diagram
1110 place footwear upper onto person's foot step
1112 position assembly edge of footwear lower against assembly edge of footwear upper step
1114 secure assembly edge of footwear lower and assembly edge of footwear upper to one another step
1120 wear the footwear step
1130 disconnect the assembly edge of footwear lower and assembly edge of footwear upper from one another step
1132 separate assembly edge of footwear lower and assembly edge of footwear upper from one another step
1140 remove footwear lower from person's foot step
1142 remove footwear upper from person's foot step
1200 easy on footwear
1202 footwear toe
1204 footwear heel
1206 footwear lateral side
1208 footwear medial side
1210 footwear upper
1212 footwear upper body
1214 footwear upper foot passageway
1216 footwear upper attachment edge
1220 footwear upper fastening element
1230 footwear lower
1232 footwear lower body
1234 footwear lower body heel section
1236 footwear lower attachment edge
1240 footwear lower fastening element
1242 footwear lower fastening element frame
1244 footwear lower fastening element magnet receiving cavity
1250 light emitting system
1252 portable power source (battery)
1254 motion activated switch
1256 lower located light emitting element
1257 lower located wiring portion
1258 upper located light emitting element
1259 upper located wiring portion
1300 easy on footwear method of use flow diagram
1310 place footwear lower onto person's foot step
1312 position assembly edge of footwear upper against assembly edge of footwear lower step
1314 secure assembly edge of footwear upper and assembly edge of footwear lower to one another step
1320 wear the footwear step
1330 disconnect the assembly edge of footwear upper and assembly edge of footwear lower from one another step
1332 separate assembly edge of footwear upper and assembly edge of footwear lower from one another step
1340 remove footwear upper from person's foot step
1342 remove footwear lower from person's foot step
2000 footwear
2002 footwear toe
2004 footwear heel
2006 footwear lateral side
2008 footwear medial side
2010 footwear upper
2012 footwear upper body
2014 footwear upper foot passageway
2019 footwear shoelaces
2030 footwear lower
2032 footwear lower body
2040 footwear heel securing and release system
2050 footwear heel securing and release member
2052 footwear heel securing and release contact panel
2054 footwear heel securing and release support panel
2056 footwear heel securing and release support member interior volume
2060 footwear heel securing and release control member subassembly
2062 footwear heel securing and release control member grip
2064 footwear heel securing and release control member shaft
2066 footwear heel securing and release control member attachment
2100 footwear
2102 footwear toe
2104 footwear heel
2106 footwear lateral side
2108 footwear medial side
2110 footwear upper
2112 footwear upper body
2114 footwear upper foot passageway
2119 footwear shoelaces
2130 footwear lower
2132 footwear lower body
2140 footwear heel securing and release system
2150 footwear heel securing and release member
2152 footwear heel securing and release member retraction mesh
2154 footwear heel securing and release member support surface
2156 footwear heel securing and release member body
2160 footwear heel securing and release control member subassembly
2162 footwear heel securing and release control member grip
2164 footwear heel securing and release control member shaft
2166 footwear heel securing and release control member attachment
2200 footwear
2202 footwear toe
2204 footwear heel
2206 footwear lateral side
2208 footwear medial side
2210 footwear upper
2212 footwear upper body
2214 footwear upper foot passageway
2219 footwear shoelaces
2230 footwear lower

2232 footwear lower body
2240 footwear heel securing and release system
2250 footwear heel securing and release member
2252 footwear heel securing and release panel
2254 footwear heel securing and release panel support member
2255 footwear heel securing and release panel lower support member
2260 footwear heel securing and release control member subassembly
2262 footwear heel securing and release control member grip
2264 footwear heel securing and release control member shaft
2268 footwear heel securing and release control biasing element
2300 footwear
2302 footwear toe
2304 footwear heel
2306 footwear lateral side
2308 footwear medial side
2310 footwear upper
2312 footwear upper body
2314 footwear upper foot passageway
2319 footwear shoelaces
2330 footwear lower
2332 footwear lower body
2340 footwear heel securing and release system
2350 footwear heel securing and release member
2352 footwear heel securing and release panel
2356 footwear heel securing and release panel lower support member
2360 footwear heel securing and release control member
2362 footwear heel securing and release control member grip
2400 footwear heel insert retention and release method of use flow diagram
2410 apply retraction force to heel insert retention and release member step
2420 place footwear onto person's foot step
2430 remove retraction force from heel insert retention and release member step
2432 heel insert returns to relaxed state step
2440 wear footwear step
2450 apply retraction force to heel insert retention and release member step
2460 remove footwear lower from person's foot step
2470 remove retraction force from heel insert retention and release member step
2472 heel insert returns to relaxed state step
2500 easy on footwear
2502 footwear toe
2504 footwear heel
2506 footwear lateral side
2508 footwear medial side
2510 footwear upper
2512 footwear upper body
2514 footwear upper foot passageway
2516 footwear upper attachment edge
2517 footwear upper bottom mating edge
2520 footwear upper fastening element
2530 footwear lower
2532 footwear lower body
2534 footwear lower body heel section
2537 footwear lower top mating edge
2540 footwear lower fastening element
2550 sliding mechanism assembly
2560 shoe element motion first guide member
2562 shoe element motion first guide member attachment portion
2564 shoe element motion first guide member slide portion
2567 shoe element motion first guide member locking engagement surface
2569 shoe element motion first guide member position restoring member
2570 shoe element motion second guide member
2572 shoe element motion second guide member attachment portion
2574 shoe element motion second guide member slide portion
2576 locking member passage
2580 shoe element motion controlling member
2582 shoe element motion controlling member pivot arm
2583 shoe element motion controlling member bias element
2584 shoe element motion controlling member actuator section
2585 shoe element motion controlling member actuator contact surface
2586 shoe element motion controlling member locking section
2587 shoe element motion controlling member locking engagement surface
2588 shoe element motion controlling member pivoting aperture
2589 shoe element motion controlling member pivoting motion
2600 footwear upper release and retention method of use flow diagram
2610 release locking mechanism to release upper step
2620 draw upper forward into foot insertion position step
2622 secure upper in foot insertion position using locking mechanism step
2630 insert foot into footwear, seating foot against lower step
2632 release locking mechanism to release upper step
2634 return upper to closed position step
2636 secure locking mechanism, securing upper and lower in wear position step
2640 wear footwear step
2642 remove footwear from person's foot step
2700 easy on footwear
2702 footwear toe
2704 footwear heel
2706 footwear lateral side
2708 footwear medial side
2710 footwear upper
2712 footwear upper body
2714 footwear upper foot passageway
2716 footwear upper attachment edge
2720 footwear upper fastening element
2730 footwear lower
2732 footwear lower body
2736 footwear lower attachment edge
2740 footwear lower fastening element
2742 footwear lower fastening element frame
2744 footwear lower fastening element magnet receiving cavity
2750 mobility assistance system
2762 rear wheel (extended)
2762' rear wheel (retracted)
2763 rear wheel strut (extended)
2763' rear wheel strut (retracted)

2766 front wheel (extended)
2766' front wheel (retracted)
2767 front wheel strut (extended)
2767' front wheel strut (retracted)
2799 ground surface
2800 easy on footwear
2802 footwear toe
2804 footwear heel
2806 footwear lateral side
2808 footwear medial side
2810 footwear upper
2812 footwear upper body
2814 footwear upper foot passageway
2816 footwear upper attachment edge
2820 footwear upper fastening element
2830 footwear lower
2832 footwear lower body
2836 footwear lower attachment edge
2840 footwear lower fastening element
2842 footwear lower fastening element frame
2844 footwear lower fastening element magnet receiving cavity
2850 mobility assistance system
2860 mobility assistance system controller
2862 rear inner wheel
2863 rear outer wheel
2864 forward inner wheel
2865 forward outer wheel
2866 front wheel
2872 first rearward wheel rotational axis
2873 second rearward wheel rotational axis
2874 first forward wheel rotational axis
2875 second forward wheel rotational axis
2899 ground surface

What is claimed is:

1. A method for placing footwear onto a person's foot, the method comprising steps of:

(a) inserting the person's foot through a foot passageway of an upper of the footwear, the footwear comprising:

an upper having an enclosed circumference defining a foot passageway, an attachment edge along a lower edge of the upper, the attachment edge of the upper including a toe portion, a lateral portion, a heel edge portion, and a medial portion, at least one upper fastening element carried by the upper proximate the attachment edge of the upper, wherein the at least one upper fastening element includes structure to functionally join the at least one upper fastening element with a respective mating feature of a respective at least one lower mating fastening element, and a lower having a sole and a sidewall, an attachment edge along an upper edge of the sidewall of the lower, the attachment edge of the lower including a toe portion, a lateral portion, a heel edge portion, and a medial portion, the upper and lower being connected by a hinge located proximate one of the heel edge portions or the toe portions, and the respective at least one lower mating fastening element carried by the lower proximate the attachment edge of the lower, wherein the at least one lower mating fastening element includes structure to functionally join the at least one lower mating fastening element with a respective mating feature of a respective at least one upper fastening element, wherein during step (a), the lateral portions of the upper and lower are detached from one another, wherein during step (a), the medial portions of the upper and lower are detached from one another and the upper is placed upon the foot and at least one of the foot and the upper is oriented nonparallel to the lower while the upper and the lower are separated, aiding placement of the footwear onto the foot of a young child, a handicapped person, a disabled person, and an elderly person upon at least one of:

wherein during step (a), at least one of:

a) the toe portion of the attachment edge of the upper and the toe portion of the attachment edge of the lower are detached from one another, and b) the heel edge portion of the attachment edge of the upper and the heel edge portion of the attachment edge of the lower are detached from one another;

(b) placing a foot contacting surface of the lower either proximate or contacting a sole of the person's foot; and (c) joining each at least one upper fastening element of the upper and each respective at least one lower mating fastening element of the lower with one another, securing the footwear onto the person's foot, wherein step (a) occurs before step (b) and step (b) occurs before step (c).

2. The method as recited in claim 1, wherein the at least one upper fastening element includes a first material and the at least one lower mating fastening element includes a second material, wherein the first material and the second material are magnetically attracted to one another, wherein step (c) is accomplished by using the magnetic attraction between the first material and the second material.

3. The method as recited in claim 1, wherein the at least one upper fastening element includes a first mechanically coupling feature and the at least one lower mating fastening element includes a second mechanically coupling feature, wherein the first mechanically coupling feature and the second mechanically coupling feature are designed to be mechanically coupled to one another, wherein step (c) is accomplished by mechanical coupling the first mechanically coupling feature of each at least one upper fastening element and the respective second mechanically coupling feature of each at least one lower mating fastening element to one another.

4. The method as recited in claim 1, wherein the at least one upper fastening element and the at least one lower mating fastening element are designed to be mechanically coupled to one another, wherein the mechanical coupler interface between each at least one upper fastening element and each respective at least one lower mating fastening element includes at least one of:

a) a pin through an aperture arrangement,
b) a snap element,
c) a hook element,
d) a hook and tab arrangement,
e) a J shaped channel,
f) a twist and lock arrangement, and
g) a pin and socket arrangement, wherein step (c) is accomplished by using the mechanical coupling.

5. The method as recited in claim 1, wherein step (b) is assisted by the hinged assembly between the upper and the lower.

6. The method as recited in claim 1, at least one of the upper and the lower further comprising at least one illuminating element, the method further comprising a step of activating the illuminating element to emit light.

7. The method as recited in claim 1, the upper comprising at least one electrical component and the lower comprising another at least one electrical component, wherein one or more of the at least one fastening element and one or more of the at least one mating fastening element provide electrical communication between the at least one electrical component in the upper and the another at least one electrical component in the lower, the method further comprising a step of transferring electrical power between the at least one electrical component in the upper and the another at least one electrical component in the lower.

8. The method as recited in claim 1, the lower further comprising at least one wheel, the method further comprising a step of using the at least one wheel to aid in mobility.

9. The method as recited in claim 1, the lower further comprising at least one retractable wheel, the method further comprising steps of:

placing the at least one retractable wheel in an extended position, wherein a portion of the extended at least one retractable wheel is positioned below a bottom of the lower; and using the at least one extended wheel to aid in mobility.

10. The method as recited in claim 1, the lower further comprising at least one wheel powered by a mobility assistance system controller, the mobility assistance system controller including a motor, a portable power source, and circuitry operating the motor via power from the portable power source, the method further comprising a step of using the at least one wheel powered by a mobility assistance system controller to aid in mobility.

11. A method for placing footwear onto a person's foot, the method comprising steps of:

(a) inserting the person's foot through a foot passageway of an upper of the footwear, the footwear comprising:

an upper having an enclosed circumference defining a foot passageway, an attachment edge along a lower edge of the upper, the attachment edge of the upper including a toe portion, a lateral portion, a heel edge portion, and a medial portion, at least one upper fastening element carried by the upper proximate the attachment edge of the upper, wherein the at least one upper fastening element includes structure to functionally join the at least one upper fastening element with a respective mating feature of a respective at least one lower mating fastening element, and a lower having a sole and a sidewall, an attachment edge along an upper edge of the sidewall of the lower, the attachment edge of the lower including a toe portion, a lateral portion, a heel edge portion, and a medial portion, the upper and lower being connected by a hinge located proximate one of the heel edge portions or the toe portions, and the respective at least one lower mating fastening element carried by the lower proximate the attachment edge of the lower, wherein the at least one lower mating fastening element includes structure to functionally join the at least one lower mating fastening element with a respective mating feature of a respective at least one upper fastening element, wherein at least three of:

a) the toe portion of the attachment edge of the upper and the toe portion of the attachment edge of the lower are detached from one another and the upper and the lower are oriented being non-parallel to one another aiding placement of the footwear onto the foot of a young child, a handicapped person, a disabled person, and an elderly person, b) the lateral portion of the attachment edge of the upper and the lateral portion of the attachment edge of the lower are detached from one another and the upper and the lower are oriented being non-parallel to one another aiding placement of the footwear onto the foot of a young child, a handicapped person, a disabled person, and an elderly person, c) the heel edge portion of the attachment edge of the upper and the heel edge portion of the attachment edge of the lower are detached from one another and the upper and and the lower are oriented being non-parallel to one another aiding placement of the footwear onto the foot of a young child, a handicapped person, a disabled person, and an elderly person, and d) the medial portion of the attachment edge of the upper and the medial portion of the attachment edge of the lower are detached from one another and the upper and lower are oriented being non-parallel to one another aiding placement of the footwear onto the foot of a young child, a handicapped person, a disabled person, and an elderly person, (b) placing a foot contacting surface of the lower one-ef either proximate or contacting a sole of the person's foot; and (c) joining each at least one upper fastening element of the upper and each respective at least one lower mating fastening element of the lower with one another, securing the footwear onto the person's foot, wherein step (a) occurs before step (b) and step (b) occurs before step (c).

12. The method as recited in claim 11, wherein the at least one-upper fastening element includes a first material and the at least one lower mating fastening element includes a second material, wherein the first material and the second material are magnetically attracted to one another, wherein step (c) is accomplished by using the magnetic attraction between the first material and the second material.

13. The method as recited in claim 11, wherein the at least one upper fastening element includes a first mechanically coupling feature and the at least one lower mating fastening element includes a second mechanically coupling feature, wherein the first mechanically coupling feature and the second mechanically coupling feature are designed to be mechanically coupled to one another, wherein step (c) is accomplished by mechanical coupling the first mechanically coupling feature of each at least one upper fastening element and the respective second mechanically coupling feature of each at least one lower mating fastening element to one another.

14. The method as recited in claim 11, wherein the at least one upper fastening element and the at least one lower mating fastening element include a mechanically coupled interface, wherein the mechanically coupled interface between each at least one upper fastening element and each respective at least one lower mating fastening element includes at least one of: a) a pin through an aperture arrangement, b) a snap element, c) a hook element, d) a hook and tab arrangement, e) a J shaped channel, f) a twist and lock arrangement, and g) a pin and socket arrangement, wherein step (c) is accomplished by using the mechanical coupling.

15. The method as recited in claim 11, wherein step (b) is assisted by the hinged assembly between the upper and lower.

16. The method as recited in claim 11, at least one of the upper and the lower further comprising at least one illuminating element, the method further comprising a step of activating the illuminating element to emit light.

17. The method as recited in claim 11, the upper comprising at least one electrical component and the lower comprising another at least one electrical component, wherein one or more of the at least one fastening element and one or more of the at least one mating fastening element provide electrical communication between the at least one electrical component in the upper and the another at least one electrical component in the lower, the method further comprising a step of transferring electrical power between the at least one electrical component in the upper and the another at least one electrical component in the lower.

18. The method as recited in claim 11, the lower further comprising at least one wheel, the method further comprising a step of using the at least one wheel to aid in mobility.

19. The method as recited in claim 11, the lower further comprising at least one retractable wheel, the method further comprising steps of:

placing the at least one retractable wheel in an extended position, wherein a portion of the extended at least one retractable wheel is positioned below a bottom of the lower; and using the at least one extended wheel to aid in mobility.

20. The method as recited in claim 11, the lower further comprising at least one wheel powered by a mobility assistance system controller, the mobility assistance system controller including a motor, a portable power source, and circuitry operating the motor via power from the portable power source, the method further comprising a step of using the at least one wheel powered by a mobility assistance system controller to aid in mobility.

* * * * *